US005797596A

United States Patent [19]

Morigami et al.

[11] Patent Number: 5,797,596

[45] Date of Patent: Aug. 25, 1998

[54] FINISHER WITH A STAPLING FUNCTION

[75] Inventors: Yuusuke Morigami, Toyohashi; Tadashi Kobayashi, Toyokawa; Misao Nishikawa, Kani; Hiroyuki Yoshikawa, Aichi-Ken; Kazuhito Ozawa, Toyokawa; Ryo Hirano, Toyohashi; Shinobu Seki; Shinji Wakamatsu, both of Toyokawa, all of Japan

[73] Assignee: Minolta Co., Ltd., Osaka, Japan

[21] Appl. No.: 633,452

[22] Filed: Apr. 17, 1996

[30] Foreign Application Priority Data

| | | | |
|---|---|---|---|
| Apr. 27, 1995 | [JP] | Japan | 7-103819 |
| Apr. 27, 1995 | [JP] | Japan | 7-103821 |
| Apr. 28, 1995 | [JP] | Japan | 7-104945 |
| Apr. 28, 1995 | [JP] | Japan | 7-105240 |
| May 1, 1995 | [JP] | Japan | 7-107186 |
| Aug. 24, 1995 | [JP] | Japan | 7-216300 |

[51] Int. Cl.[6] ..... B65H 39/02

[52] U.S. Cl. ..... 270/58.11; 270/58.14

[58] Field of Search ..... 270/58.08, 58.09, 270/58.11, 58.12, 58.13, 58.14

[56] References Cited

U.S. PATENT DOCUMENTS

| | | | |
|---|---|---|---|
| Re. 35,087 | 11/1995 | Uto et al. | 270/58.09 |
| 4,516,714 | 5/1985 | Braun et al. . | |
| 4,523,750 | 6/1985 | Hubler . | |
| 4,592,651 | 6/1986 | Oikawa et al. . | |
| 4,627,707 | 12/1986 | Tani et al. . | |
| 4,903,952 | 2/1990 | Russel et al. | 270/58.09 |
| 4,965,629 | 10/1990 | Hiroi et al. . | |
| 5,029,831 | 7/1991 | Green | 270/58.08 |
| 5,032,876 | 7/1991 | Murakami . | |
| 5,037,077 | 8/1991 | Kubota et al. | 270/58.12 |
| 5,112,034 | 5/1992 | Uto et al. | 270/58.12 |
| 5,129,640 | 7/1992 | Kosaka et al. | 270/58.12 X |
| 5,330,170 | 7/1994 | Uotani et al. | 270/58.08 |
| 5,385,340 | 1/1995 | Hiroi et al. . | |
| 5,388,819 | 2/1995 | Ushirogata | 270/58.11 X |
| 5,447,298 | 9/1995 | Watanabe et al. | 270/58.11 |

*Primary Examiner*—Hoang Nguyen

*Attorney, Agent, or Firm*—Burns, Doane, Swecker & Mathis, LLP

[57] ABSTRACT

A finisher comprising a non-sort tray disposed at an uppermost location, a stacking tray for stapling disposed at an intermediate location, and a large-capacity storing tray disposed at a lower location. In a non-sort mode, sheets discharged from a copying machine are first stored in the non-sort tray and, when the non-sort tray is occupied full, subsequent incoming sheets are stored in the storing tray. In a stapling mode, sheets are collected on the stacking tray and, after a stapling operation, they are stored in the storing tray.

17 Claims, 100 Drawing Sheets

ONE-SIDE ALIGNMENT

CENTER ALIGNMENT

FINISHER WITH A STAPLING FUNCTION

BACKGROUND OF THE INVENTION

1. Field of the Invention

The present invention relates generally to a finisher and, more particularly, to a finisher of the type which sorts and staples sheets discharged from an image forming apparatus, such as electrophotographic copying machine or laser printer.

2. Description of Prior Art

Generally, various kinds of finisher have been known which sort image-formed sheets discharged from a copying machine into a desired number of sets or staple them. In a conventional stapling apparatus of the type in which sheets are aligned into a set on a tray and the set of sheets are moved to a stapling position for being stapled, the stapled sheet set being then returned to the original position. In a recent trend toward diversified finishing practice, there are increasing needs for center stapling by which a set of sheets is stapled at a center portion thereof (as seen with weekly magazines).

To enable the center stapling mode, the stapling unit is comprised of a staple head and a staple anvil disposed separately, and a connector for interconnecting them. In such arrangement, one half of the sheet set is delivered into the stapling unit, and the stapling unit is moved in a direction perpendicular to the direction of sheet transport to carry out staple driving operation at plural points in the mean time. Thereafter, the sheet set is delivered in the same direction as the direction of incoming delivery. This may be advantageous from the view point of space requirements. In such stapling unit, however, it is necessary that after stapling operation the connector must be shunted outward from the track of the sheet set, with the result that, during this shunting process, operation for transporting a next set of sheets into the finisher (including copying operation) is held on standby, which no doubt unfavorably affects copy productivity as a whole. More particularly, in the corner stapling operation, shifting or shunting the stapling unit can more adversely affect copy productivity.

As a conventional finisher there is also known an arrangement such that a non-sort tray for collecting sheets not subject to stapling is disposed on a uppermost location; a stapling tray for sheets to be stapled is vertically disposed; and a stapled sheet set is allowed to drop as it is onto a storing tray disposed below. However, where the stapling tray is vertically disposed, the tray is subject to a height limitation and the range of sizes of sheets allowable for stapling is limited. As a result, even if the maximum allowable size of sheet for copying is A3, sheets of such size are not acceptable for stapling finish.

From the view point of ease of sheet removal from the finisher, it is desirable that non-sort sheets and stapled sheet sets be transported to and stored at an upper portion of the finisher. However, transporting stapled sheet sets upward requires an increase in the size of transport assembly and is not practical. While it is desirable that the storage for non-sort sheets be of a large capacity so as to meet voluminous copying needs, the provision of a large-capacity storage for non-sort sheets at the upper portion of the finisher requires that the storage for stapled sheet sets be disposed at a much lower location, which involves greater inconvenience for sheet removal.

A finisher without plural trays for stapling has been proposed such that after stapling is carried out on a stacking tray for temporarily loading and storing sheets, the stapled sheet set is allowed to drop onto a separate tray provided below the stacking tray. However, where the stapling operation is carried out on the stacking tray, it is necessary that feed of a next set of sheets to the stacking tray, or next set copying, be held on standby for the time required for stapling plus the time required for transport of the sheet set from the stacking tray, which unfavorably affects copy productivity as a whole.

Further, as above-mentioned, to enable the center stapling mode of finishing, the stapling unit comprises the staple head and the staple anvil disposed separately, and the connector for interconnecting them. In such stapling unit, it is necessary that the connector which is likely to interfere with the sheet set must be caused to shunt out of the path of sheet set transport after the end of the stapling operation. However, starting the transport of the sheet set only after such shunting results in a decrease in the efficiency of stapling, which in turn obliges the feed of next sheet set to the finisher (including copying operation) to be held on standby. As a result, copy productivity is lowered as a whole.

In conventional finishers, when plural sets of sheets are subjected to stapling, staples are applied on same points. Therefore, when stapled sets of sheets are stacked on the storing tray, the staples lie one over another, with the result that the stapled portions become more bulky than other portions. This poses a problem that when a next set of sheets is stored, the next sheet set often interferes with the bulkier portion of the previously stored sheet set, thus disturbing sheet set alignment on the store tray.

In order to solve such inconvenience, Japanese Patent Publication No. 6-19616 teaches that each time a set of sheets is stored a storing tray is shifted in a direction perpendicular to the direction of sheet transport so as to control for stapled portions being not concentrated at one point. However, this requires a mechanism for shifting the storing tray, resulting in an increase in the size of finisher. Further, such arrangement involves a problem that since sets of sheets are stacked in staggered relation on the storing tray, sheet set removal from the storing tray takes more time.

SUMMARY OF THE INVENTION

Accordingly, it is an object of the present invention to provide a finisher which does not require the shifting of a stapling unit during a corner stapling operation and can enhance copy productivity.

It is another object of the present invention to provide a finisher which affords easy removal of a non-sort sheet and a stapled sheet set and enables a voluminous storing of non-sort sheets, and which is capable of stapling even large-size sheets and enables easy transport of a stapled sheet set.

It is another object of the present invention to provide a finisher which enables transport a next set of sheets to a stacking tray even during a stapling operation and can enhance copy productivity.

It is another object of the present invention to provide a finisher which enables fast delivery of a stapled sheet set from a stapling unit and can enhance the efficiency of stapling.

It is another object of the present invention to provide a finisher which is capable of not only side stapling but also center stapling and is also capable of staple driving at any desired points.

It is another object of the present invention to provide a finisher which permits stapled sheet set to be stored on a storing tray in good alignment without the storing tray being shifted.

In order to accomplish the foregoing objects, a finisher in accordance with the present invention comprises sheet stacking means, transport means for transporting a sheet set from the stacking means, and stapling means for driving staples onto a sheet set transported from the stacking means. The stapling means include a sheet set transport section, a staple head and a staple anvil which are disposed across the sheet set transport section, and a connector interconnecting the staple head and the staple anvil. The staple head and the staple anvil have their home positions set at a corner stapling position, and the connector has its home position set at a position offset outward from a track of sheet set transport, the staple head, the staple anvil and the connector being integrally reciprocally shiftable from their respective home positions in a direction perpendicular to the direction of sheet set transport.

According to the foregoing arrangement, during the corner stapling operation, the stapling means need not move in any way and may stay as set at its home position. This permits fast stapling operation, eliminate the necessity of a next set of sheets being held on standby, and provides for improvement in copy productivity. Of course, it is possible to move the stapling means to carry out the center stapling with respect to a sheet set, or to staple a leading portion or a trailing portion of the sheet set at plural points.

Further, a finisher in accordance with the present invention includes a non-sort tray disposed on an upper tier, a stapling tray disposed on a middle tier, and a large-capacity storing tray disposed on a lower tier, so that sheets discharged from the image forming apparatus may be selectively transported to the non-sort tray, the stapling tray, or the storing tray, and so that stapled sheet sets are transported to the storing tray.

In the present invention, the stapling tray for stapling is of the type in which sheets are stacked one over another and is disposed generally horizontally. Therefore, the stapling tray is not subject to any height limitation may be a tray having a large area. This permits sheets of a larger size to be accepted for stapling. Furthermore, stapled sets of sheets may be transported downward to the storing tray which is located at a lower site. This arrangement, as compared to an arrangement for upward transport, is advantageous in that the sheet set transport unit can be simplified in construction.

Non-sort sheets are accommodated in the uppermost tier tray. This non-sort tray is designed to be of a small capacity for meeting ordinary copy needs. Therefore, the non-sort tray may be of thin construction and, this, coupled with the fact that the stapling tray is horizontally disposed, permits the large-capacity storing tray at the lower location to be set at a relatively high level. For voluminous copying operation, non-sort sheets are first accommodated in the non-sort tray and, when that tray is fully occupied, sheets are transported to the storing tray, whereby needs for sheet supply may be met. Since the non-sort tray is disposed at the uppermost location, and since the large-capacity storing tray is disposed at a relatively high level, easy sheet removal from the finisher is made possible.

Further, the finisher includes a sheet set transport unit for transporting a sheet set stapled by the stapling means to the storing tray. The stapling means is movable in a direction perpendicular to the direction of sheet set transport, and can drive staples at plural points located in the moving direction. The sheet set transport unit transports a sheet set in the same direction as the direction in which the sheet set is fed from sheet stacking means. According to the construction, when a sheet set fed from the stacking means is stapled at a center portion or at a side portion, the stacking means is empty and, therefore, a next set of sheets can be transported to the stacking means even if stapling operation is in progress. Therefore, copying operation need not be held on standby for the next sheet set, and this provides for improvement in copy productivity.

In the present invention, the distance, on the sheet stacking means, between a leading edge regulating position in the direction of sheet transport and the stapling position is preferably longer than the distance between a trailing edge of a sheet set placed at a trailing portion stapling position and the stapling position. In the case of the trailing portion stapling, when the sheet set is set at the trailing portion stapling position, a regulating member for regulating the leading end of the sheet stacking means may be allowed to enter the regulating position, and this, in turn, enables early transport of a next sheet set into the sheet stacking means.

Further, a finisher in accordance with the present invention comprises control means for controlling the speed of sheet set transport by transport means for transporting a sheet set after a stapling operation. The stapling means is movable in a direction perpendicular to the direction of sheet set transport and can effect staple driving at plural points in the direction of its movement, the stapling means being adapted to shunt outward from the path of sheet transport. When the stapling means is shunted outward from the path of sheet transport, the control means accelerate sheet set transport by the transport means. Through this control, the stapled sheet set is promptly discharged from the stapling means, and this enables an early start of stapling operation with respect to a next set of sheets without a standby time being required.

The control means also controls the shift movement of the stapling means and, if, during stapling operation, the spacing between the leading edge position of the sheet set and possible interference position of the stapling means relative to the sheet set is large, the control means simultaneously set the time for the start of movement of the stapling means to the shunting position after final stapling operation and the time for the start of sheet set transfer by the transport means. Through this control, the stapled sheet set is promptly discharged from the stapling means, and this enables an early start of stapling operation with respect to a next set of sheets without a standby time being required.

Further, a finisher in accordance with the invention comprises sheet stacking means, transport means for transporting a sheet set from the stacking means, stapling means, and shifting means for shifting the stapling means in a direction perpendicular to a direction of sheet set transport. The transport means is capable of transporting a sheet set selectively to a plurality of stapling positions in the sheet transport direction. For example, in the case of leading portion stapling mode, the transport means transport the sheet set so that the leading portion may be set at the staple driving position of the stapling means; and in the case of center stapling mode, the transport means transport the sheet set so that the center portion is set at the staple driving position. During stapling operation, the stapling means is shifted by shifting means in a direction perpendicular to the direction of sheet set transport and is once halted at a desired point, at which point staple driving is carried out.

That is, according to the above invention, the sheet set can be transported by the transport means to plural stapling positions; the stapling means is movable in a direction perpendicular to the path of sheet set transport; and any stapling position in that direction can be selected as desired.

Through this arrangement, not only side (leading portion or trailing portion) stapling, but also center stapling are possible. And stapling may be effected at plural points, not at a corner point only.

Further, a finisher in accordance with the present invention comprises a stacking tray for collecting sheets, one sheet at a time, stapling means for stapling a set of sheets stacked on the stacking tray, a storing tray for storing thereon stapled sheet sets, and control means for changing a stapling point on sheets for each predetermined number of sets. According to the invention, the stapling point on sheets is changed for each predetermined number of sheet sets so that when sheet sets are loaded on the storing tray, stapled portions (staples) will not be centered on one particular point. Therefore, stapled portions on the storing tray are prevented from becoming excessively bulky, it being thus unlikely that sheet sets on the storing tray will go out of alignment, or that storing sheet sets on the tray will be substantially hindered. It is unnecessary to shift the storing tray and this eliminates the need for a shift mechanism. Sheet sets may be stacked on the storing tray in orderly end alignment, and this affords easy removal of sheet sets from the store tray.

In the present invention, wherever used, the term "change or vary the stapling point" means that the stapling point is shifted a distance corresponding to the length of a staple; that the stapling point is shifted a distance corresponding to the width of a staple; or that the stapling point is changed between the leading portion and the trailing portion in the direction of sheet set transport, from the one to the other and vice versa. Such a change is made in the intervals of a predetermined number of copies, for example, between each odd nth copy and each even nth copy; in the two or three copy intervals; or for 10 sets of sheets, 1–5 sets on one hand and 6–10 sets on the other. Where such a change is made between the leading portion and the trailing portion in the direction of sheet set transport, image information should be stored in the electronic memory of the image forming apparatus, and accordingly image should be inverted 180° with respect to sheets to be stapled at the leading portion or the trailing portion.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Embodiments of finisher according to the present invention will now be described with reference to the accompanying drawings.

(Copying System)

Figure 1:
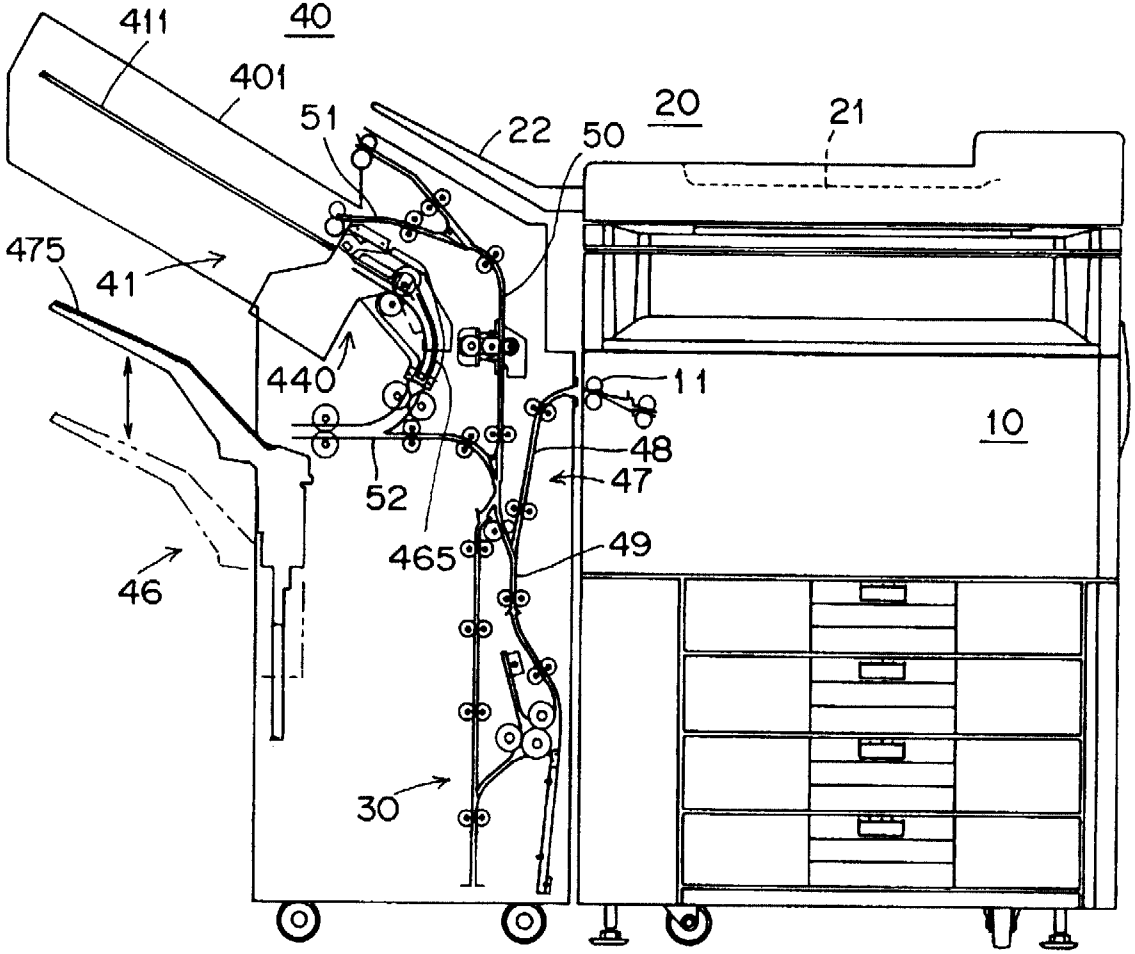
FIG. 1 is a schematic view showing a copying system including a finisher in accordance with the present invention.

FIG. 1 illustrates a copying system including a finisher 40 which is one embodiment of the present invention, the finisher 40 being connected to a copying machine 10. The copying machine 10 is of the type in which an image is formed on a copy sheet in a well known electrophotographic manner, such that copy sheets, as copying is effected thereon, are discharged from a sheet discharge station 11, one sheet at a time with image-formed surface turned up. An automatic document feeder 20 (hereinafter referred to as "ADF") is provided on the top of the machine 10. The ADF 20 feeds a set of documents set on a tray 21, one document at a time, onto a platen glass (not shown) of the machine 10, each document being discharged/loaded onto a tray 22 after an image has been read from the document. Each document set on the platen glass automatically by the ADF 20 or manually by an operator is read with respect to its image by an image reader (not shown) incorporated in the machine 10, the image so read being converted into digital data which in turn are stored in a memory of a controller. Copying operation is carried out by reading the image data with appropriate editing made as required. In particular, the controller permits various modes of copying operations including copying documents in different page orders, document image reversal processing, i.e., copying of a document image turned 180°, copying two document images arranged on one copy sheet, and duplex copying in which copying is effected on both sides of a copy sheet.

(Finisher)

As FIG. 1 shows, the finisher 40 comprises a non-sort tray 401 for carrying/accommodating sheets discharged from the machine 10, a stapling section 41 for stacking sheets and staple-fastening stacked sheets, a storing section 46 for storing a stapled set of sheets, and a sheet transport assembly 47 for selectively transporting sheets discharged from the machine 10 to the non-sort tray 401, the stapling section 41, or the storing section 46. The sheet transport assembly 47 has annexed thereto a folding mechanism 30 which will be described in detail hereinafter.

(Sheet Transport Assembly)

Figure 2:
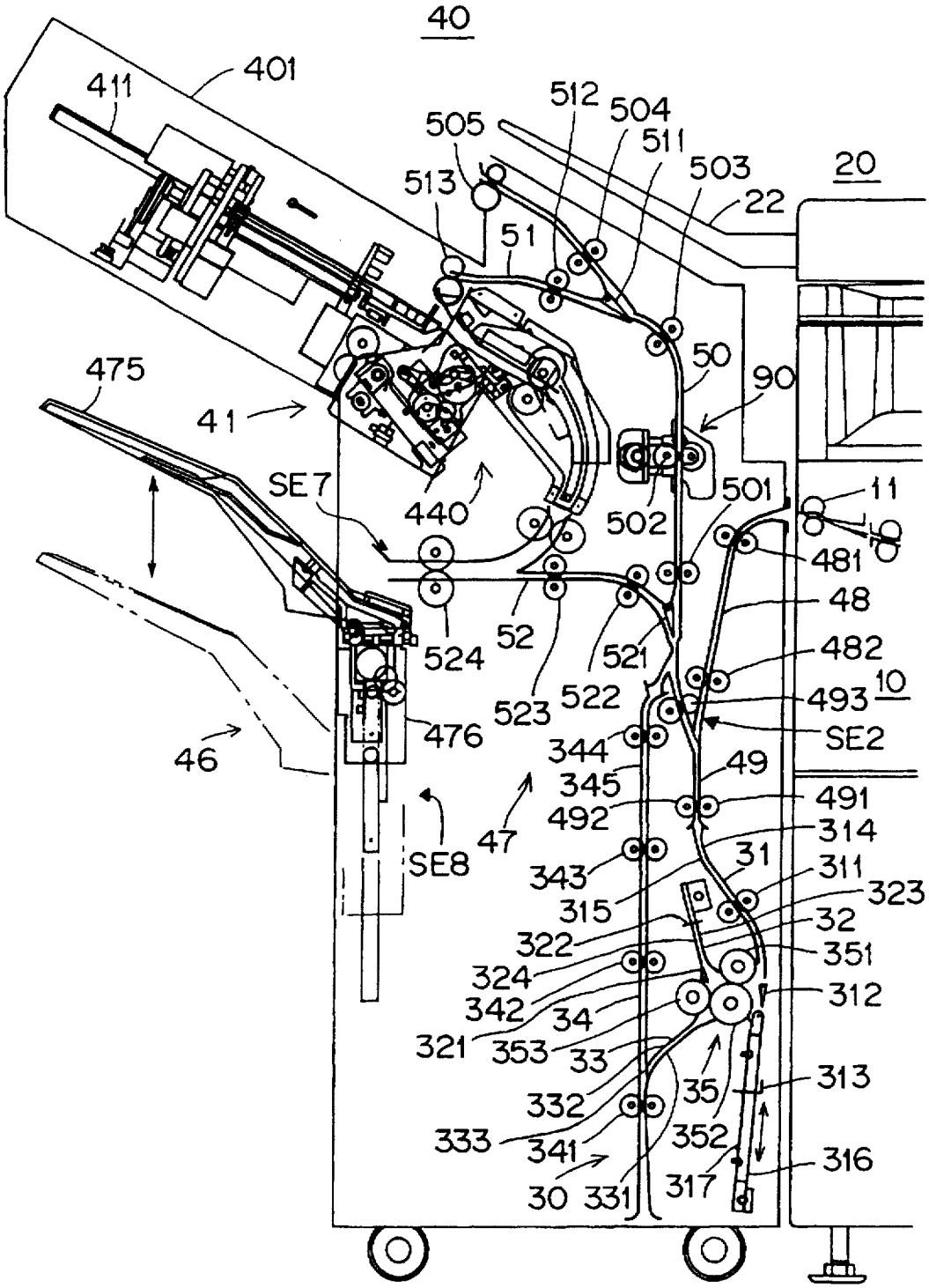
FIG. 2 is a schematic view showing the finisher.

The sheet transport assembly 47, as shown in FIG. 2, comprises a transport path 48 for receiving sheets from a sheet discharge station 11 of the machine 10 and transporting them downward, a switch-back transport path 49 for inverting sheets in leading-and-trailing/top-and-bottom relation, a transport path 50 for transporting sheets to the non-sort tray 401, a transport path 51 branched from the transport path 50 for transporting sheets to the stapling section 41, and a transport path 52 branched from the transport path 50 for transporting sheets to the storing section 46.

Figure 3:
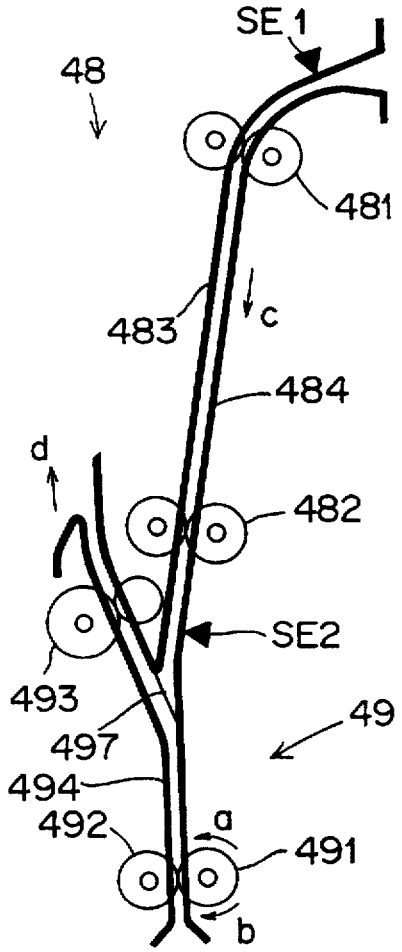
FIG. 3 is an elevation view showing a transport path in the finisher.

As FIG. 3 shows, the transport path 48 comprises a transport roller pair 481, 482 which is forwardly rotatable in the direction of sheet transport (direction of arrow c), guide plates 483, 484, and a sheet detecting sensor SE1.

The switch-back transport path 49 comprises a transport roller 491 which is forward/reverse rotatable in the direction of arrow a or b, a follower roller 492 driven to rotate in contact with the roller 491, a transport roller pair 493 for transporting switched-back sheets in the direction of arrow d, a guide plate 494, and a sheet detecting sensor SE2. A flexible resin sheet 497 is attached to a curved corner portion of the guide plate 483.

A sheet transported along the transport path 48 in the direction of arrow c is guided to the switch-back transport path 49 after clearing the resin sheet 497. Upon lapse of a predetermined time after the trailing edge of the sheet being detected by the sensor SE2, that is, when the trailing edge of the sheet clears the resin sheet 497, the roller 491 is switched reverse so that the sheet is transported in the direction of arrow d. In this case, the resin sheet 497 functions to prevent the sheet from going backward.

Figure 4:
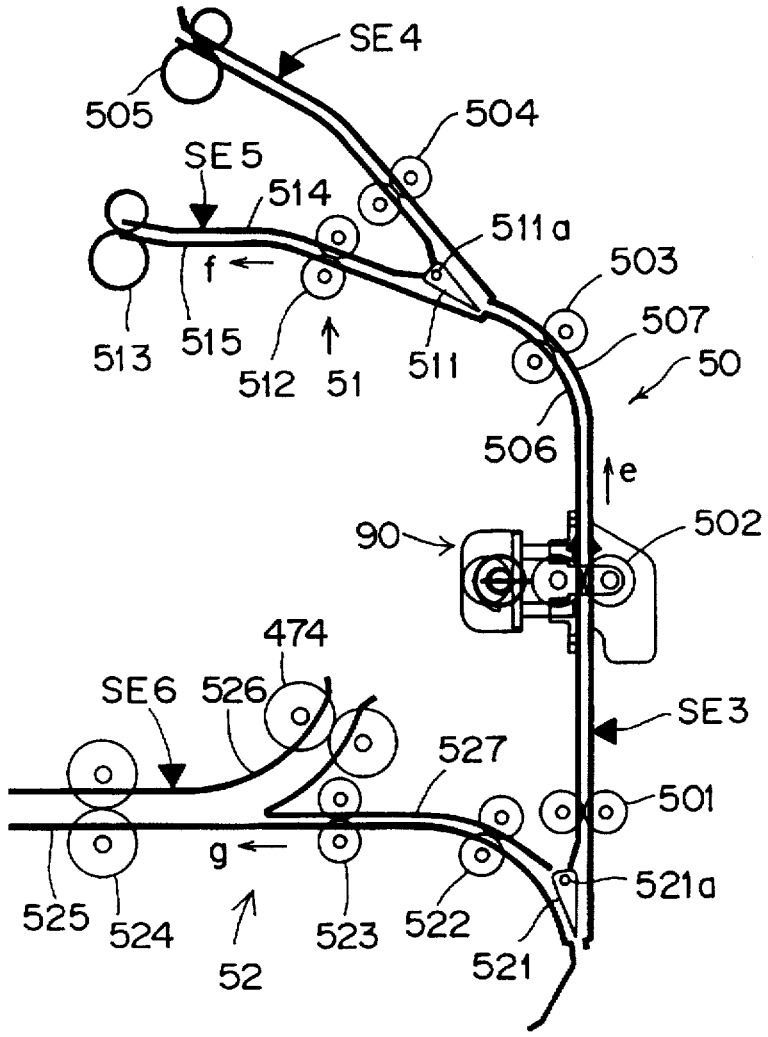
FIG. 4 is an elevation view showing another transport path in the finisher.

The transport path 50, as FIG. 4 shows, comprises transport roller pairs 501, 502, 503, 504 for transporting sheets in the direction of arrow e, a discharge roller pair 505, guide plates 506, 507, and sheet detecting sensors SE3, SE4. On the transport path 50 there is provided a punch mechanism 90 for punching a leading portion or a trailing portion of a sheet to make holes therein while the sheet is being transported. The punch mechanism 90 is well known in the art and need not be described herein.

The transport path 51 comprises a changeover pawl 511 for switching over the destination of sheet transport, a transport roller pair 512 for transporting sheets in the direction of arrow f, a discharge roller pair 513, guide plates 514, 515, and a sheet detecting sensor SE5.

The transport path 52 comprises a changeover pawl 521 for switching over the destination of sheet transport, transport roller pairs 522, 523 for transporting sheets in the direction of arrow g, a discharge roller pair 524, guide plates 525, 526, 527, and a sheet detecting sensor SE6.

The changeover pawls 511 and 521 are pivotable by solenoids not shown about support shafts 511*a* and 521*a* respectively. Each sheet transported through the switch-back transport path 49 is guided by the changeover pawl 521 to one of the transport paths 50 and 52. Each sheet transported along the transport path 50 is guided on its way by the changeover pawl 511 either for continued travel on the transport path 50 or for entry into the transport path 51. Sheets are transported from the discharge roller pair 505 to the non-sort tray 401, or from the discharge roller pair 513 to the stapling section 41, or from the discharge roller pair 524 to the storing section 46, whichever may be the case. Immediately after a trailing edge of a sheet is detected by the sensor SE4, SE5 or SE6, discharge roller pair 505, 513, or 524, whichever may be appropriate, is reduced in rotation velocity to permit the sheet to be discharged at reduced speed without any disturbance being caused to the condition of sheet stack.

The transport roller pair 503 disposed on the transport path 50 consists of a pair of cylindrical rollers (so-called straight rollers) slightly longer than a maximum available roller width for sheet passage (which corresponds to A3 size), whereas each of the other roller pairs consists of a plurality of small-width rollers mounted on a support shaft. Further, the level of contact pressure to be applied by the transport roller pair 503 is set sightly higher than that of any of the other roller pairs 501, 502, 504, 512, and 513. More specifically, the contact pressure of the transport roller pair 503 is more than 2 kg, whereas that of the other roller pairs is less than 2 kg.

By designing the transport roller pair 503 to be of such arrangement it is intended that the fold of each copy sheet which is effected by the folding mechanism 30 to be described hereinafter is rendered more positive by causing the sheet to pass through the transport roller pair 503.

For sheets to be received into the storing section 46 via the transport path 52, the transport roller pair 522 or 523 may be designed to be of a similar arrangement to the transport roller pair 503.

(Storing Section)

As FIG. 2 shows, the storing section 46 comprises a storing tray 475, a drive mechanism 476 for moving the tray 475 upward and downward, a sensor SE7 for detecting the number of sheets accommodated, and a sensor SE8 for detecting a lower limit position of the storing tray 475. Onto the tray 475 are delivered sheets from the transport path 52, one at a time, in the case of bulk copying, or as will be described in detail hereinafter sets of sheets stapled at the stapling section 41. Each time a copy sheet is received/loaded on the storing tray 475, the tray 475 is lowered a predetermined quantity by the drive mechanism 476. When the descent of the tray 475 to the lower limit position is detected by the sensor SE8, the tray 475 is already fully occupied and accordingly subsequent copying operation is interrupted.

The arrangement of the drive mechanism 476 for lowering the tray 475 a predetermined quantity at a time for bulk sheet stacking is well known in the art and need not be described in detail herein.

(Folding Mechanism)

Figure 18A:
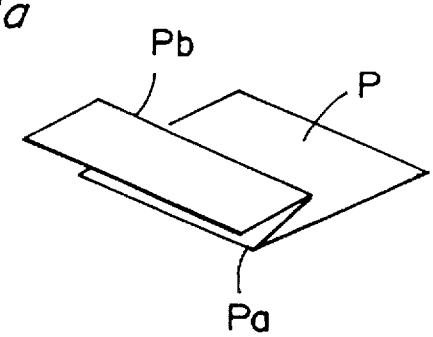
FIGS. 18*a*, 18*b* and 18*c* are explanatory views showing a Z-folded sheet and the condition in which the sheet is discharged onto a tray.

The folding mechanism 30 is provided immediately below the sheet transport assembly 47 and has a function to fold an image-formed sheet into two parts along a center line in the direction of sheet transport, a function to unfold the folded sheet and centrally form a fold line, and a function to Z-fold the sheet. The term "Z-fold" means a manner of folding such that the sheet is folded two times with the image-formed surface facing up as illustrated in FIG. 18*a*.

Specifically, as FIG. 2 shows, the folding mechanism 30 comprises a first transport path 31 which receives a sheet from the switch-back transport path 49 and transports the same downward for the purpose of first folding, a second transport path 32 for effecting second folding, a sheet folding station 35 for effecting a few types of sheet folding, a third transport path 33 for transporting the folded sheet further downstream, and a fourth transport path 34 for inverting (switching back) the sheet in leading-and-trailing/top-and-bottom relation for delivery of the sheet into the transport path 50.

The sheet folding station 35 comprises three folding rollers 351, 352 and 353, of which the roller 352 is a main folding roller, the other two rollers 351, 353 being auxiliary folding rollers. The main folding roller 352 is forward/reverse rotatable and the auxiliary folding rollers 351, 353 are driven to rotate while in pressure contact with the main folding roller 352. The manner of sheet folding operation of the folding rollers 351, 352, 353 will be described hereinbelow.

The first transport path 31 is located on the right side of the sheet folding station 35 and comprises a forward/reverse rotatable transport roller pair 311, a sheet-feed direction changeover pawl 312, a sheet regulator plate 313, and guide plates 314, 315, 316, 317. The regulator plate 313 serves to regulate a leading edge of a sheet fed into the first transport path 31 for sheet folding, thereby to determine a first fold position, and is up-and-down movable by an unillustrated stepping motor in a lower portion of the first transport path 31. The position (level) of the regulator plate 313 is changed according to the mode of folding (two-folding or Z-folding) and the sheet size. The changeover pawl 312, driven by a solenoid not shown, is operative to switch for causing a sheet fed to the first transport path 31 to be transported directly to the sheet folding station 35, or for causing the sheet to be transported once to the lower portion of the first transport path 31.

The second transport path 32 is located right above the sheet folding station 35 and comprises a sheet-feed direction changeover pawl 321, a sheet regulator plate 322, and guide plates 323, 324. The regulator plate 322 serves to regulate a leading edge of a sheet fed into the second transport path 32 to determine a second fold position, and is switchable by a solenoid not shown, at an upper portion of the second transport path 32, for a choice between two positions selectable for the direction of sheet transport. The changeover pawl 321, actuated by a solenoid not shown, is operative to switch for causing a sheet which has passed between the folding rollers 351 and 352 to be transported to the second transport path 32, or for causing the sheet to pass between the folding rollers 352 and 353 without being guided to the second transport path 32.

The third transport path 33 comprises guide plates 331, 332 for guiding a sheet exiting the folding rollers 352, 353 to the fourth transport path 34. The fourth transport path 34 is located on the left side of the sheet folding station 35 and comprises a forward/reverse rotatable transport roller pair 341, vertical portions of the guide plates 331 and 332, a guide plate 345, and transport roller pairs 342, 343, 343 for transporting sheets upward. The fourth transport path 34 is connected at its upper end to aforesaid transport path 50. At the exit side of the third transport path 33, a flexible resin sheet 333 is attached to a curved portion of the guide plate 332. When a copy sheet which has been transported on the third transport path 33 clears the resin sheet 333, through reverse rotation of the transport roller pair 341 the sheet is transported downward along the fourth transport path 34. When the trailing edge of the sheet clears the resin sheet 333, the transport roller pair 341 is switched into forward rotation so that the sheet is transported upward along the fourth transport path 34. In the case of this switch back, the resin sheet 333 functions to prevent the sheet from moving backward.

Figure 5:
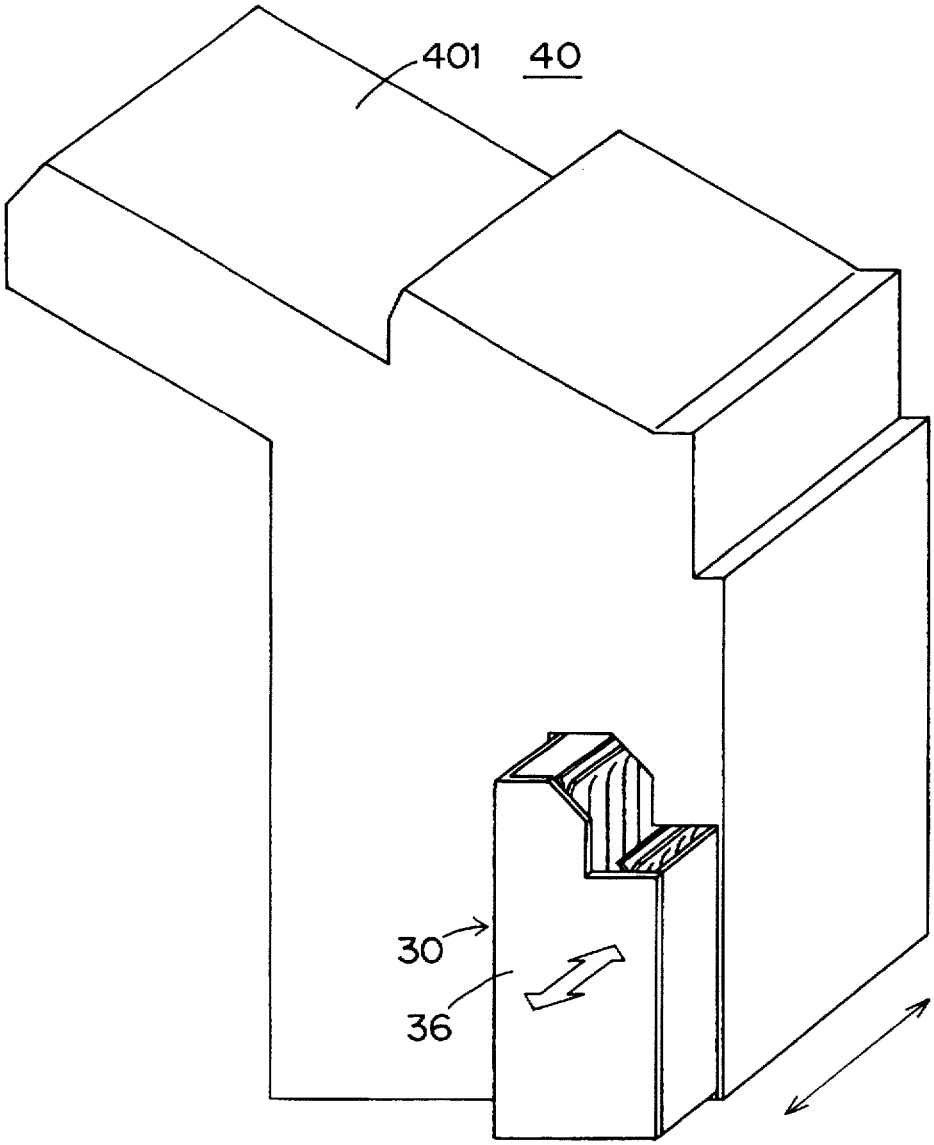
FIG. 5 is a perspective view showing an external appearance of the finisher.

As FIG. 5 shows, the folding mechanism 30 is unitized such that it is integrally housed in a casing 36, which can be retractably pulled out on the front side of the finisher 40. This pull-out can be made by causing rollers carried on the casing 36 to go into rolling movement on an unillustrated rail provided in the finisher 40. The folding mechanism 30 is removable from the finisher 40 and this provides ease of maintenance, checking, and paper jam handling.

(Operation of Folding Mechanism)

Operation of the folding mechanism 30 will now be explained. The folding mechanism 30 has four modes of function, namely, a first mode or Z-folding, a second mode or two-folding, a third mode or forming a fold line, and a fourth mode or allowing passage of a sheet without subjecting the sheet to the process of folding. These modes may be selectively used by an operator on a control panel of the machine 10.

Figure 6:
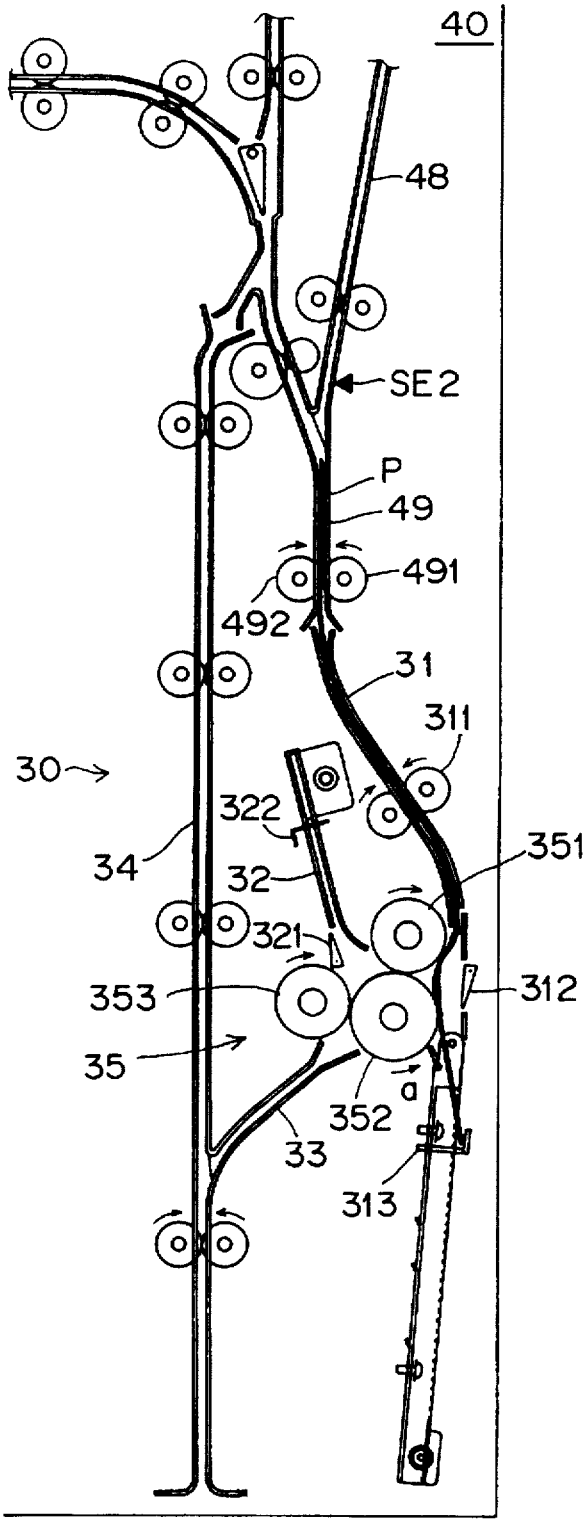
FIGS. 6 to 8 are views in elevation for explaining an operation (in Z-folding mode) of a sheet folding mechanism in the finisher.

The first mode of operation or Z-folding is a handling step in which a large-size sheet (A3, B4) is folded in a Z-pattern as shown in FIG. 18*a*. As FIG. 6 shows, sheet P is fed from the transport path 49 to the first transport path 31 through the transport rollers 491, 492, and is then transported downward by the transport roller pair 311 toward the regulator plate 313. The regulator plate 313 is set to a position corresponding to the Z-folding mode which is variable according to the size of the sheet P. When the leading edge of the sheet P abuts the regulator plate 313, the sheet P bends toward the nip between the folding rollers 351 and 352 under a transport force given by the transport roller pair 311. The bend of the sheet P is threaded into the nip between the folding rollers 351 and 352 so that a first folding is carried out. The folding rollers 351, 352, 353 are driven forward in the direction of arrow a as the leading edge of the sheet P is detected by the sensor SE2.

Figure 7:
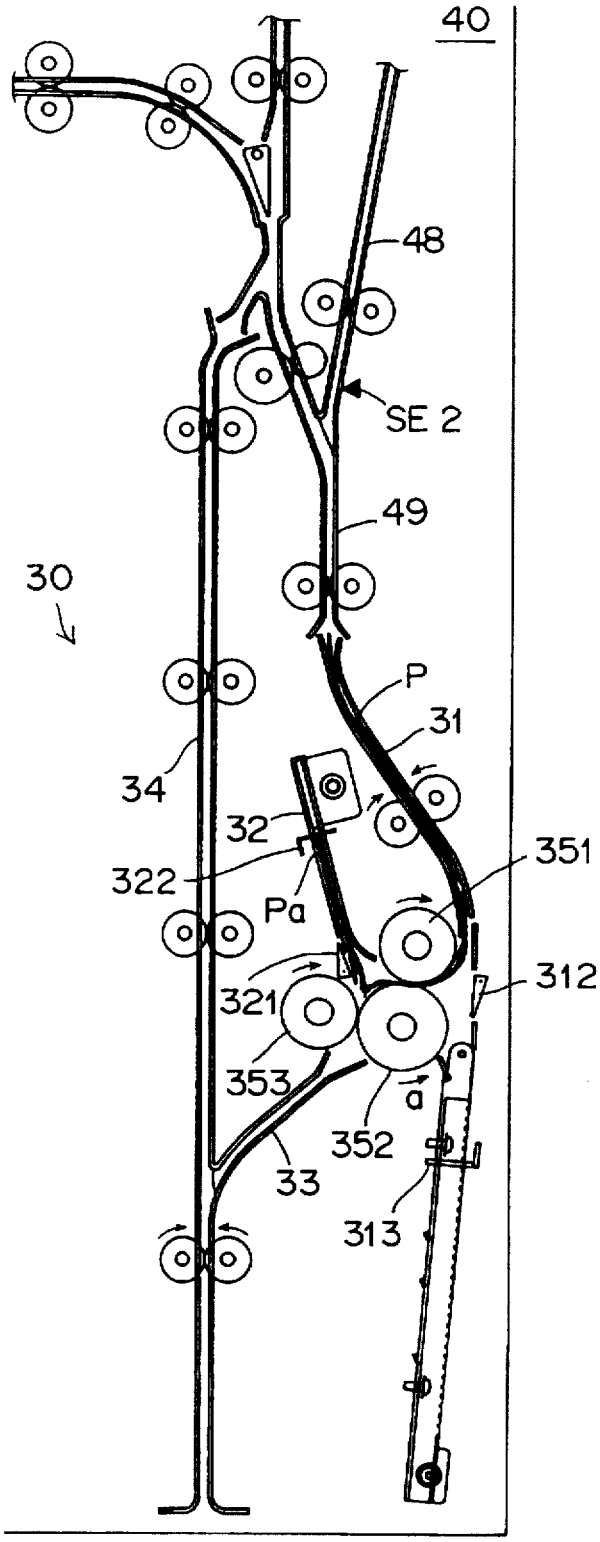

The sheet P with which the first folding has been completed in the above described manner is guided by the changeover pawl 321 for transfer to the second transport path 32, with a first fold Pa positioned on the leading side. The regulator plate 322, located on the second transport path 32, is disposed at a position set for second folding operation of the Z-folding mode which is variable according to the size of the sheet P. As FIG. 7 shows, when the first fold Pa of the sheet P abuts the regulator plate 322, the sheet P bends toward the nip between the folding rollers 352 and 353 under a transport force given by the folding rollers 351, 352, and this bend is threaded into the nip between the folding rollers 352 and 353 so that second folding is carried out.

Figure 8:
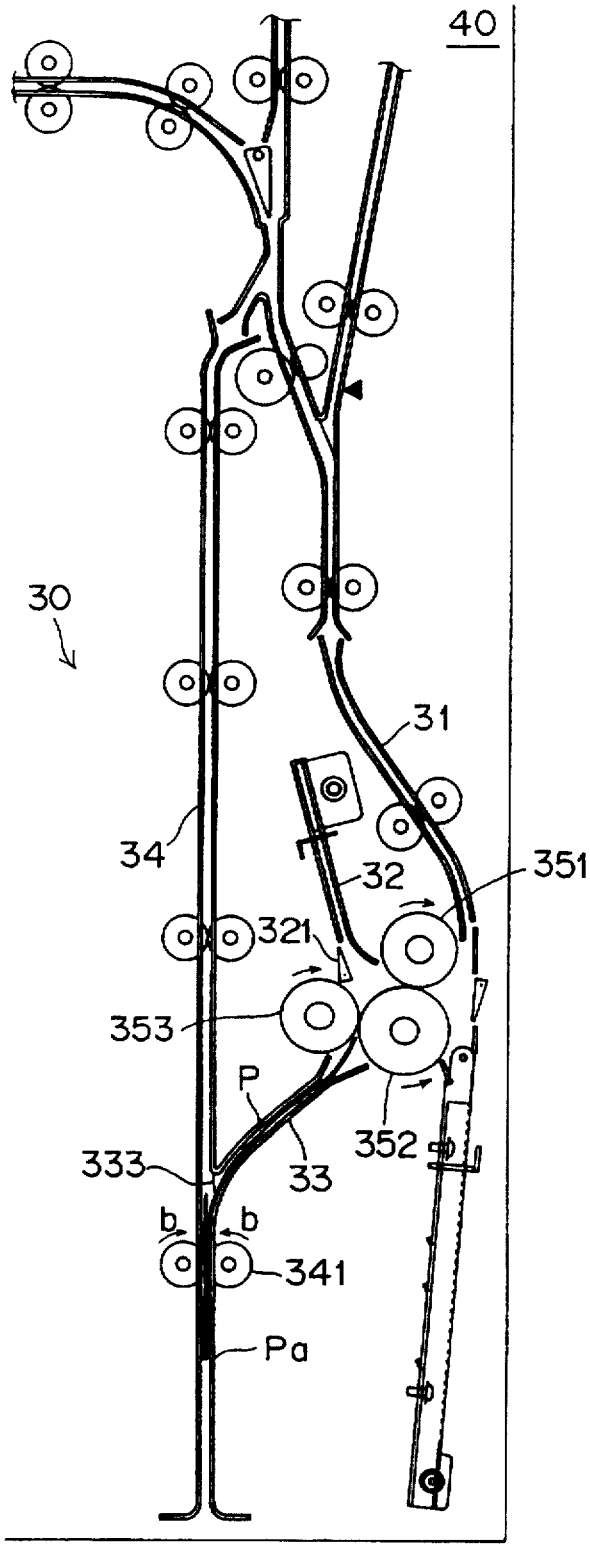
Figure 9:
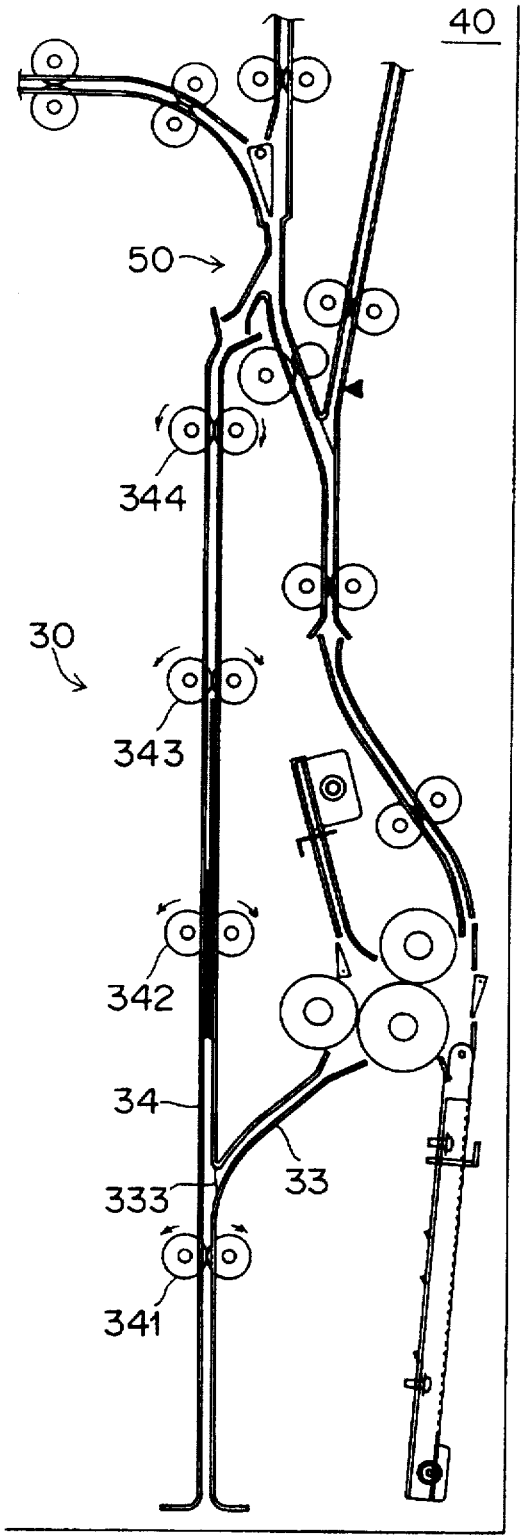
FIGS. 9 to 12 are views in elevation for explaining an operation (in two-folding mode) of the sheet folding mechanism.

The sheet P with which the Z-folding has been completed as above described, as FIG. 8 shows, is fed through the third transport path 33 into the fourth transport path 34, being transported downward through reverse rotation of the transport roller pair 341 in the direction of arrow b. When the trailing edge of the sheet P clears the resin sheet 333, the transport roller pair 341 is switched for forward rotation. Thereupon, the sheet P is switched back so that, as FIG. 9 shows, the sheet P is transported upward by the transport rollers 341, 342, 343, 344 along the fourth transport path 34 for entry into the transport path 50.

Figure 18B:
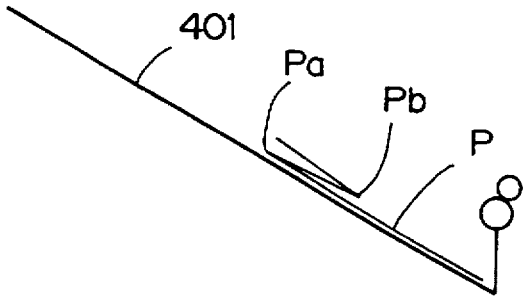
Figure 18C:
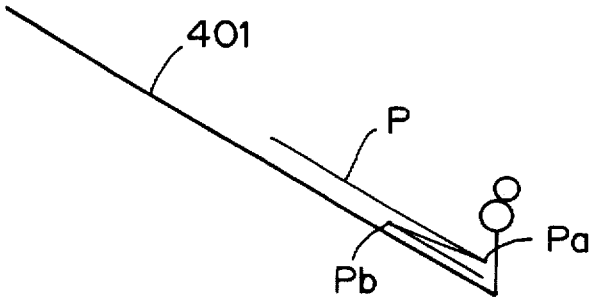

By switching back the Z-folded sheet on the fourth transport path 34 it is intended that the alignment of sheets as they are discharged onto the tray 401, 411 or 475 will not be disturbed. If the Z-folded sheet P is discharged onto the non-sort tray 401 (or tray 411 or 475) without being switched back on the fourth transport path 34, as FIG. 18*b* shows, the sheet is placed on the tray 401 with the fold Pb facing up. When a next sheet is discharged on the preceding sheet, the leading edge of the next sheet may seat beneath the second fold Pb of the sheet P. The sheet P is switched back on the fourth transport path 34 in order to prevent such disturbance in sheet alignment. Thus, as illustrated in FIG. 18c, the sheet P is discharged onto the tray 401, with the fold Pb positioned at the underside, and the next sheet is placed on the preceding sheet P in proper alignment therewith.

Figure 10:
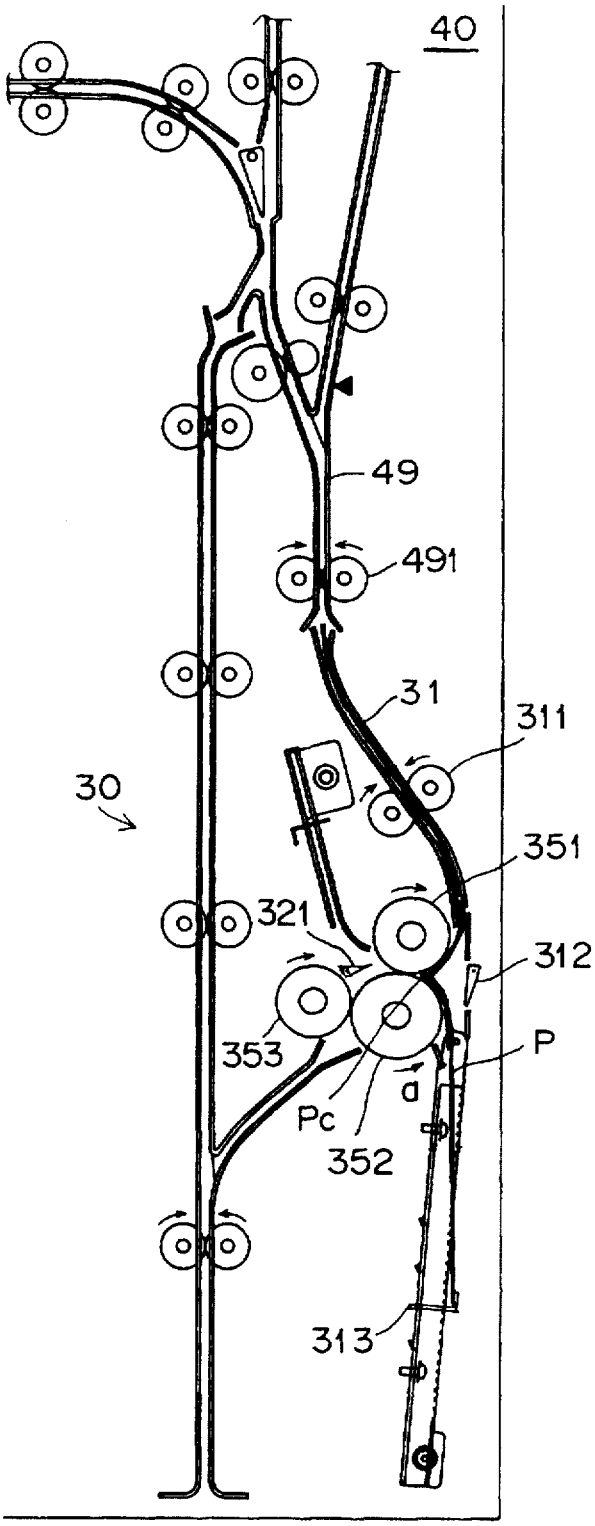

The second mode of operation or two-folding is a operation such that a sheet is centrally folded in the direction of sheet transport. In this case, as FIG. 10 shows, the regulator plate 313 on the first transport path 31 is set at a position adjusted for centrally folding the sheet P according to the size of the sheet P. When the leading edge of the sheet P which has been transported along the first transport path 31 abuts the regulator plate 313, the center portion of the sheet P bends to be threaded into the nip between the folding rollers 351 and 352 as already explained with reference to FIG. 6. The centrally folded sheet P is guided by the changeover pawl 321, with the fold Pc positioned on the leading side, for being fed into the nip between the folding rollers 352 and 353 (see FIG. 11). Then, the sheet P is fed through the third transport path 33 into the fourth transport path 34 and, as already explained with reference to FIG. 8, through the changeover of the transport roller pair 341 from reverse run in the direction of arrow b to forward run, the sheet P is switched back to be transported upward along the fourth transport path 34 (see FIG. 12) for entry into the transport path 50.

Figure 13:
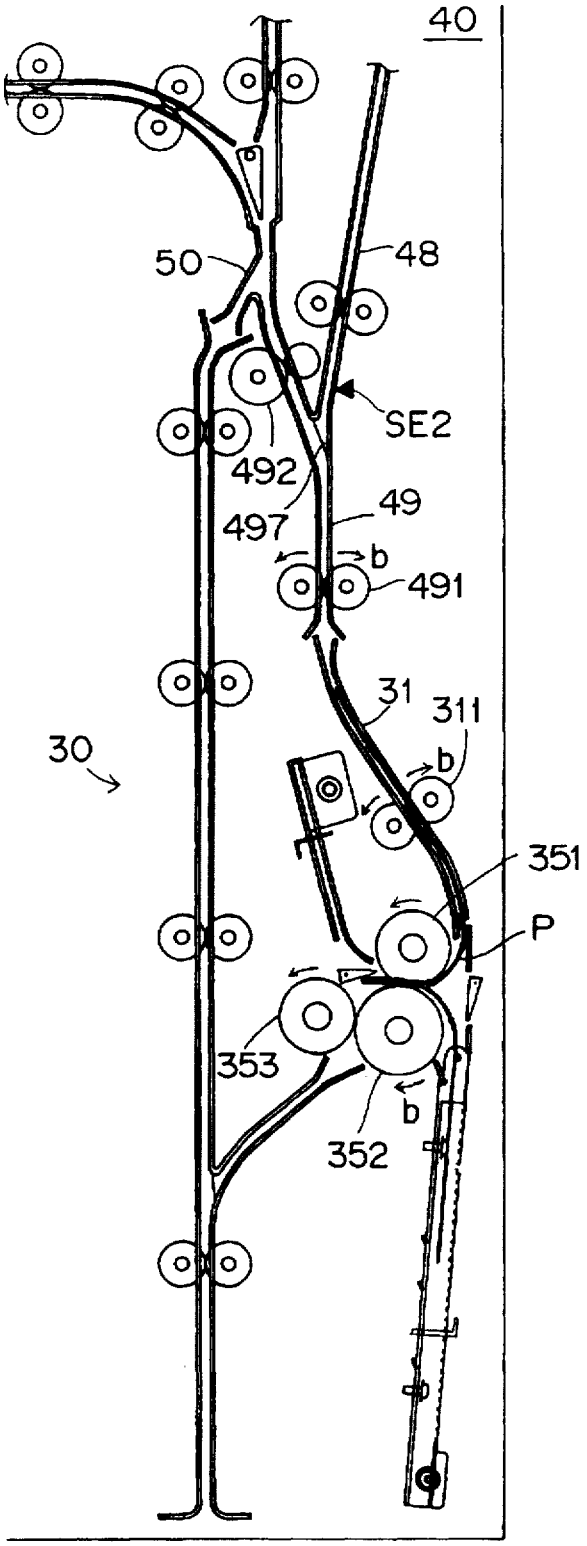
FIGS. 13 and 14 are views in elevation for explaining an operation (in fold line setting mode) of the sheet folding mechanism.

The third mode of operation or pre-folding is a operation for centrally folding sheet P in the direction of sheet transport as a preparatory step for center stapling of sheets by means of a stapling unit 441 to be described hereinafter. As already explained with reference to FIG. 10, the sheet P which has been transported along the first transport path 31 is regulated by the regulator plate 313 with respect to the leading edge of the sheet P and the center portion of the sheet P is threaded into the nip between the folding rollers 351 and 352. As FIG. 13 illustrates, when the center portion of the sheet P is threaded a predetermined amount into the nip between the folding rollers 351 and 352, the transport roller pair 311 and folding rollers 351, 352 are driven reverse in the direction of arrow b. Switching over to such reverse rotation is effected when a predetermined time period is counted by a timer which starts counting upon detection by the sensor SE2 of the trailing edge of the sheet P. Through aforesaid reverse rotation the sheet P is transported upward along the first transport path 31, with the folded portion of the sheet P being smoothed meanwhile, and is thus transported back to the transport path 49. The transport rollers 491, 492 are also switched to reverse rotation almost simultaneously with the transport roller pair 311 so that the sheet P is guided by the resin sheet 497 for being transferred from the transport path 49 to the transport path 50. This pre-folding mode is carried out only when the center stapling is required, and the sheet P is discharged from the transport path 51 onto the stacking tray 411 of the stapling section 41.

Figure 15:
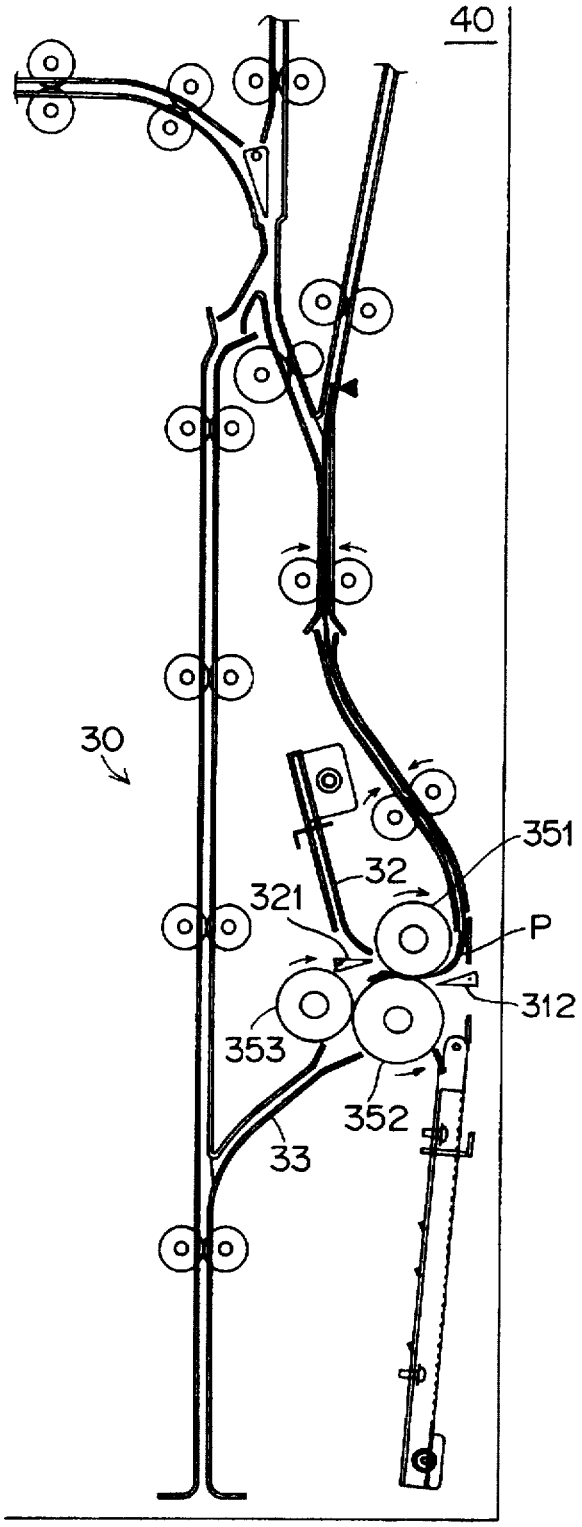
FIGS. 15 to 17 are view in elevation for explaining an operation (in sheet passage mode) of the sheet folding mechanism.
Figure 16:
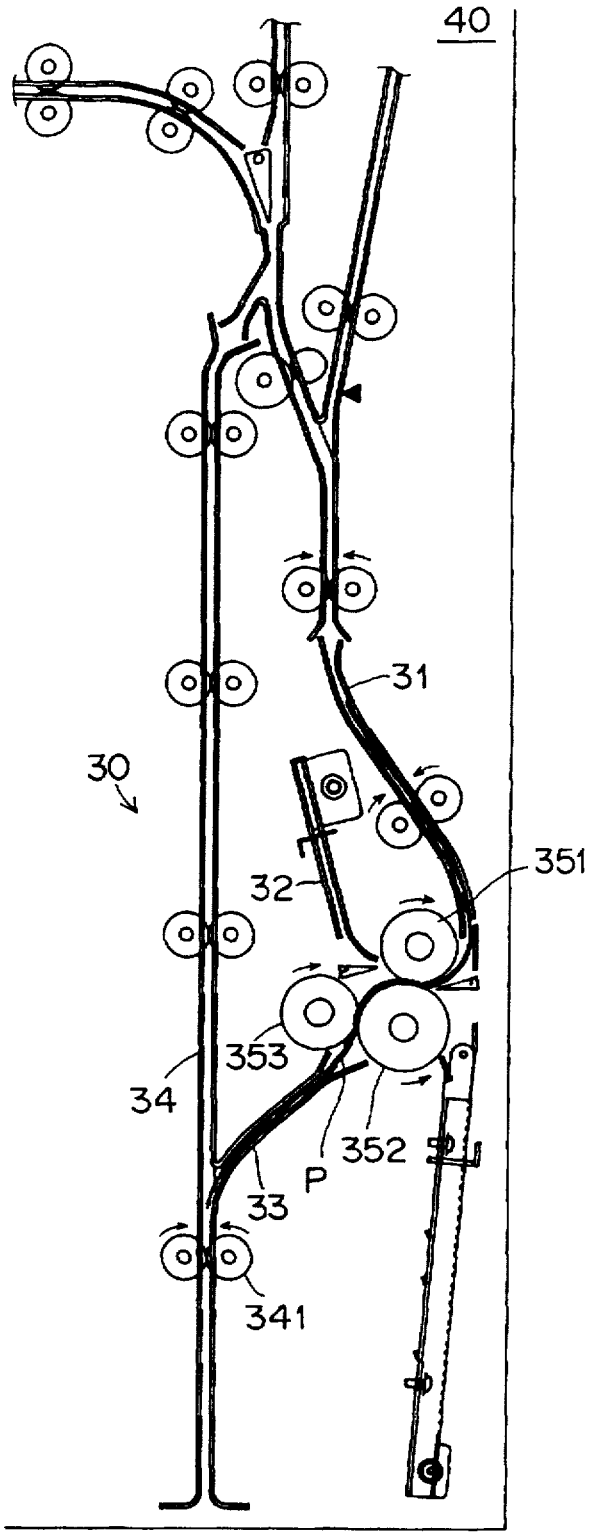
Figure 17:
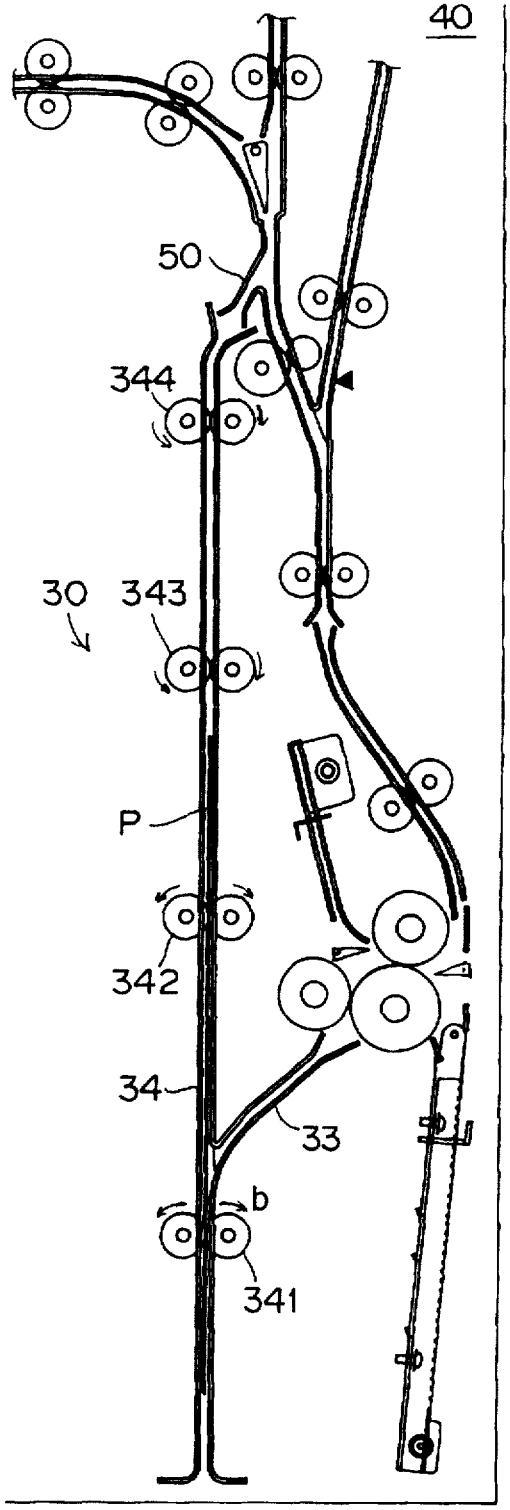

The fourth mode or sheet passage mode is a operation such that a sheet is simply allowed to pass through the folding mechanism 30 without sheet folding being carried out. When sheet P is fed from the transport path 49 to the first transport path 31, as FIG. 15 shows, the changeover pawl 312 is set at a position for guiding the sheet P to the folding rollers 351, 352, and the changeover pawl 321 is set to a position for guiding the sheet P to the folding rollers 352, 353. Therefore, the sheet P is allowed to pass through the nip between the folding rollers 351 and 352 and then through the nip between the folding rollers 352 and 353 for entry into the third transport path 33 (see FIG. 16). Then, as already explained with reference to FIGS. 8 and 12, through the changeover of the transport roller pair 341 from reverse run in the direction of arrow b to forward run, the sheet P is switched back to be transported upward along the fourth transport path 34 for entry into the transport path 50.

(Stapling Section)

Figure 19:
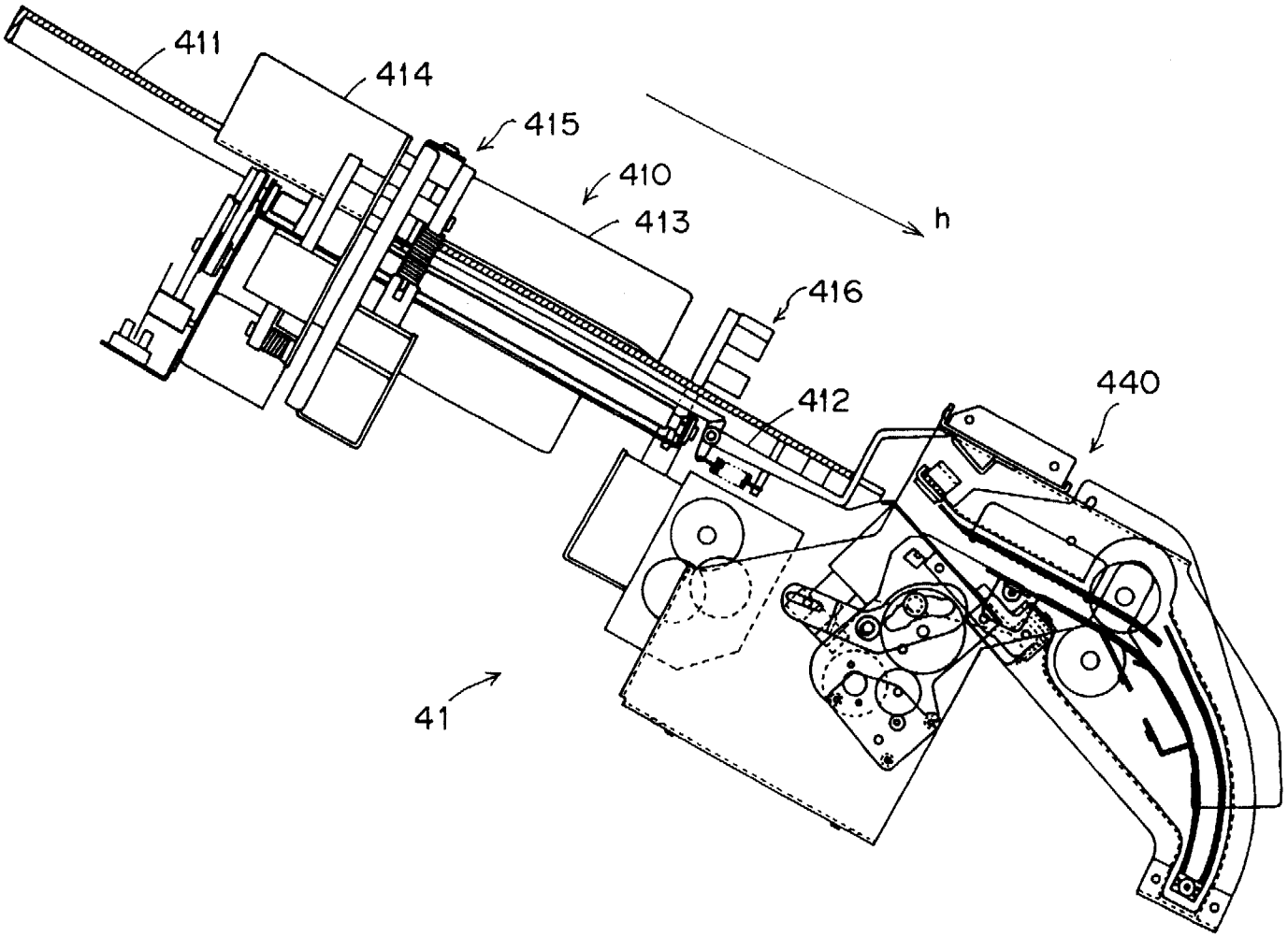
FIG. 19 is a front view showing a stapling section.

Next, the stapling section 41 will be described. The stapling section 41 comprises a sheet stacking station 410 and stapling station 440 as illustrated in FIGS. 19 and 20.

The sheet stacking station 410 comprises the inclined stacking tray 411, a lead stopper 412 mounted to a leading end portion of the tray 411, a sheet side edge alignment plate 413, and first and second chucking devices 415, 416 which are capable of gripping/releasing sheets at sides thereof respectively.

The stacking tray 411 serves to temporarily carry and accommodate for stapling purposes sheets discharged from the transport path 51 with their image formed surface facing down. The lead stopper 412 serves to stop leading edges (trailing edge when viewed in the direction of sheet discharge onto the tray 411) of sheets discharged onto the tray 411 and align the sheets in the direction of sheet transport to the stapling station 440 (shown by arrow h). The side alignment plate 413 is reciprocally movable in a direction (shown by arrow i) perpendicular to the direction of sheet transport and serves to align sheets laterally on the tray 411. The first chucking device 415 is disposed on the front side of tray 411, and the second chucking device 416 is disposed on the rear side of the tray 411. These chucking devices 415, 416 are operative to grip sides of sheets alternately so as to prevent float-up of the sheets. The first chucking device 415 also has a function to grip a set of sheets for transport of the same to the stapling station 440.

Figure 20:
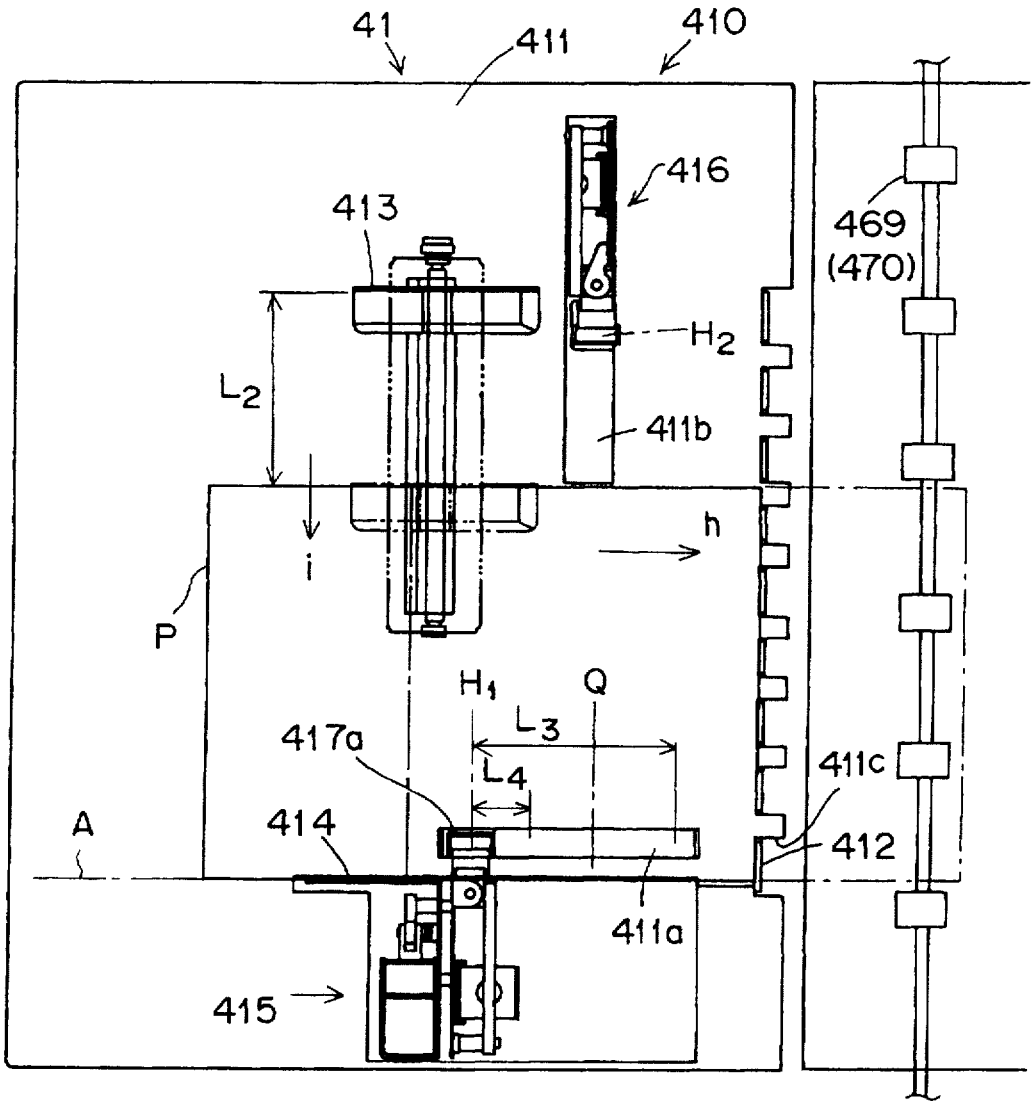
FIG. 20 is a plan view showing a stacking tray in the stapling section.
Figure 21:
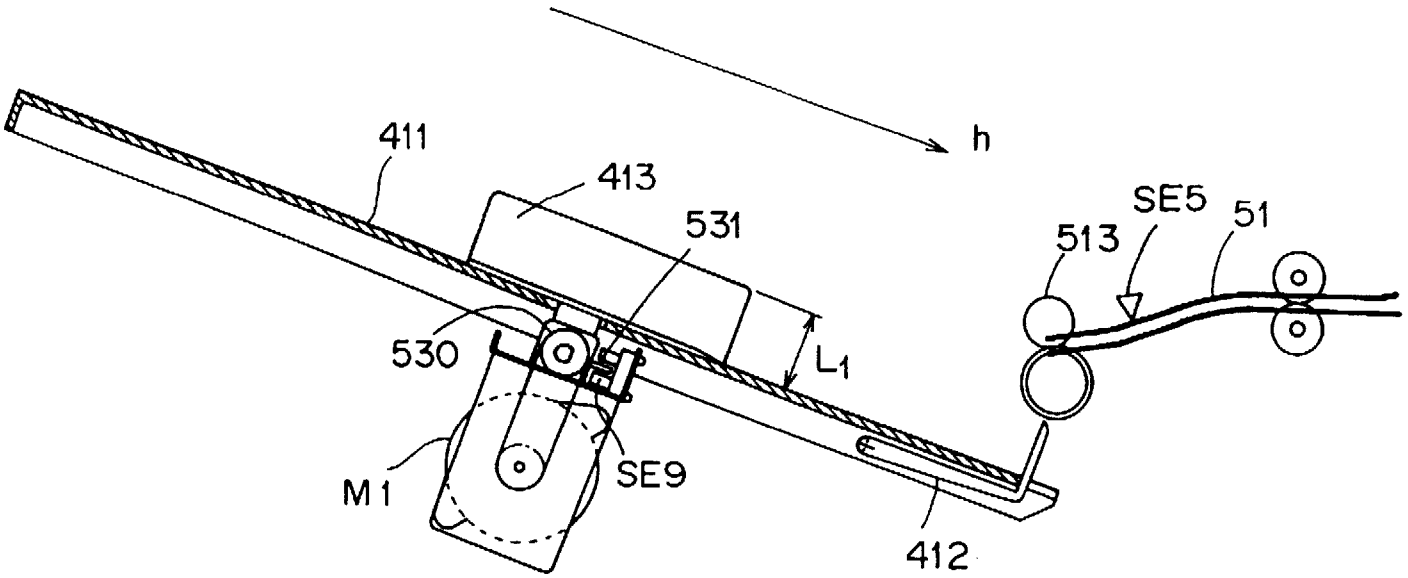
FIG. 21 is a sectional view showing the stacking tray.

As shown in FIGS. 20 and 21, the side alignment plate 413 has a height $L_1$ that is higher than a maximum height of a sheet bulk that can be carried on the stacking tray 411, and is disposed at a position opposed to an alignment reference plate 414 mounted to the first chucking device 415. This alignment plate 413 is mounted on a spiral shaft 530 located on the rear side of the tray 411 for reciprocal movement on the shaft 530 in a direction shown by arrow i in concert with the rotation of the shaft 530, the spiral shaft 530 being forward/reverse driven by a stepping motor M1. The alignment plate 413, held on standby at a position indicated by solid line, is actuated through forward run of the motor M1 to advance to an alignment position (shown by a double-dashed chain line in FIG. 20) corresponding to the size of sheet P. In this case, the other side of the sheets P abuts the reference plate 414 for alignment. The presence of the alignment plate 413 at its home position is detected upon entry of a light shielding plate 531 fixed to the alignment plate 413 into the optical axis of a sensor SE9 disposed on the rear side of the tray 411. The distance $L_2$ of run by the alignment plate 413 for its advance to the alignment position is determined by controlling the number of pulses for driving the stepping motor M1 in accordance with the size of the sheet P.

Sheets are transported on the sheet transport assembly 47 with their center taken as a reference line, and are individually discharged from the discharge roller pair 513 of the transport path 51 onto the stacking tray 411 (see double-dashed chain lines in FIG. 20). Upon lapse of a predetermined time period of from the detection of the trailing edge of each sheet by the sensor SE5 and up to complete placement of the sheet on the tray 411, the stepping motor M1 is driven forward. When one sheet is aligned between the alignment plate 413 and the reference plate 414, the motor M1 is driven reverse and accordingly the alignment plate 413 retracts to the home position. That is, each time a sheet is received onto the tray 411, the alignment plate 413 advances in the direction of arrow i to cause the sheet to abut the reference plate 414 for alignment on the tray 411 on a one-side reference basis.

(First Chucking Device)

Figure 22:
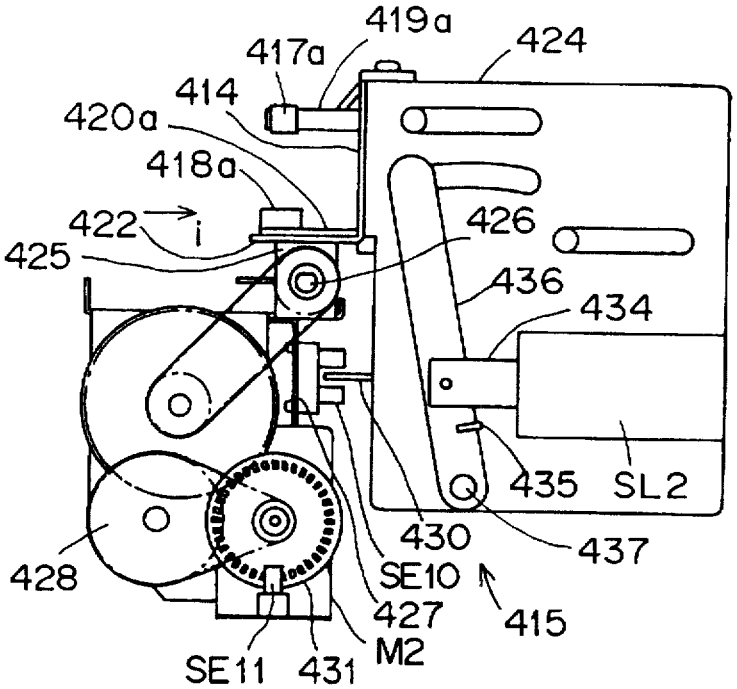
FIG. 22 is a front view showing a first chucking device in the stapling section.
Figure 23:
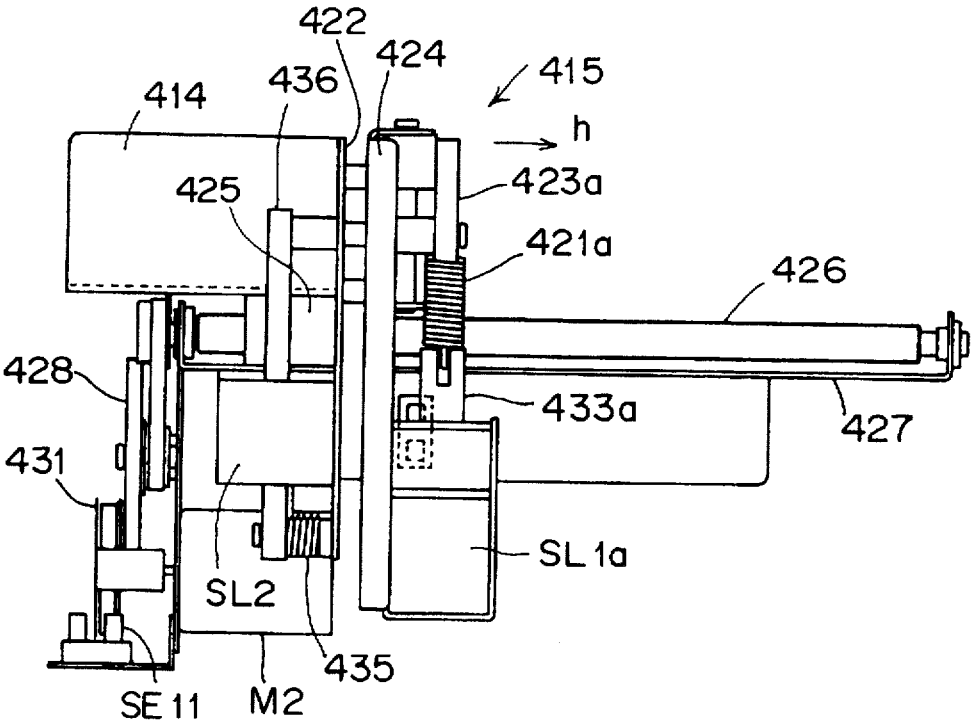
FIG. 23 is a side view showing the first chucking device.

As FIGS. 22 and 23 show, the first chucking device 415 comprises friction plates 417*a*, 418*a* made of a resilient material, support plates 419*a*, 420*a* for supporting the friction plates 417*a*, 418*a*, a solenoid SL1*a* for actuating the friction plate 417*a* to move upward and downward, and a support plate 422 for retaining these elements in position. The solenoid SL1*a* has a plunger 433*a* connected to the support plate 419*a* through a spring 421*a* and a lever 423*a* so that when the solenoid SL1*a* is turned on, the friction plate 417*a* is caused to move downward in conjunction with the support plate 419*a* to resiliently hold a side of sheets on the stacking tray 411 in cooperation with the friction plate 418*a*.

The friction plates 417*a*, 418*a* are set at a position shifted back in the direction of arrow i, rather than the chucking position shown in FIG. 22, that is, at a position offset from a side of a sheet aligned on the stacking tray 411 shown in FIG. 20. In order to cause the friction plates 417*a*, 418*a* and support plates 419*a*, 420*a* therefor to shift to the chucking position in a direction opposite from the direction of arrow i, there is mounted a solenoid SL2 on a bracket 424. A plunger 434 of the solenoid SL2 is connected to a link 436 which is pivotable about a pin 437, the link 436 being connected at its ends to the support plates 419*a*, 420*a*. The link 436 is biased by a spring 435 wound on the pin 437 in the clockwise direction in FIG. 22. When the solenoid SL2 is off, the plunger 434 is in its retracted position and the friction plates 417*a*, 418*a*, together with the support plates 419*a*, 420*a*, are shunted outward of sheet P. Such shunting is intended to prevent the friction plate 417*a* and the support plate 419*a* from interfering with a sheet when the sheet P is received onto the tray 411. When the solenoid SL2 is turned on, the plunger 434 moves forward, and the link 436 rotates counter-clockwise, so that the friction plates 417*a*, 418*a*, together with the support plates 419*a*, 420*a*, are caused to shift in a direction opposite from the direction of arrow i so as to be set in the chucking position.

Further, the first chucking device 415 is reciprocally movable in the direction of arrow h to transport a sheet set to the stapling station 440, with the sheet set grasped at one side by the first chucking device 415. For this movement, a nut member 425 fixed to the bracket 424 is threadingly fitted to the spiral shaft 426. The spiral shaft 426 is rotatably mounted to a frame 427 and is adapted to be forward/reverse driven by a motor M2 through a drive transmission 428 which comprises gears and belts. That is, through forward run of the motor M2, the spiral shaft 426 rotates forward to cause the first chucking device 415 to advance in the transport direction h, and through reverse run of the motor M2 the first chucking device 415 is caused to retreat. The presence of the first chucking device 415 in its home position $H_1$ is detected upon entry of a light shield plate 430 fixed to the bracket 424 into the optical axis of a sensor SE10 disposed on the frame 427.

On the output shaft of the motor M2 there is fixed a disc 431 having a multiplicity of small holes formed regularly along a circumferential edge portion thereof such that on the basis of the rotation of the disc 431 a sensor SE11 will detect the small holes to generate pulse signals. By counting the number of pulses output from the sensor SE11 it is possible to detect the quantity of movement of the first chucking device 415; and when a predetermined number of pulses has been counted, the motor M2 is turned off. In this way, the quantity of movement of the first chucking device 415 can be accurately controlled. The stacking tray 411 is formed with an elongate slot 411*a* (see FIG. 20) which enables the friction plates 417*a*, 418*a* to grasp a sheet set and shift in the direction of sheet transport h.

Figure 24:
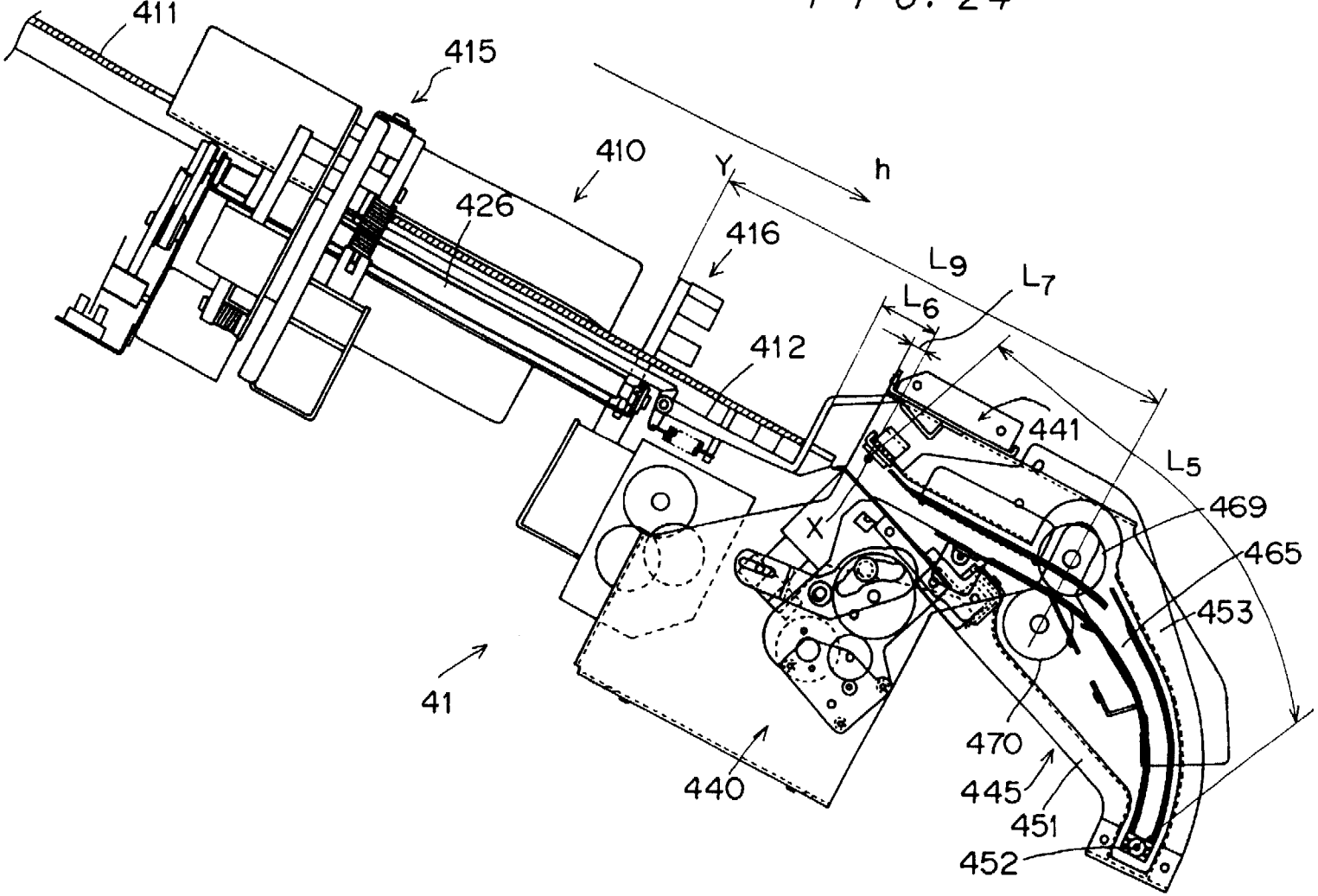
FIG. 24 is a partial sectional view showing the stapling section.

As FIG. 24 shows, the leading end of the spiral shaft 426 extends to a location Y adjacent to the stapling station 440 such that the first chucking device 415 is shiftable to the location Y. In this case, the leading edge of a sheet set held between the friction plates 417*a* and 418*a* gets caught between transport rollers 469 and 470 and thereafter the sheet set is transported by the transport rollers 469, 470. Therefore, the distance $L_9$ between the position Y and the nip between the rollers 469 and 470 is set shorter than a minimum acceptable size sheet (B5Y).

(Lead Stopper)

Figure 25:
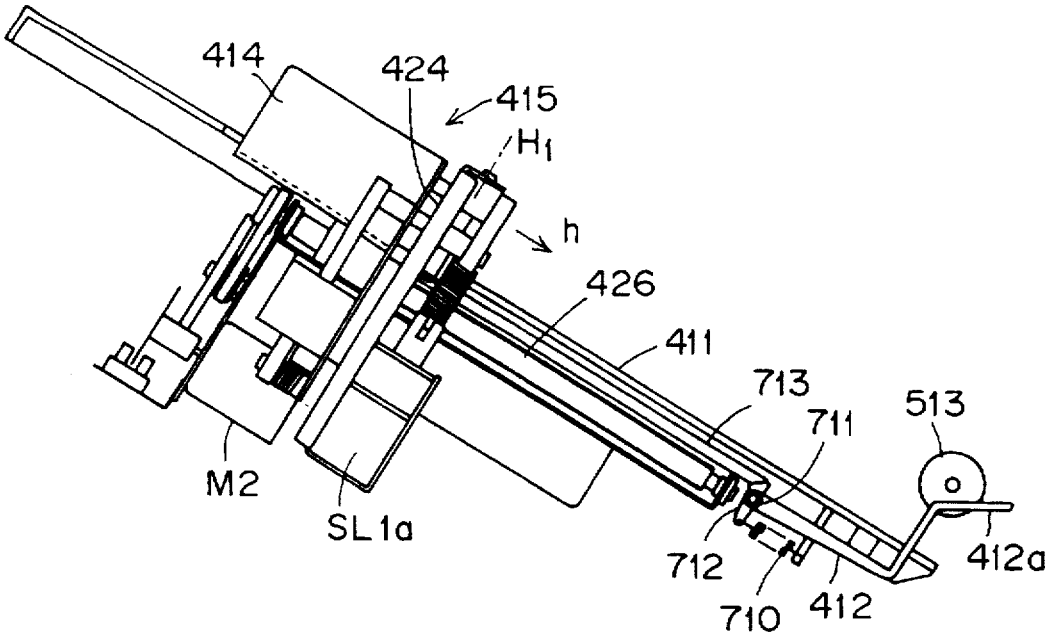
FIG. 25 is a partial sectional view showing operation of a lead stopper (under regulatory control)

As FIG. 25 shows, the lead stopper 412 is pivotally mounted on the leading end of the stacking tray 411 such that when a cam 712 fixed integrally with the stopper 412 is biased by a spring 710, the stopper 412 pivots counter-clockwise so that its front end projects over the tray 411 to regulate the leading edges of sheets. The stopper 412 has a comb teeth shape and, as FIG. 20 shows, it projects upward from notches 411*c* at the leading portion of the tray 411. A lever 713 fixed to the bracket 424 of the first chucking device 415 abuts at the leading end thereof against an inclined upper end surface of the cam 712.

Figure 26:
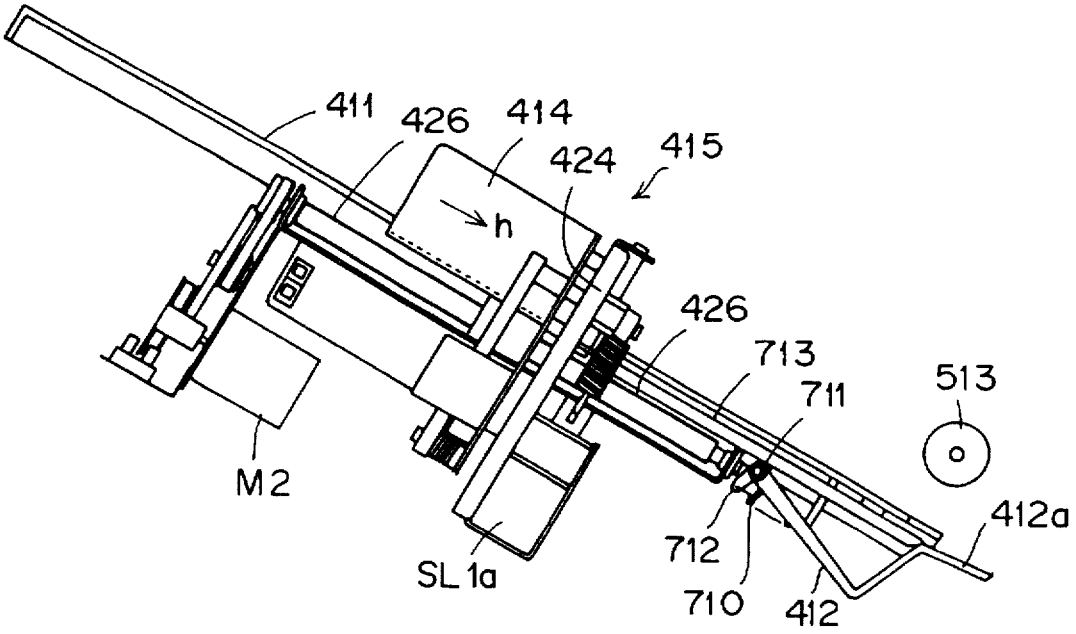
FIG. 26 is a partial sectional view showing operation of the lead stopper (when released from the regulatory control)

As stated earlier, a set of sheets stacked on the stacking tray 411 is gripped by the first chucking device 415 and is transported in the direction of arrow h by the motor M2 (spiral shaft 426) being driven forward. In this conjunction, the lever 713 shifts integrally with the first chucking device 415 in the direction of arrow h to pivot the cam 712 clockwise as shown in FIG. 26. At the same time, the lead stopper 412 pivots about the pin 711 in the clockwise direction to become shunted to the underside of the tray 411. While a set of sheets is being transported, that is, while the first chucking device 415 is in an advanced position relative to the home position $H_1$, the cam 712 is held down by the lever 713 so that the lead stopper 412 is held on the back side of the tray 411 to permit the transport of sheets. When the stopper 412 is in its shunted condition, a leading portion 412*a* of the stopper 412 is positioned substantially flush with the tray 411 and guides the downstream of the sheet set being transported. This enables smooth delivery of the sheet set from the tray 411 to the stapling station 440.

Upon delivery of a sheet set to the stapling station 440, the solenoid SL1*a* is turned off to enable the friction plates 417*a*, 418*a* to release the sheet set and, simultaneously therewith, the motor M2 is driven reverse to cause the first chucking device 415 to retreat to the home position $H_1$. When the first chucking device 415 returns to the home position $H_1$, the lever 713 releases the cam 712 from its bias so that the lead stopper 412 pivots upward to prepare for a next sheet set to be received.

(Second Chucking Device)

Figure 27:
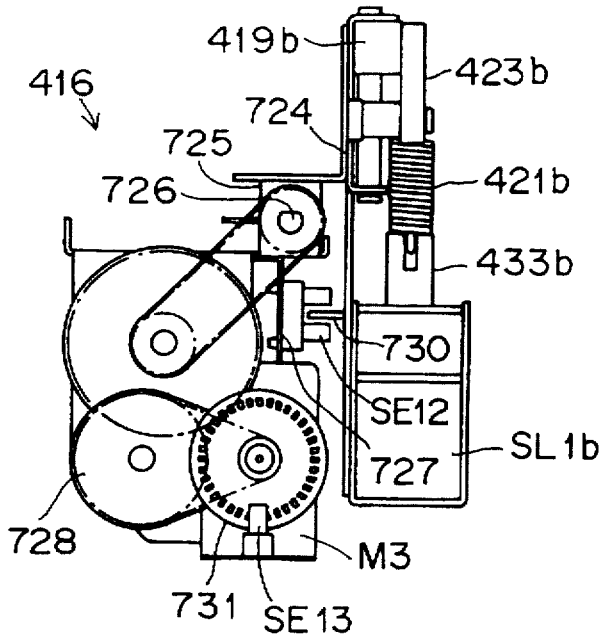
FIG. 27 is a front view showing a second chucking device in the stapling section.
Figure 28:
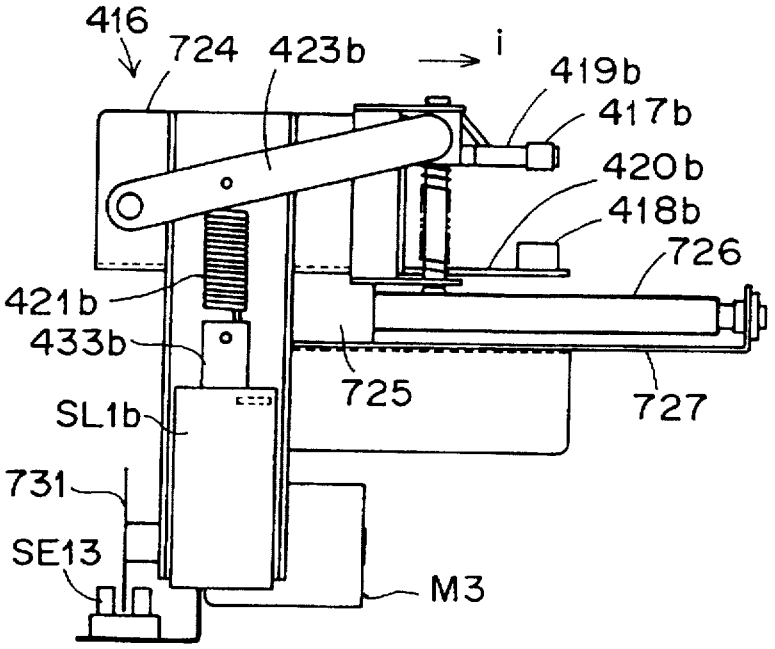
FIG. 28 is a side view showing the second chucking device.

As FIGS. 27 and 28 show, the second chucking device 416 comprises friction plates 417*b*, 418*b* made of a resilient material, support plates 419*b*, 420*b* for supporting them, a solenoid SL1*b* for moving the friction plate 417*b* upward and downward, and a support plate 724 for supporting these members. The solenoid SL1*b* has a plunger 433*b* which is connected to the support plate 419*b* through a spring 421*b* and a lever 423*b*, so that when the solenoid SL1*b* is turned on, the friction plate 417*b* moves downward in conjunction with the support plate 419*b* to resiliently grasp, in cooperation with the friction plate 418*b*, a side of a sheet set on the stacking plate 411. This arrangement is identical with that of the first chucking device 415.

Further, the second chucking device 416 is reciprocally movable in a direction (shown by arrow i) perpendicular to the direction of transport h from a home position $H_2$ shown by solid line in FIG. 20 and to a position at which sheet P can be grasped at a side. For the purpose of this movement, a nut member 725 fixed to the support plate 724 is threadingly fitted on a spiral shaft 726. The spiral shaft 726 is rotatably mounted to a frame 727 and is adapted to be forward/reverse driven by a motor M3 through a drive transmission 728 which comprises gears and belts. That is, through forward run of the motor M3, the spiral shaft 726 rotates forward to cause the second chucking device 416 to advance in the direction i, and through reverse run of the motor M3 the second chucking device 416 is caused to retreat. The presence of the second chucking device 416 in its home position $H_2$ is detected upon entry of a light shield plate 730 fixed to the support plate 724 into the optical axis of a sensor SE12 disposed on the frame 727.

On the output shaft of the motor M3 there is fixed a disc 731 having a multiplicity of small holes formed regularly along a circumferential edge portion thereof such that on the basis of the rotation of the disc 731 a sensor SE13 will detect the small holes to generate pulse signals. By counting the number of pulses output from the sensor SE13 it is possible to detect the quantity of movement of the second chucking device 416; and when a predetermined number of pulses has been counted, the motor M3 is turned off. In this way, the quantity of movement of the second chucking device 416 can be accurately controlled. The stacking tray 411 is formed with an elongate slot 411*b* (see FIG. 20) which enables the friction plates 417*b*, 418*b* to grasp a sheet set and shift in the direction of arrow i.

Sheets to be received onto the stacking tray 411 may be varied in size, from B5Y minimum to A3T maximum. This second chucking device 416, as is the case with the side alignment plate 413, is adapted to advance to a position at which it can grasp a side of sheets aligned by the alignment plate 413 and reference plate 414 in response to a sheet size signal transmitted from the controller of the copying machine 10 to the controller of the finisher 40.

(Chucking Operation)

In the present embodiment, the first chucking device 415 is operated in the following three modes.

A first mode is such that the first chucking device 415, alternately with the second chucking device 416, grasp a side of sheets stacked/aligned on the stacking tray 411, one sheet at a time. This alternate chucking operation is carried out in case that the sheet folding mode is selected. In the case of non-folded sheets being stapled, the first chucking device 415 is on standby at the home position $H_1$. In the case of alternate chucking operation, the motor M2 is run forward, and the first chucking device 415, as shown in FIG. 20, moves from the home position $H_1$ to a position Q opposed to the second chucking device 416 irrespective of sheet size. In the position Q, the solenoids SL1*a*, SL2 are off and the friction plates 417*a* and 418*a* are in their shunted condition at a location outside the alignment reference line A of the reference plate 414. The second chucking device 416 is on standby at its home position $H_2$.

When sheet P is discharged onto the stacking tray 411, the alignment plate 413 advances a predetermined quantity in the direction of arrow i from the home position in response to a trailing edge detection signal from the sensor SE5, to align the sheet P between the alignment plate 413 and the reference plate 414. Next, the solenoid SL2 is turned on in response to an advance end signal of the alignment plate 413, and the friction plates 417*a*, 418*a* advance to a position for grasping the side of the aligned sheet P. Thereupon, the solenoid SL1*a* is turned on, and the friction plates 417*a* and 418*a* grasp the side of the sheet P. At the end of the chucking operation, the alignment plate 413 returns to the home position.

When a next sheet is discharged onto the tray 411, in the same manner as above described the alignment plate 413 advances the predetermined quantity, and in synchronism with this the second chucking device 416 advances a predetermined quantity in the direction of arrow i from the home position $H_2$. Next, the solenoid SL1*b* is turned on in response to an advance end signal of the alignment plate 413, and the friction plates 417*b* and 418*b* grasp the side of the sheets. Almost simultaneously with this, the alignment plate 413 returns to its home position, and the solenoid SL1*a* of the first chucking device 415 is turned off so that the friction plates 417*a*, 418*a* release the sheets from their grasp. Then, the solenoid SL2 is turned off and the friction plates 417*a*, 418*a* become shunted outward from the sheets. When a next sheet is received, the second chucking device 416 releases the sheet set from its grasp, then retreats, and the first chucking device 415 grasps the sheet set.

In this way, the chucking devices 415 and 416 alternately repeat advancing to and retreating from the chucking position with respect to sheets successively delivered onto the stacking tray 411, for alternate sheet holding.

By virtue of this chucking operation of the first mode, it is possible to prevent any float up of sheets and also to design the stacking tray 411 to be of a larger loading capacity. In particular, this operation is advantageous in collecting two-folded and Z-folded sheets onto the stacking tray 411 as earlier described.

In the second mode, the first chucking device 415 grasps a set of sheets on the stacking tray 411 at the home position $H_1$ and transports the sheet set distance $L_4$ in the direction of arrow h (see FIG. 20). This is done for the purpose of setting the leading portion of the sheet set on the stapling position X (X designates a stapling position in the direction of sheet transport as in FIG. 24) in order to staple the sheet set at the leading edge portion.

In this second mode, when set of sheets is aligned on the tray 411, the second chucking device 416 is held on standby at its home position $H_2$, and the first chucking device 415 grasps the sheet set at its home position $H_1$ and, through forward run of the motor M2, it advances the distance $L_4$. In this conjunction, the lead stopper 412 pivots downward to release the leading edge regulation as already described. The forward run of the motor M2 is stopped upon the lapse of a predetermined time after the leading edge of the sheet set is detected by a sensor SE18 (see FIG. 33) at the stapling station 440. The sheet set which has been transported the distance $L_4$ is stapled at the leading portion thereof.

At the end of the stapling operation, the motor M2 is driven forward while the first chucking device 415 still grasps the sheet set, so that the first chucking device 415 shifts further in the direction of arrow h and delivers the sheet set to the transport rollers 469, 470. In this case, the halting of the first chucking device 415 is controlled by pulse signals from the sensor SE11. Then, the solenoids SL1*a*, SL2 are turned off and the motor M2 is driven reverse, whereupon the first chucking device 415 returns to its home position $H_1$.

The third mode of operation is such that the first chucking device 415 grasps a set of sheets on the stacking tray 411 at the home position $H_1$ and transports the sheet set the distance $L_3$ in the direction of arrow h until the leading portion of the sheet set is drawn in between the transport rollers 469, 470 (see FIG. 20). This is done for the purpose of stapling the sheet set at the center portion thereof or at the trailing portion thereof.

In this third mode, when set of sheets is aligned on the tray 411, the second chucking device 416 is held on standby at its home position $H_2$, and the first chucking device 415 grasps the sheet set at its home position $H_1$ and, through forward run of the motor M2, it advances the distance $L_3$. In this conjunction, the lead stopper 412 pivots downward to release the leading edge regulation as already described. The halting of the first chucking device 415 at the distance $L_3$ is controlled by pulse signals from the sensor SE11. Then, the solenoids SL1*a*, SL2 are turned off and the motor M2 is driven reverse, whereupon the first chucking device 415 returns to its home position $H_1$. The sheet set is transported further by the transport rollers 469, 470 in the direction of arrow h for being stapled as will be hereinafter described.

(Stapling Station)

Figure 29:
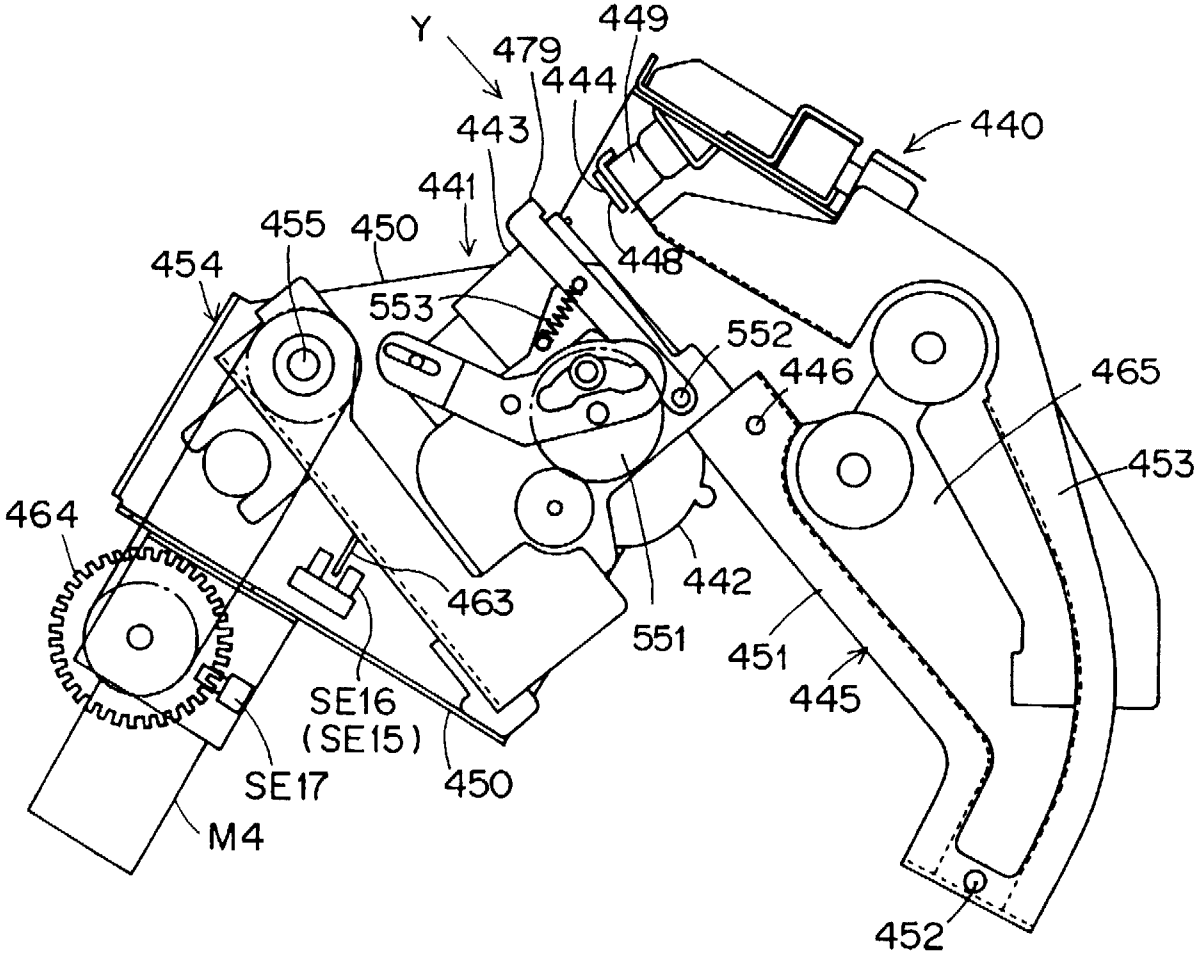
FIG. 29 is a front view showing a stapling station.

As FIGS. 24 and 29 show, the stapling station 440 comprises the stapling unit 441, a driving unit 454, and a sheet set transport unit 465.

(Stapling Unit)

Figure 30:
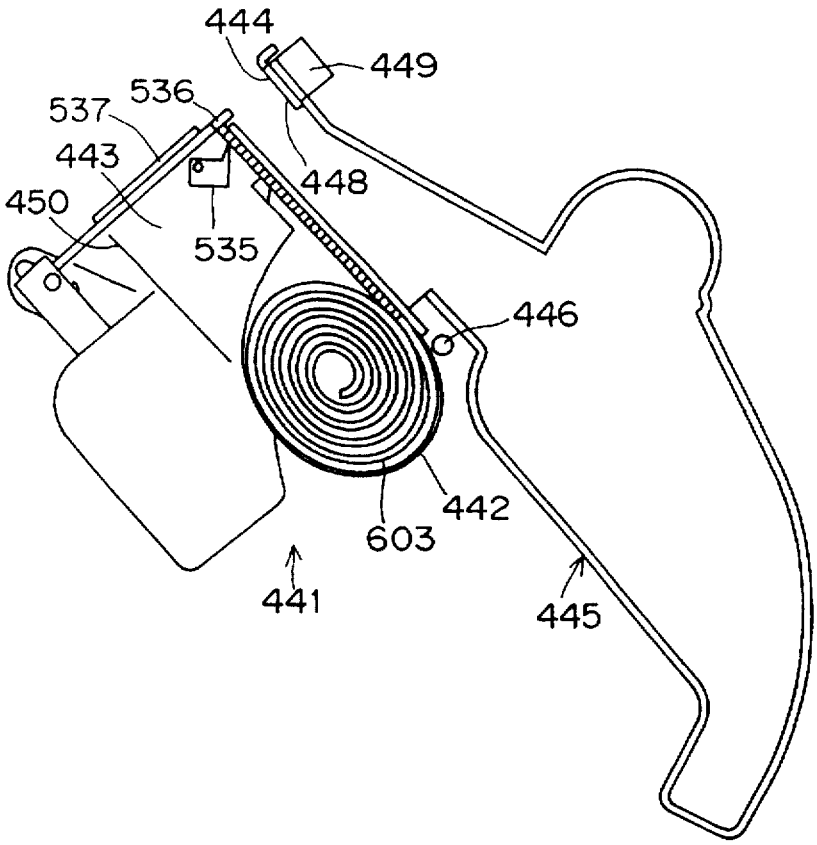
FIG. 30 is a front view showing an interior arrangement of a stapling unit.
Figure 31:
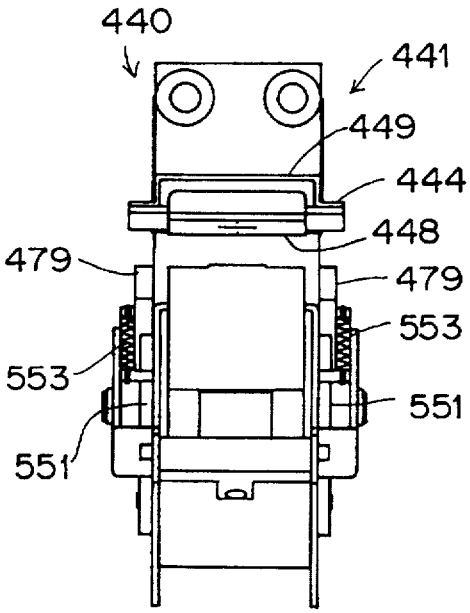
FIG. 31 is a view as seen in the direction of Y in FIG. 29.

The stapling unit 441, as FIGS. 29, 30 and 31 show, comprises a staple cartridge 442, a staple head 443, a staple anvil 444, and a connector 445 for interconnecting the staple head 443 and staple anvil 444.

The staple cartridge 442 is of the well known type which is removably mountable to the staple head 443 and has staples 603 housed therein. Staples 603 are such that they are individually arranged parallel and adhesively joined into a planar-form assembly which is accommodated within the staple cartridge 442 in a rolled-up condition.

The staple head 443, mounted on a bracket 450, includes a staple feed member 535, a staple severing member 53 and a stable bending member 537, and is pivotable about a support shaft 446. As the staple head 443 pivots about the support shaft 446 in the clockwise direction in FIG. 29, staples 603 are severed or separated one at a time, and each severed staple is bent in U shape and driven into place with respect to a sheet set. The staple feed member 535 turns intermittently in response to such driving operation to feed staples 603 one pitch at a time. The staple head 443 has a sensor (not shown) for detecting the presence or non-presence of staples 603 in the staple cartridge 603.

Further, the staple head 443 has sheet presser members 479 disposed on opposite sides which come in pressure contact with a sheet set inserted between the staple head 443 and the staple anvil 444 in synchronism with staple driving but slightly earlier than staple 603 goes in contact with the sheet set, thereby to prevent the sheet set from becoming offset. The sheet presser members 479 are pivotable about a support shaft 552 and are biased by a spring 553 against a cam 551 which is driven into rotation by a stapler drive motor not shown. The sheet presser members 479 are operative on the basis of rotation of the cam 551 to securely hold the sheet set in cooperation with the staple head 444. At the end of staple driving, the sheet presser members 479 retract in synchronism with the staple head 443. The drive function of the staple head 443 is well known in the art and, therefore, need not be described in detail herein.

The staple anvil 444 comprises a staple receiving member 448 for inwardly bending staples 603 driven through a sheet set, and a support plate 449 for buffering any shock caused during staple driving by the staple head 443.

(Connector)

The connector 445 comprises first and second support plates 451, 453. The first support plate 451 is disposed integrally with the bracket 450 of the staple head 443. At the front end of the second support plate 453 is mounted the staple anvil 444, and the rear end of the second support plate 453 is joined with the first support plate 451 through a support shaft 452.

Figure 32:
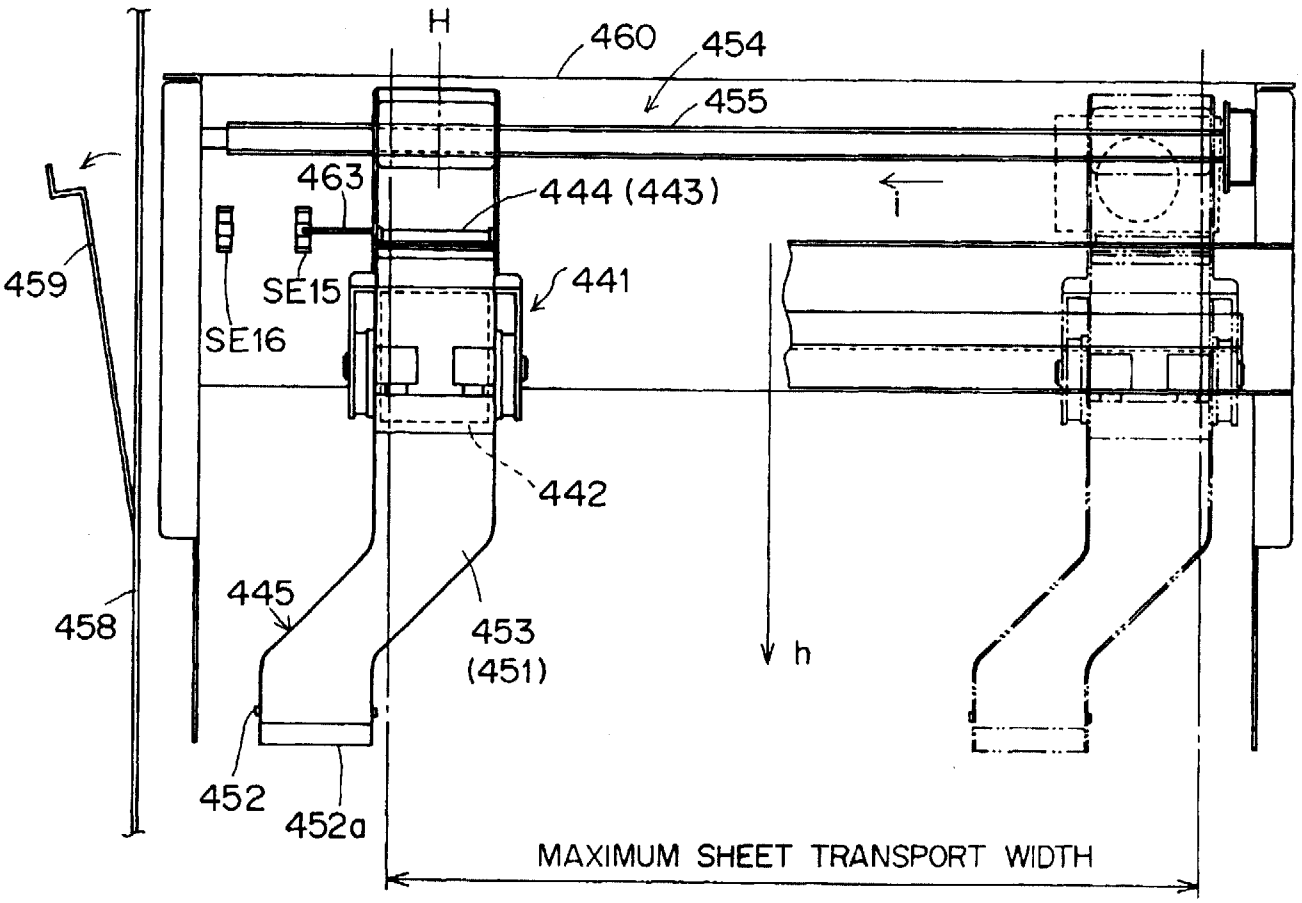
FIG. 32 is an explanatory view showing the stapling unit in movement.

Further, as FIG. 32 shows, the connector 445 is such that a joint 452*a* at the support shaft 452 is positioned offset from the staple head 453 and the staple anvil 444 in a direction perpendicular to the direction of sheet set transport (shown by arrow h). The position H shown by solid line in FIG. 32 is a home position of the stapling unit 441. At this home position H, the joint 452*a* is located outside the sheet set transport path and the staple head 443 and the staple anvil 444 are set at a position for stapling a corner portion of a sheet set.

As FIG. 24 shows, the distance $L_5$ between the support shaft 452 and the stapling position X is set slightly longer than one half of a maximum allowable sheet length (which corresponds to A3T size). This enables not only the leading portion stapling, but the center stapling as well with respect to sheet sets delivered to the stapling station 440. In case that the length of the sheet set is less than ½ of the maximum permissible feed size, the trailing portion stapling is possible with respect to the sheet set. In case of the trailing portion stapling mode, the stacking tray 411 is empty during the stapling operation; therefore, it is possible to immediately begin the delivery of a next set of sheets to the stacking tray 411. This makes it possible to carry out copying and stapling operation as a whole in an efficient manner.

The distance $L_6$ between the stapling position X and the lead stopper 412 is set longer than the distance $L_7$ between the stapling position X and the trailing edge of sheets delivered to the stapling station 440. This prevents any interference of the stopper 412 with the trailing edge of sheets during the process of the trailing portion stapling.

Figure 139:
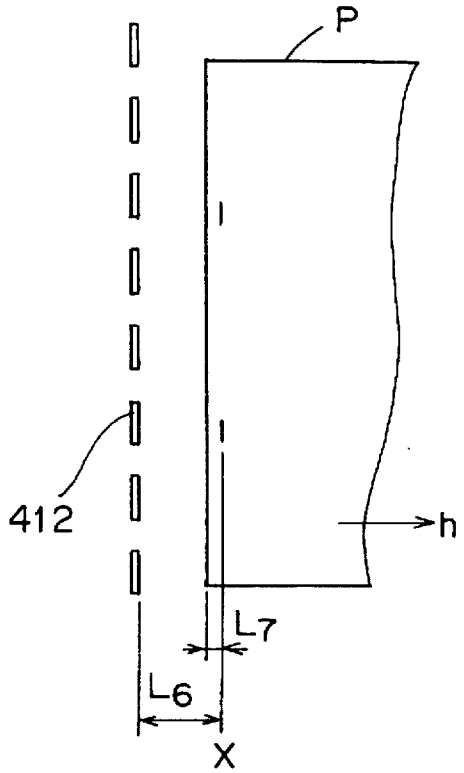
FIG. 139 is a plan view showing a positional relationship between a set of sheets and stapling positions and the lead stopper.

In other words, as FIG. 139 shows, $L_6$ represents the distance between the sheet regulating position on the stacking tray 411, or the position of the lead stopper 412, and the stapling position X, and $L_7$ represents the distance between the trailing edge of the sheet set P and the stapling position X. This arrangement has an advantage that in the trailing portion stapling mode, even if the lead stopper 412 is allowed to advance to the regulating position immediately upon sheet set P being set at the trailing portion stapling position, there is no possibility of the lead stopper 412 interfering with the trailing edge of the sheet set, it being thus possible to quickly deliver a next set of sheets onto the stacking tray 411.

(Driving Unit)

The driving unit 454 is designed to move the stapling unit 441 back and forth in the direction (shown by arrow i) perpendicular to the direction h of sheet set transport for the purpose of staple driving at plural points on a sheet set. As FIGS. 29 and 32 show, the driving unit 454 comprises a spiral shaft 455 extending perpendicular to the transport direction h, a forward/reverse drivable motor M4 as a source of driving power, and a drive transmission (not shown) for transmitting the revolution of the motor M4 to the spiral shaft 455. The stapling unit 441 has a bracket 450 threadingly fitted to the spiral shaft 455 so that it is movable in the direction of arrow i and reverse on the basis of the forward/reverse rotation of the spiral shaft 455. The spiral shaft 455 extends over a maximum sheet feed width (which corresponds to A3T and A4Y), and extends on the front end side (left hand side in FIG. 32) to a location adjacent to an outer frame 458. Sensors SE15, SE16 are disposed on a frame 460 which supports the spiral shaft 455. A light shielding plate 463 mounted to the bracket 450 is adapted for entry into and retreat from each optical axes of the sensors SE15, SE16. The presence of the stapling unit 441 at its home position H shown by solid line in FIG. 32 is detected upon entry of the light shielding plate 463 into the optical axis of the sensor SE15. When the stapling unit 441 shifts further toward the front side (left hand side), the light shielding plate 463 enters the optical axis of the sensor SE16. This position is a position for staple replacement at which an operator may open a small door 459 of the outer frame 458 to replace the staple cartridge 442.

A disc 464 having a multiplicity of notches formed regularly on its periphery is fixed to the output shaft of the motor M4 so that a sensor SE17 can detect such notches on the basis of rotation of the disc 464 thereby to generate a pulse signal. By counting the number of pulses output from the sensor SE17 it is possible to detect the quantity of shift of the stapling unit 441. When a predetermined number of pulses has been counted, the motor M4 is turned off, whereby the quantity of shift of the stapling unit 441, that is, the stapling position, can be accurately controlled. Such stapling position (stop position) will be described hereinafter. The return of the stapling unit 441 to its home position H and the shift thereof to the staple replacement position are detected through detection signals from the sensors SE15 and SE16, and on the basis of these signals the motor M4 is turned off.

(Stapling Mode)

Stapling operation may basically be set in three modes. A first mode is leading portion stapling in the direction of sheet set transport, which is further divided into a corner stapling mode and a mode of leading portion stapling at plural points. A second mode is trailing portion stapling in the direction of sheet set transport, which is further divided into a corner stapling mode and a mode of trailing portion stapling at plural points. A third mode is center stapling at plural points.

The manner of shift movement of the stapling unit 441 during stapling operation in each of these modes will be described hereinafter.

(Sheet Set Transport Unit)

Figure 33:
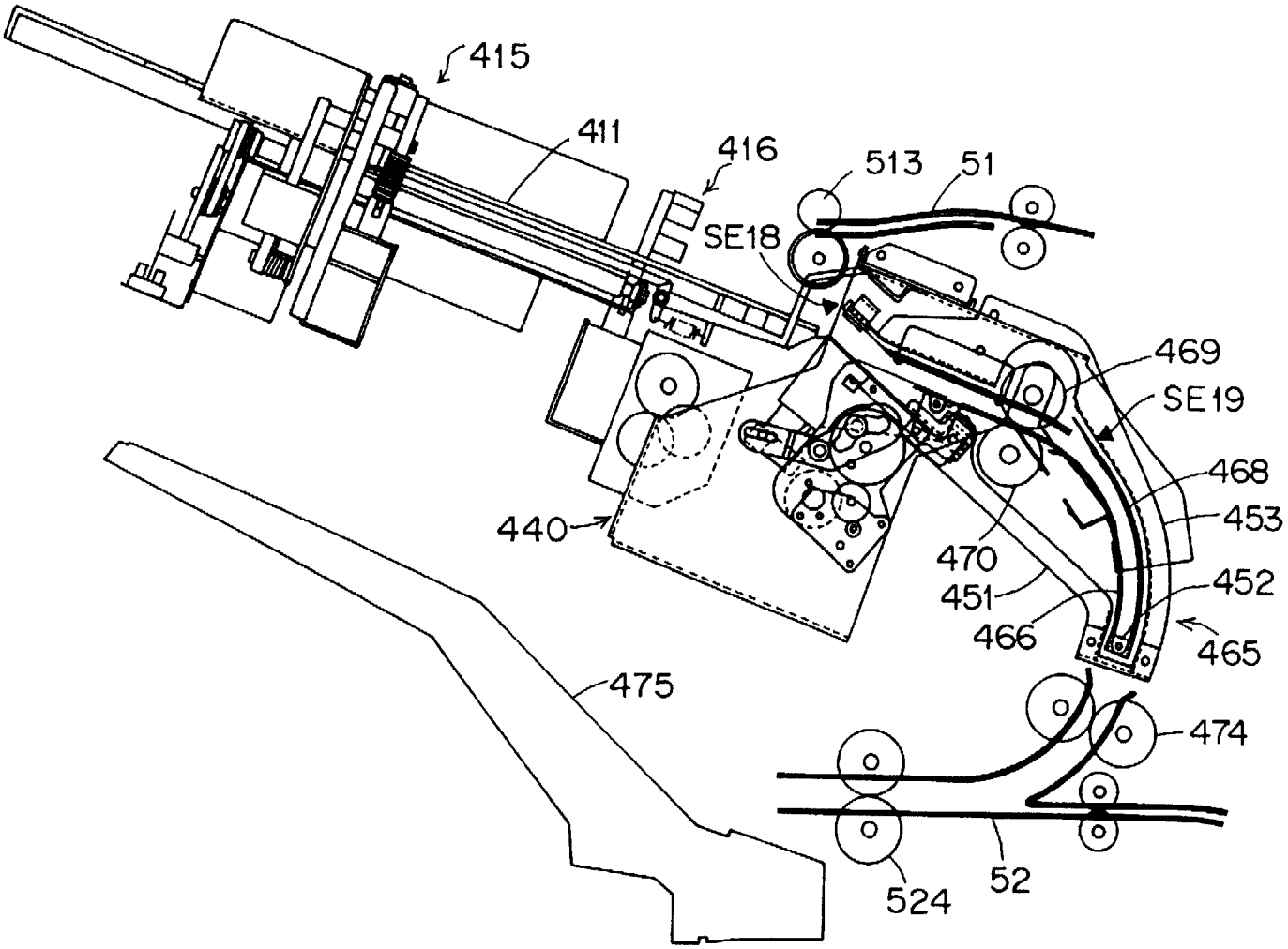
FIG. 33 is a partial sectional view showing a sheet set transport station.

As FIG. 33 shows, the sheet set transport unit 465 comprises a guide plate 466 fixed to the inner side of the support plate 451, a guide plate 468 mounted to the inner side of the support plate 453 which is pivotable about the support shaft 452, the transport rollers 469, 470 driven to rotate in the direction of sheet set transport, and sensors SE18, SE19 for detecting sheets. The transport roller 469 is shiftable by means of a solenoid not shown toward and away from the transport roller 470 such that when a sheet set is delivered by the first chucking device 415, the transport roller 469 is moved away from the transport roller 470 so as to permit the sheet set to be received between the rollers 469 and 470 and is thereafter operative to transport the sheet set in cooperation with the transport roller 470.

The sheet set transported through this transport unit 465 is fed into the earlier described transport path 52 and, after being passed through a transport roller pair 474, the sheet set is delivered, while being decelerated, from the discharge roller pair 524 onto the storing tray 475.

(Leading Portion Stapling Mode)

The mode of operation for sheet set stapling at the leading portion will be explained.

Figure 34:
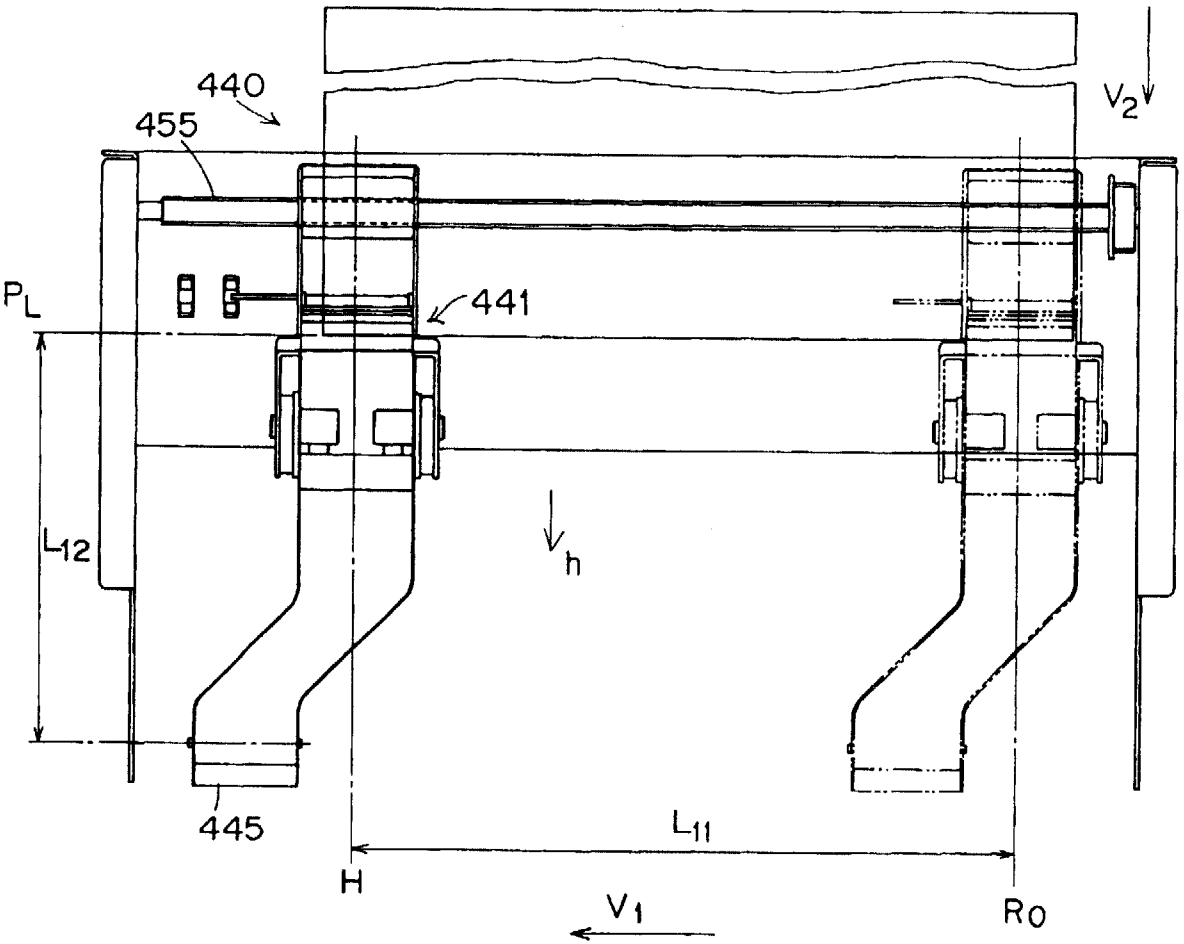
FIG. 34 is an explanatory view showing a leading corner stapling in progress.

For corner stapling, as shown by double-dotted chain lines in FIG. 34, the stapling unit 441 shifts to stapling point $R_0$ before a sheet set reaches the stapling station 440. In this case, the stapling unit 441 shifts to a point located slightly past the stapling point $R_0$ and then return to the stapling point $R_0$ to stop there.

After the end of staple driving with respect to the sheet set, the stapling unit 441 returns to its home position H. The sheet set, being held as grasped by the first chucking device 415, is transported by the first chucking device 415 in the direction of arrow h, and is delivered to the transport rollers 469, 470.

Figure 35:
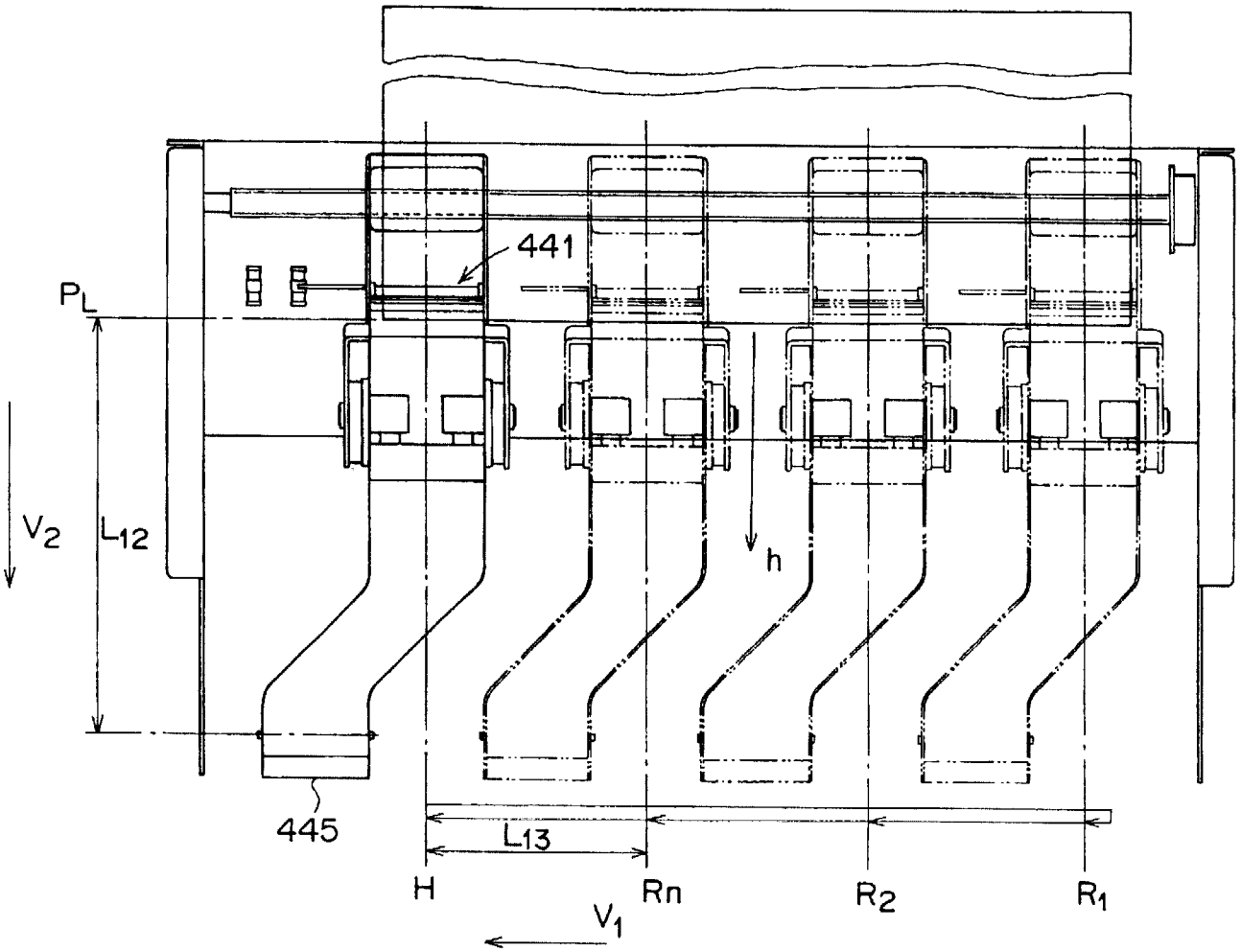
FIG. 35 is an explanatory view showing a leading portion stapling at plural points.

The stapling station 440 is of the following arrangement so as not to allow the connector 445 to interfere with the leading edge $P_L$ of a sheet set.

$$L_{11}/V_1 < L_{12}/V_2$$

where, $V_1$ : speed of stapling unit shifting $V_2$ : speed of sheet set transport $L_{11}$: distance between $R_0$ and H $L_{12}$: distance between sheet set leading edge and connector For stapling at plural points, as FIG. 35 shows, initially the stapling unit 441 shifts to stapling point $R_1$ before the leading edge $P_L$ of the sheet set reaches the stapling station 440. In this case, the stapling unit 441 begins shifting from its home position H and, after slightly passing the stapling point $R_1$, it returns to the point $R_1$. After staple driving at point $R_1$, the stapling unit 441 carries out staple driving while stopping at stapling points $R_2$, $R_n$, and then returns to its home position H. After the end of staple driving, the transport of sheet sets is carried out in the same way as in the case of the corner stapling mode.

The stapling station 440 is of the following arrangement so as to prevent the connector 445 from interfering with the leading edge $P_L$ of a sheet set.

$$L_{13}/V_1 < L_{12}/V_2$$

where, $L_{13}$: distance between $R_n$ and H

In the present embodiment, it is arranged that a sheet set passes through the interior of the stapling unit 441. If the staple head 443 and the staple anvil 444 are completely separated from each other, it is very difficult to bring the staple head 443 and the staple anvil 444 in correct alignment with each other. In the present embodiment, therefore, the two components are integrally connected by means of support plates 451, 453 extending along the path of transport of sheet sets so as to be accurately registered with each other so that any possible stapling error may be prevented. In the leading portion stapling mode, it is arranged that the stapling unit 441 is shifted to a stapling point $R_0$ or $R_1$ most remote from the home position H before the arrival of a sheet set, and that the staple driving is carried out from a position remote from, and toward a position nearer to the home position H, whereby time required for staple driving may be reduced. Further, the fact that the connector 445 of the stapling unit 441 is offset outward from a side of the sheet set makes it possible to prompt the timing for starting the transport of sheet sets. In addition, when the stapling unit 441 is at the home position H, staple driving may be carried out without the stapling unit 441 being required to shift, and the transport of a sheet set may be commenced immediately after staple driving.

(Trailing Portion Stapling Mode)

The trailing portion stapling mode is a mode of operation for stapling the trailing portion of sheet sets. A sheet set is transported by the first chucking device 415 to the transport rollers 469, 470 which, in turn, transports the sheet set further. The rotation of the transport rollers 469, 470 is halted after the leading edge of the sheet set is detected by the sensor SE19 and when the trailing edge of the sheet set has reached stapling position X depending upon the sheet size.

Figure 36:
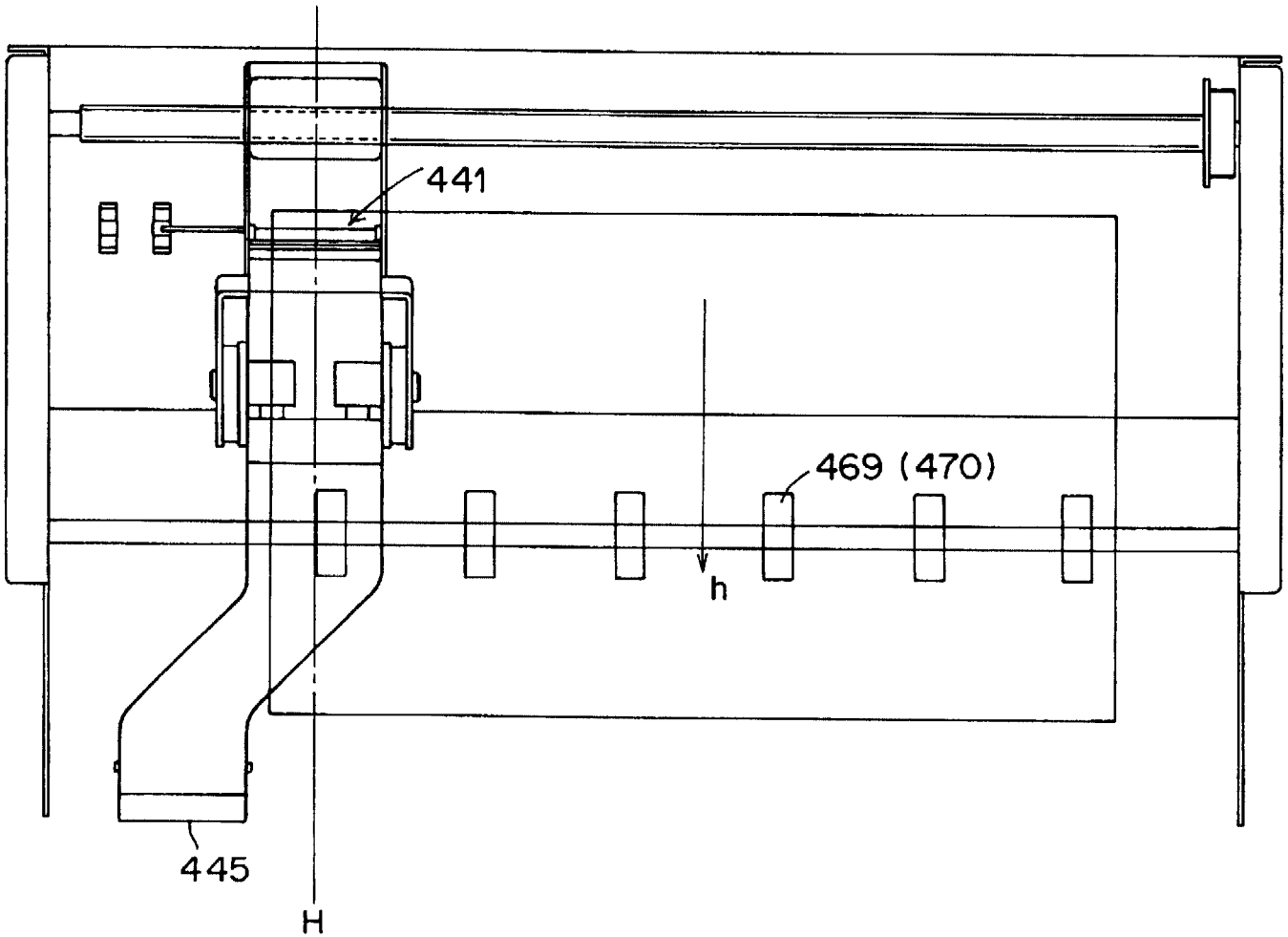
FIG. 36 is an explanatory view showing a trailing corner stapling in progress.

For corner stapling, as FIG. 36 shows, the stapling unit 441 carries out staple driving without shifting from the home position H.

Figure 37:
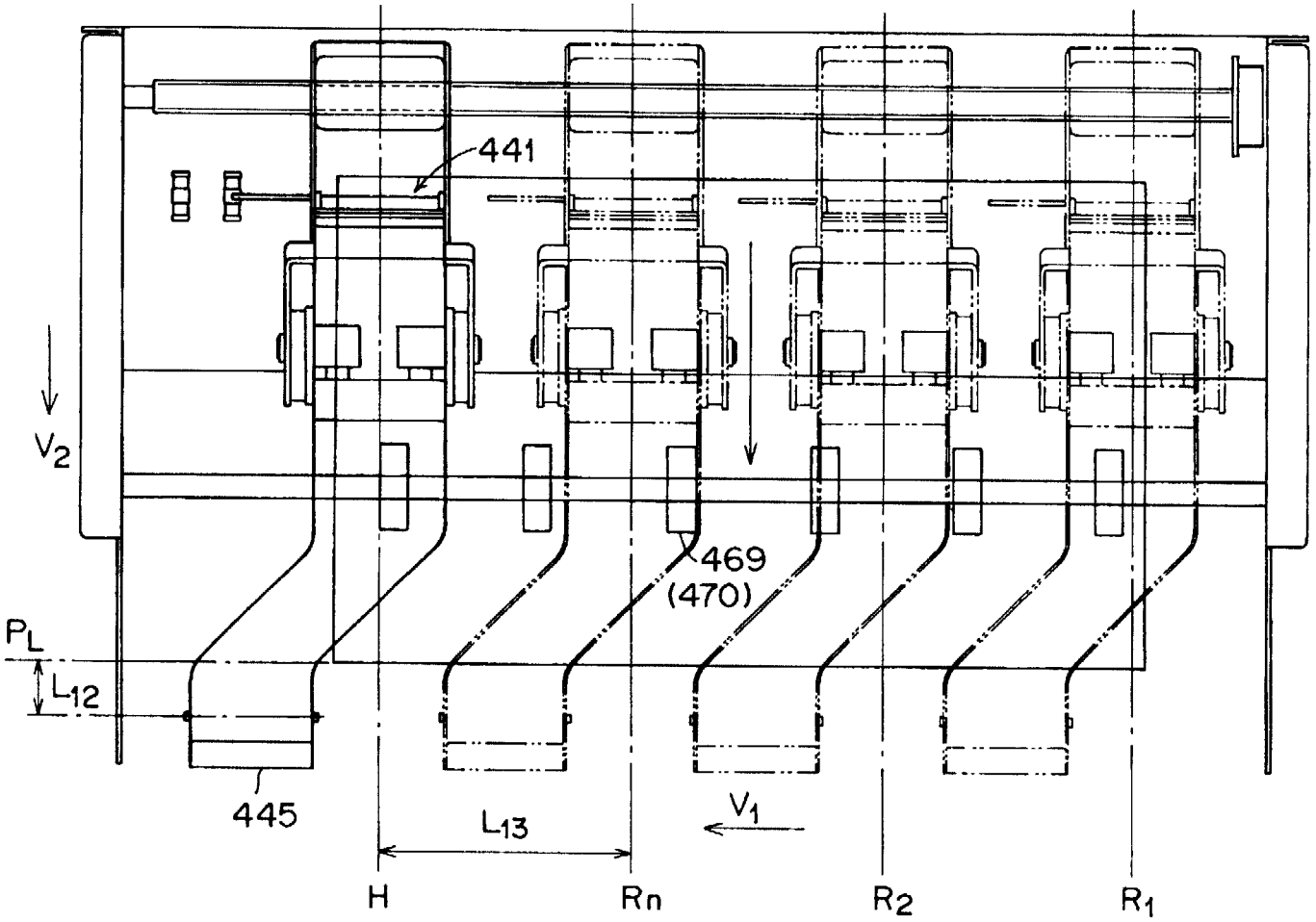
FIG. 37 is an explanatory view showing a trailing portion stapling at plural points.

For stapling at plural points, as FIG. 37 shows, the stapling unit 441 first shifts to stapling point $R_1$ (the mode of shift is identical with the foregoing leading portion stapling mode) and carries out staple driving at that point. Then, the stapling unit 441 carries out staple driving while stopping once at stapling points $R_2$, $R_n$, and thereafter it returns to the home position H.

After the end of the staple driving and upon the lapse of a standby time corresponding to the size of the sheet set, the sheet set is delivered from the stapling station 440 as the rotation of the transport rollers 469, 470 are resumed. The standby time is calculated by the controller so as to conform to the following relation:

$$(L_{12}/V_2)+T>L_{13}/V_1$$

For distance $L_{12}$, $L_{13}$, reference is made to FIG. 37.

(Center Stapling Mode)

The center Stapling mode is a mode of operation for stapling a sheet set centrally at plural points. A sheet set is transported by the first chucking device 415 to the transport rollers 469, 470 which, in turn, transports the sheet set further. The rotation of the transport rollers 469, 470 is halted after the leading edge of the sheet set is detected by the sensor SE19 and when the center of the sheet set has reached stapling position X depending upon the sheet size.

Figure 38:
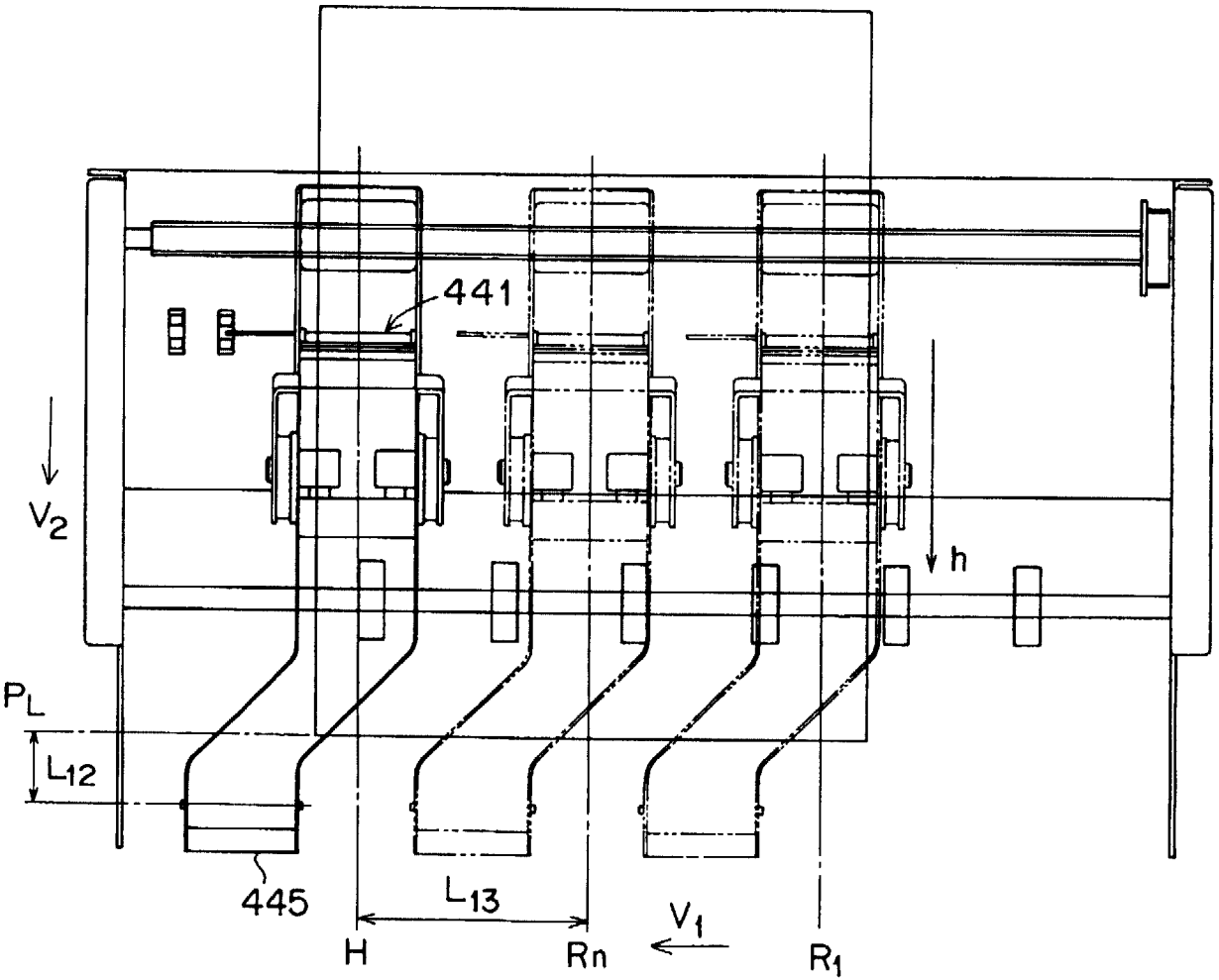
FIG. 38 is an explanatory view showing the process of a center stapling.

The manner of the stapling unit 441 shifting is illustrated in FIG. 38 and is identical with the shifting mode illustrated in FIGS. 35, 37. The standby time involved after the end of staple driving and until the transport of sheet sets by the transport rollers 469, 470 is calculated by the controller so as to conform to the relation $(L_{12}/V_2)+T>L_{13}/V_1$.

(Stapling Points and Guide Plates)

In the above described stapling operations, stapling points perpendicular to the direction of sheet transport may be established as desired through on/off control of the motor M4. Generally, however, stapling points are previously set according to the stapling mode and the size of sheets.

Figure 39:
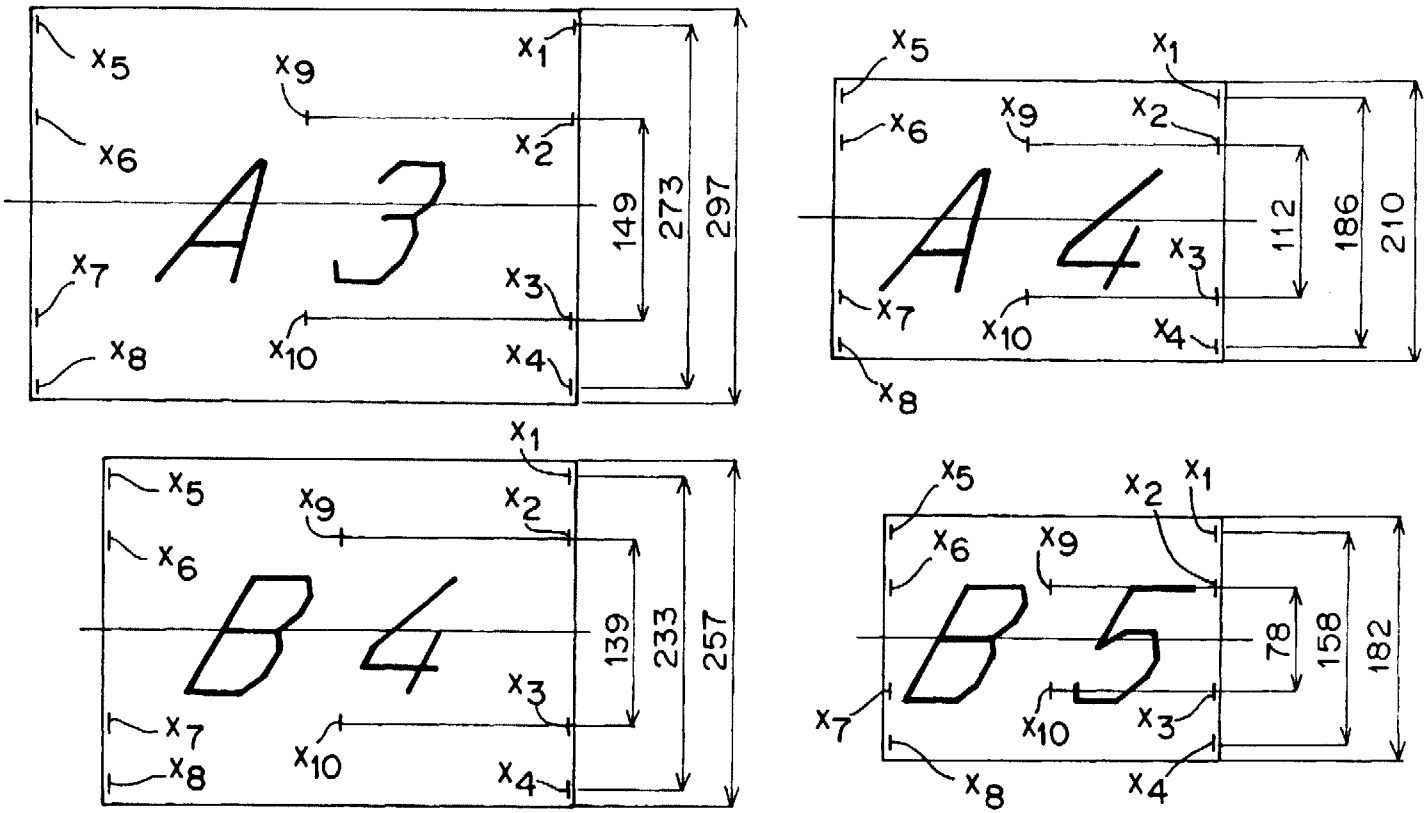
FIG. 39 is an explanatory view showing points for stapling with respect to sheets of different sizes in the case of one-side aligned sheet feeding.

FIG. 39 shows stapling points with respect to cross-feed sheets in case of stapling operation being carried out on a one-side alignment basis for all sheet sizes. In the leading portion stapling mode, staple driving is effected at corners $x_1$ or $x_4$, or at two points $x_2$ and $X_3$. In the trailing portion stapling mode, staple driving is effected at corners $x_5$ or $x_8$, or at two points $x_6$ and $x_7$. In the center stapling mode, staple driving is effected at two points $x_9$ and $x_{10}$.

Figure 40:
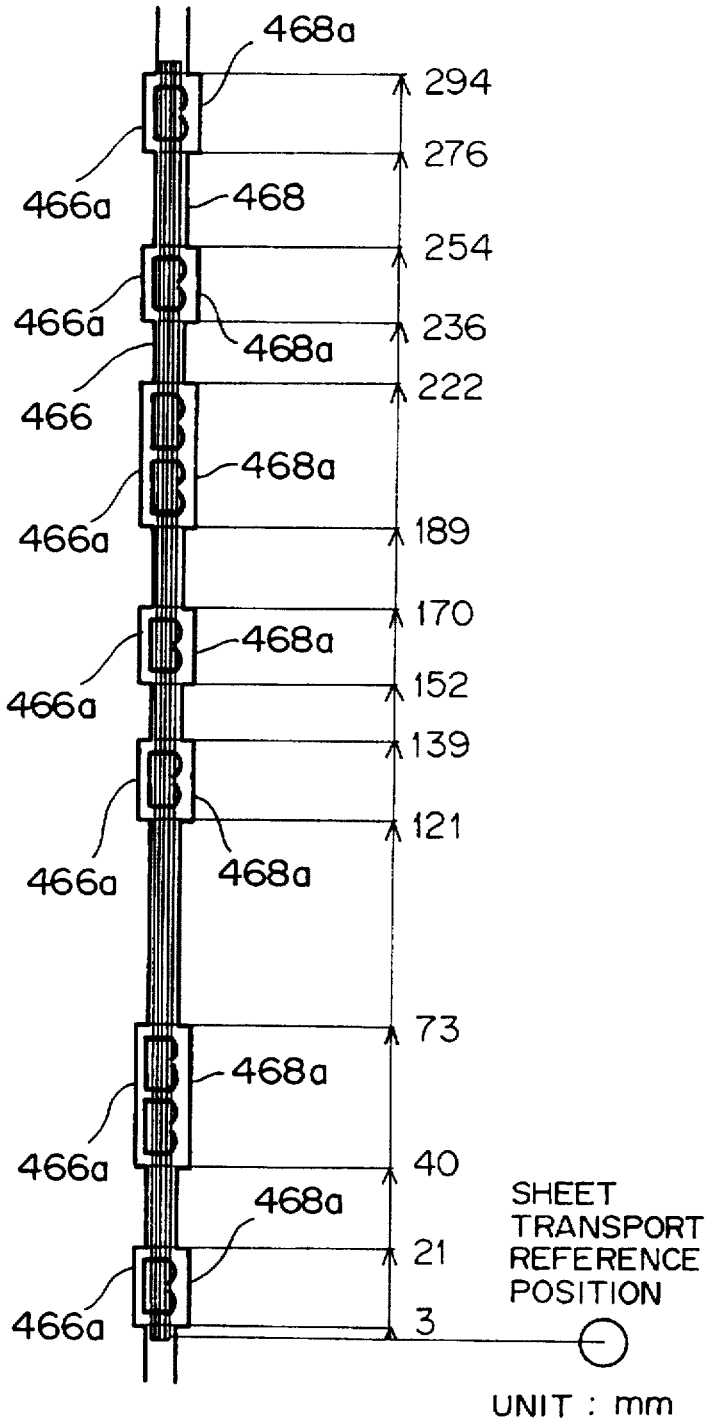
FIG. 40 is an explanatory view showing guide plates of the sheet set transport station, in the case of one-side aligned sheet feeding.

Guide plates 466, 468 have a large number of recessed portions 466*a*, 468*a* as shown in FIG. 40. These recessed portions 466*a*, 468*a* correspond to the stapling points $x_1$ to $x_{10}$ shown in FIG. 39 and serve to prevent staples from going into contact with guide plates 466, 468 during transport of a stapled sheet set. In the event that staples should contact guide plate 466, 468, there would occur transport-related troubles, such as oblique run of sheet sets and paper jamming.

Figure 41:
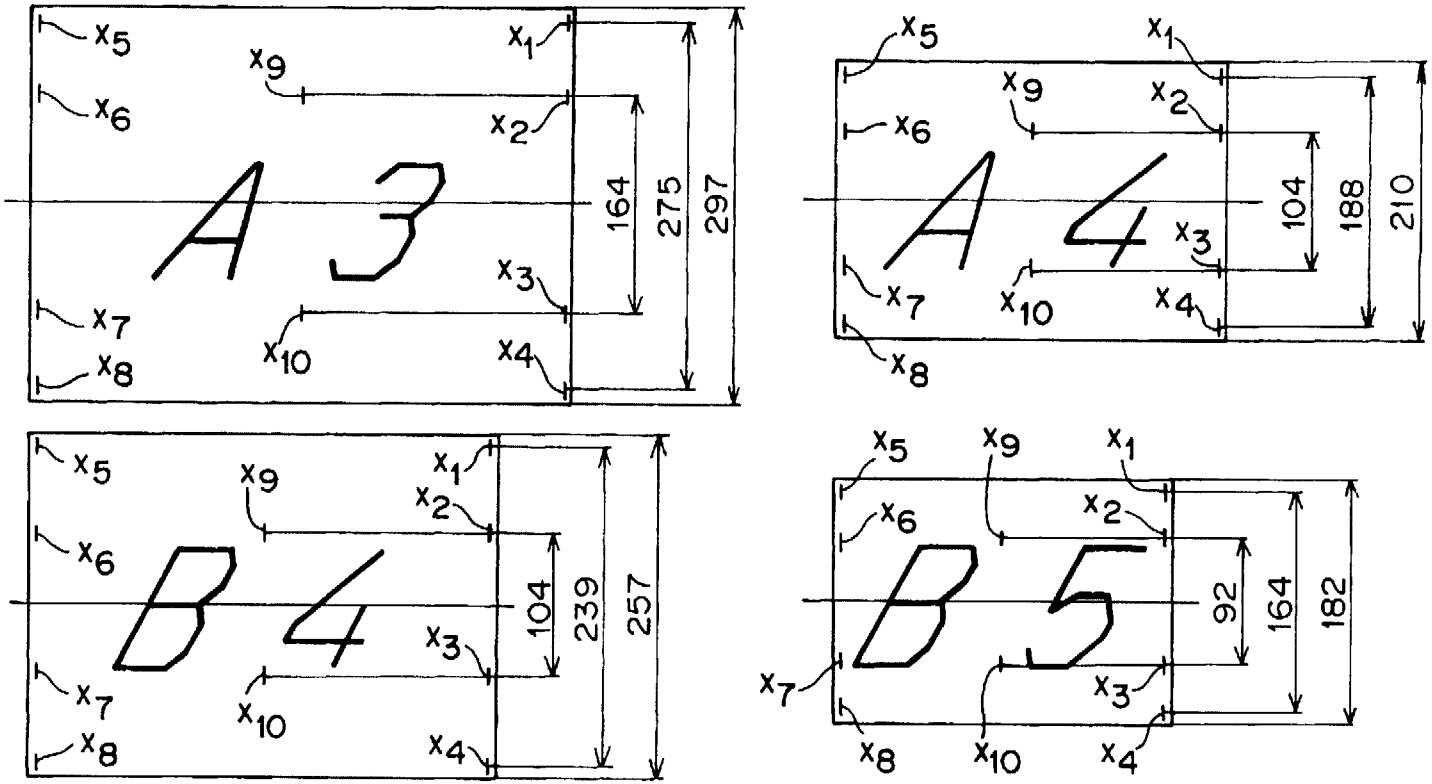
FIG. 41 is an explanatory view showing points for stapling with respect to sheets of different sizes in the case of centrally aligned sheet feeding.
Figure 42:
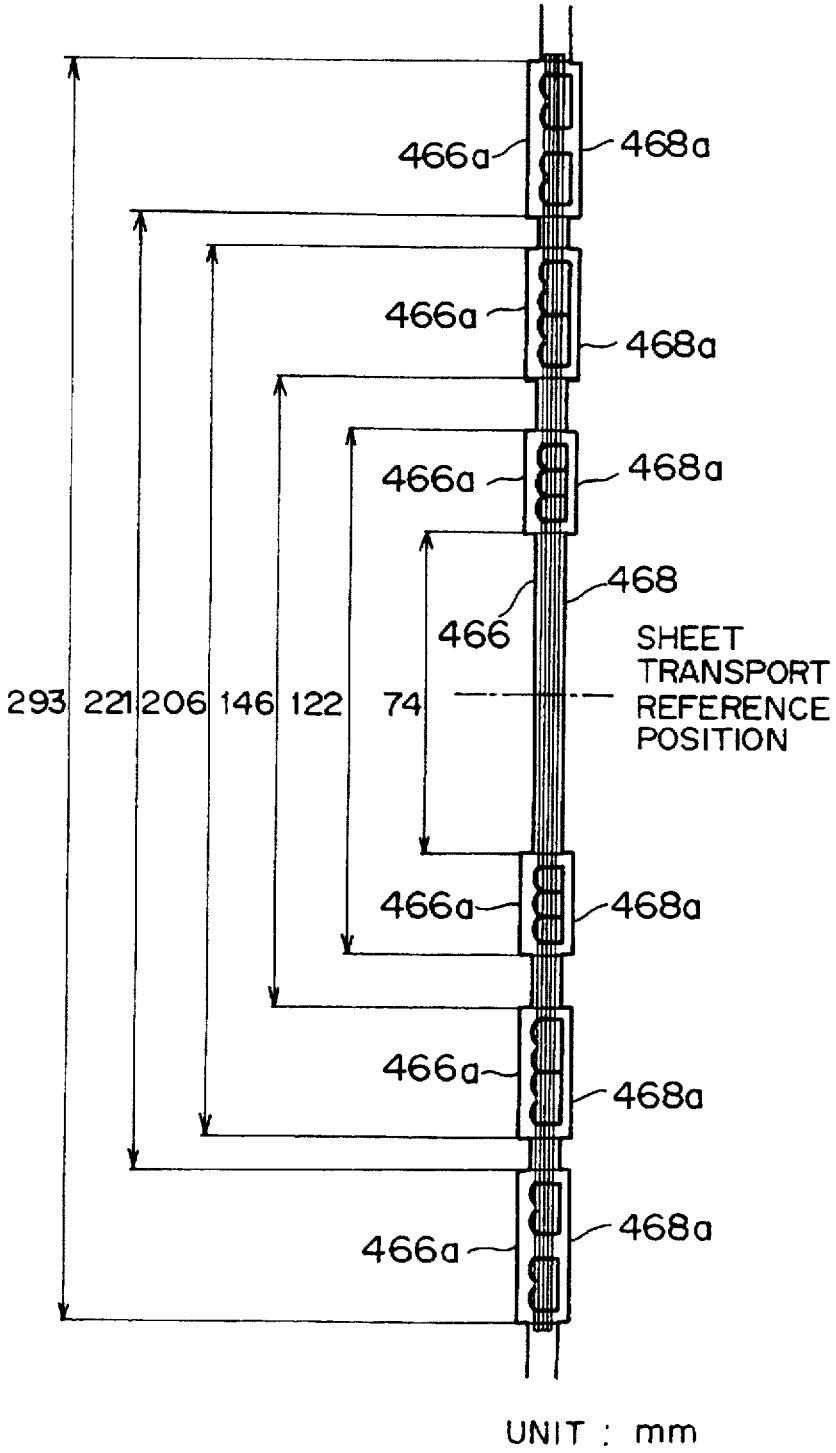
FIG. 42 is an explanatory view showing guide plates of the sheet set transport station, in the case of centrally aligned sheet feeding.

FIG. 41 shows stapling points in cases where sheets aligned on the stacking tray 411 on a center alignment basis are delivered to the stapling station 440 for being stapled. As FIG. 42 shows, guide plates 466, 468 are formed with recessed portions 466*a*, 468*a* in corresponding relation to these stapling points.

It is needless to say that the transport rollers 469, 470 are also disposed offset from the track of stapling points $x_1$ to $x_{10}$ (see FIG. 37).

(Pattern of Sheet Transport in Various Modes)

Next, the pattern of sheet transport in various modes (non-sort mode, folding mode, and stapling mode) of finishing operation by the finisher 40 will be explained.

(Non-Sort Mode)

Figure 43:
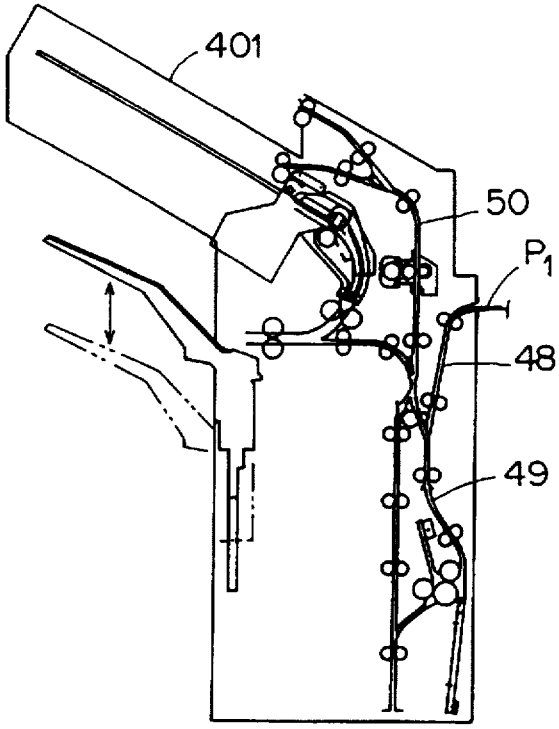
FIGS. 43 to 50 are explanatory views showing a form of sheet transporting in non-sort mode.
Figure 44:
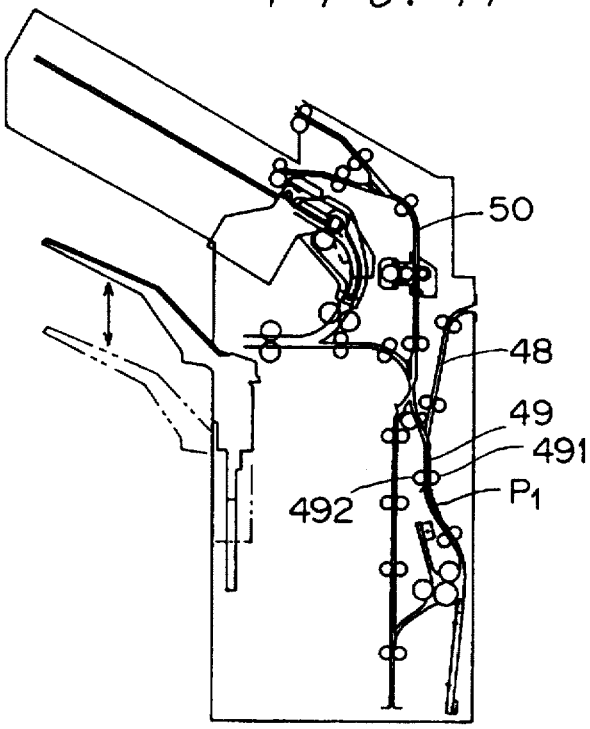
Figure 45:
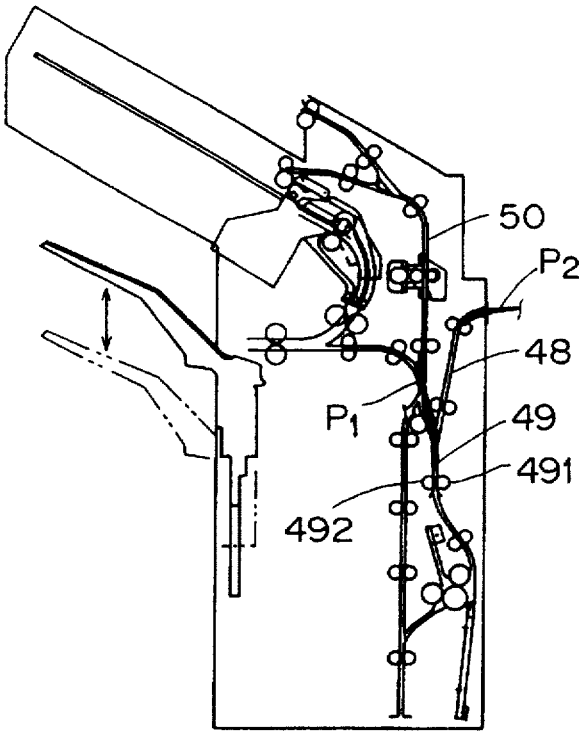
Figure 46:
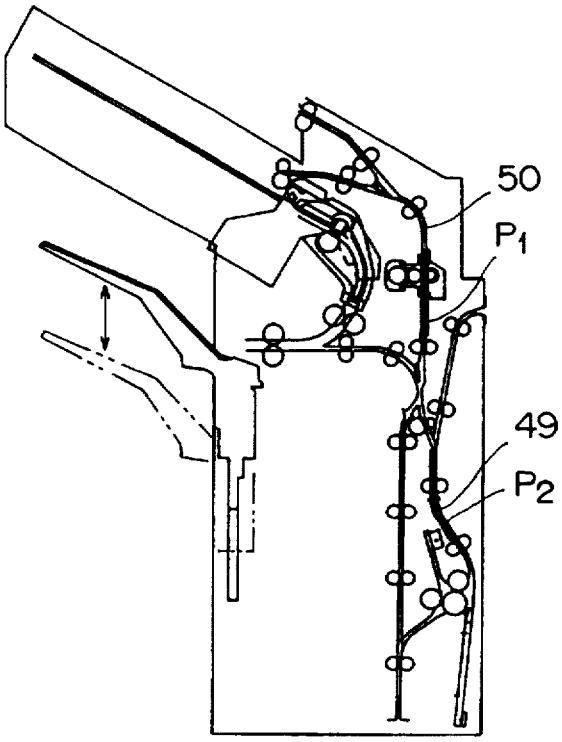
Figure 47:
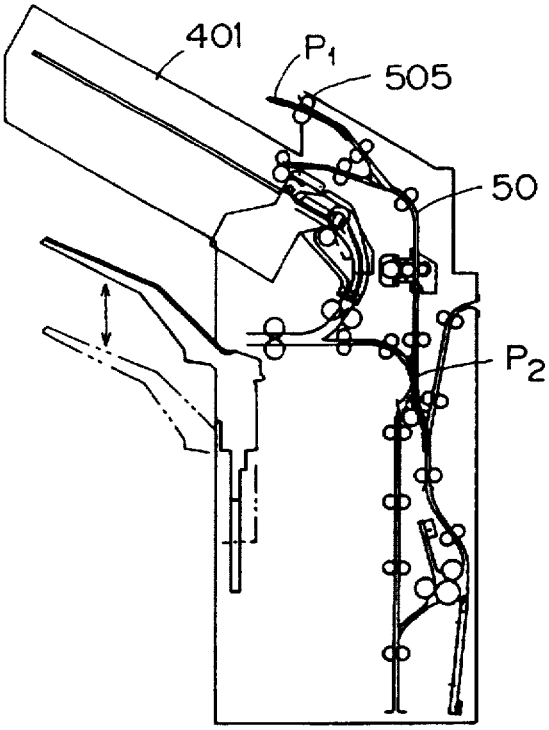
Figure 48:
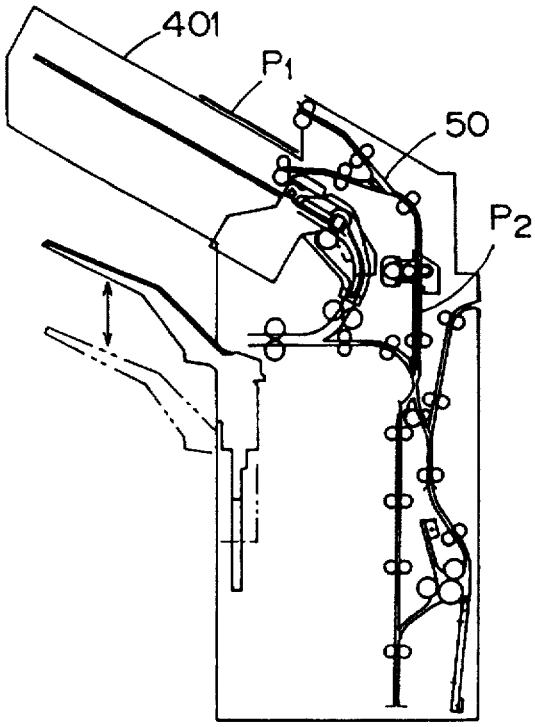
Figure 49:
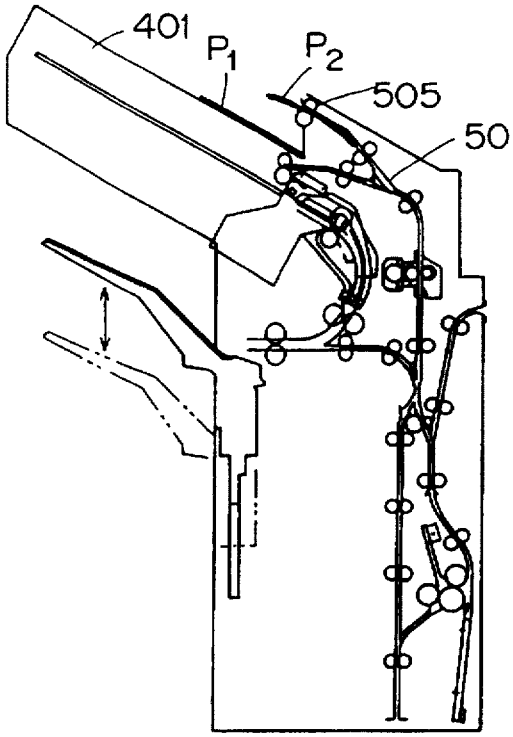
Figure 50:
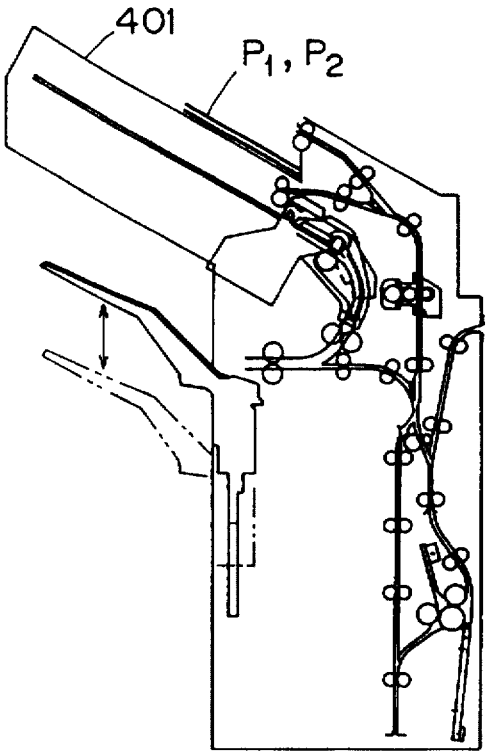

In the non-sort mode, sheets are discharged onto the non-sort tray 401 for being stacked thereon. In this non-sort mode, the changeover pawls 511, 521 are arranged so as to permit sheets to advance on the transport path 50. Sheet $P_1$ discharged from the copying machine 10 (with its image formed surface turned up) is directed to the transport path 48 (see FIG. 43) and, after being once transported to the transport path 49, it is switched back for delivery to the transport path 50 as the rollers 491, 492 are driven reverse (see FIGS. 44 and 45). Next, a second sheet $P_2$ discharged from the machine 10 is also directed to the transport path 48 (see FIG. 45). The first sheet $P_1$ is transported upward on the transport path 50 as it is, and the second sheet $P_2$ is switched back on the transport path 49 for transfer to the transport path 50 (see FIG. 46). Subsequently, the sheet $P_1$ is discharged from the discharge roller pair 505 while being decelerated onto the non-sort tray 401, with its image-formed surface turned down (see FIGS. 47, 48). Similarly, the sheet $P_2$ is discharged from the discharge roller pair 505 while being decelerated onto the non-sort tray 401, with its image-formed surface turned down (see FIGS. 49, 50).

(Non-Sort Mode with Voluminous Storing)

The sheet loading capacity of the non-sort tray 401 is limited. In the present embodiment, therefore, it is arranged that when the non-sort tray 401 becomes full, subsequent incoming sheets are discharged onto the tray 475 of the storing section 46.

Figure 51:
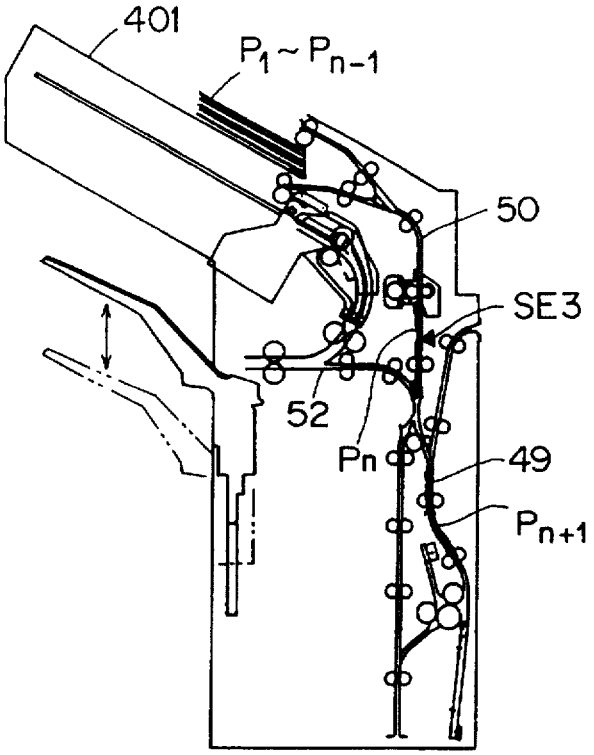
FIGS. 51 to 56 are explanatory vies showing a form of sheet transporting in non-sort mode, in a voluminous discharge fashion.

It is now assumed that as FIG. 51 shows, sheets $P_1$ to $P_{n-1}$ have been discharged onto the non-sort tray 401; that a next sheet $P_n$ is transported on the transport path 50; and that a further sheet $P_{n+1}$ is on the transport path 49. When the sheet $P_n$ is discharged, the non-sort tray 401 will be fully occupied. Whether or not the non-sort tray 401 is full or not is judged by reading the count of a copy number counter in the controller of the machine 10. For this purpose, when the trailing edge of the sheet $P_n$ has passed a junction of the transport paths 50, 52 (i.e., upon detection of sheet trailing edge by the sensor SE3), the changeover pawl 521 is actuated to change the path for the sheet to cause the sheet to enter the transport path 52.

Figure 52:
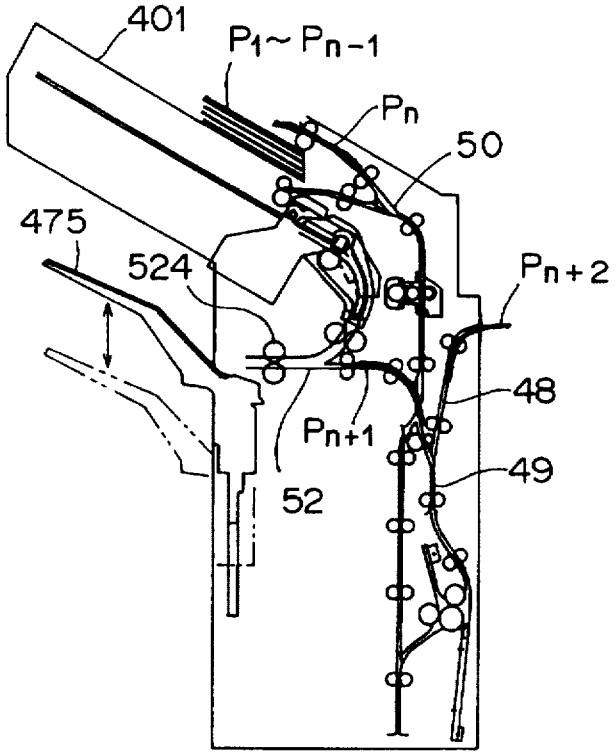
Figure 53:
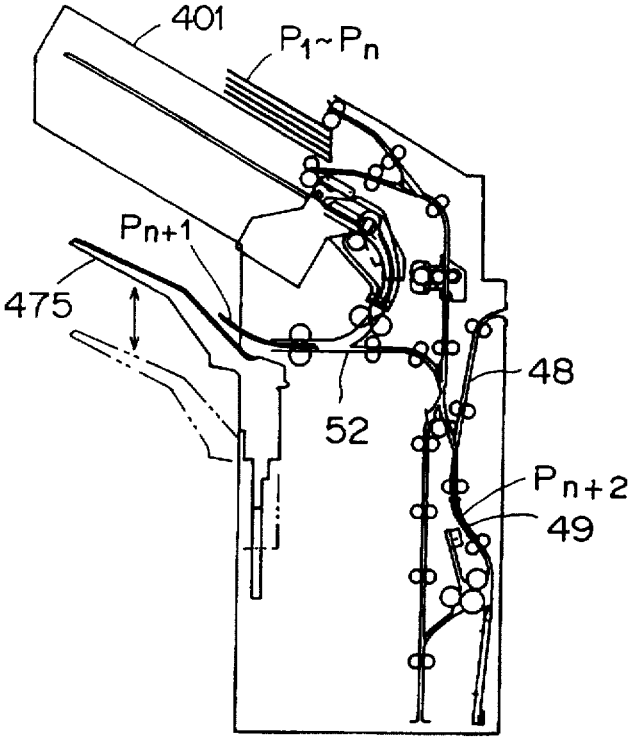
Figure 54:
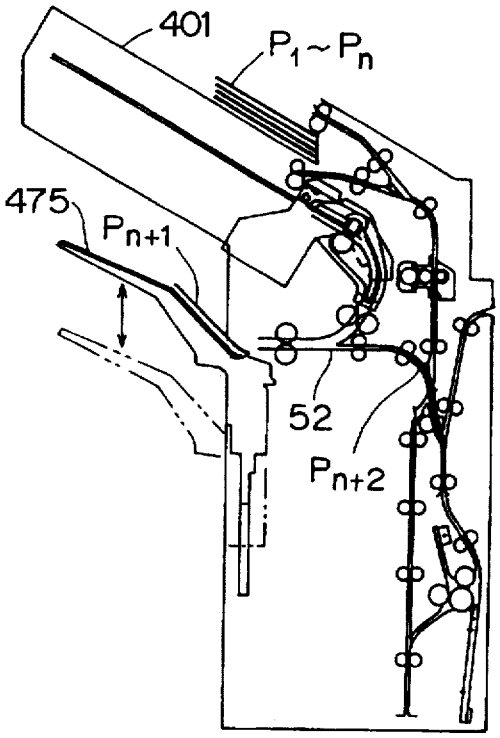
Figure 55:
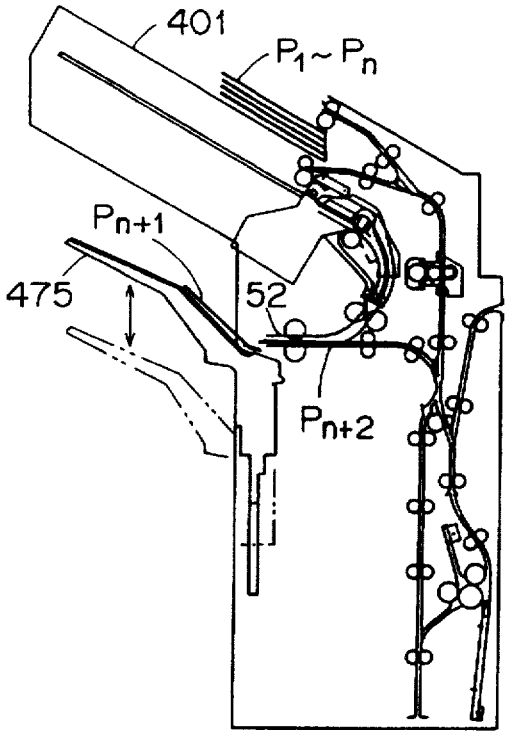
Figure 56:
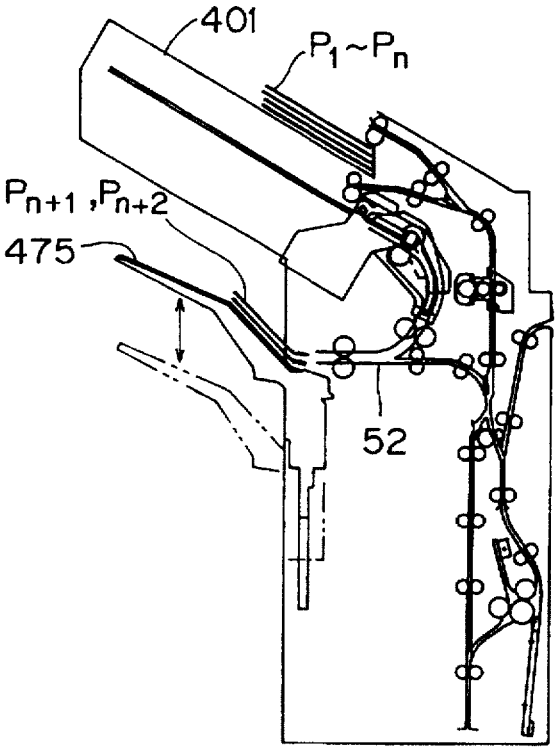

The sheet $P_n$, transported on the path 50, is discharged onto the non-sort tray 401; and the sheet $P_{n+1}$ is transported by the changeover pawl 521 into the path 52 and is then discharged from the discharge roller pair 524 onto the storing tray 475, with its image-formed surface turned down (see FIGS. 52 and 53). Next sheet $P_{n+2}$ is transported from the path 48 to the path 52 through the path 49 and is then discharged/loaded on the tray 475 (see FIGS. 53 through 56). As the number of sheets loaded thereon increases, the tray 475 descends one step at a time as already explained.

(Non-Sort Mode with Different Sizes Sheets)

Next, the mode of operation in which sheets of different sizes are discharged onto the non-sort tray 401 will be explained. It is assumed that documents to be copied are of A4Y size (Y means that the shorter side of the document or sheet is parallel to the direction of transport) and of A3T size (T means that the longer side of the document or sheet is parallel to the direction of transport), each document one in number, and that the number of copies is one for each document.

Figure 57:
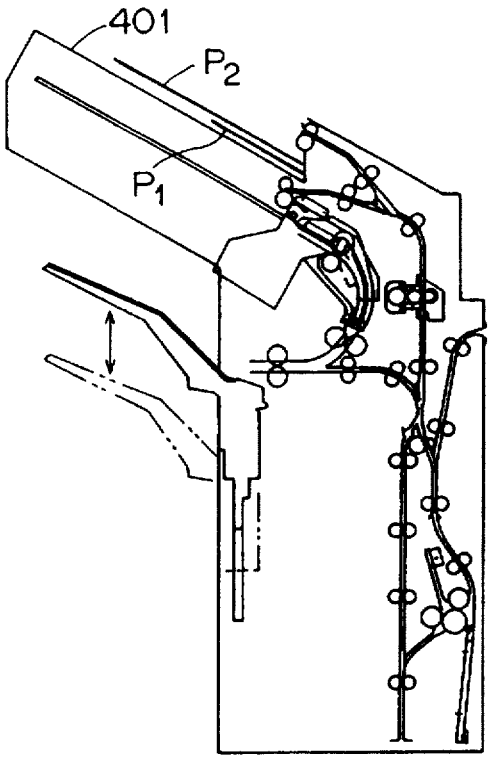
FIG. 57 is an explanatory view showing a form of sheet transporting in non-sort mode, with sheets of different sizes transported in mixture.

Image reversal processing is carried out by the controller of the machine 10 with respect to the first sheet $P_1$ of A4Y size. Sheet transport is carried out in the same fashion as that in the case of the sheet $P_1$ which is illustrated in FIGS. 43 through 48. The second sheet $P_2$ of A3T size is likewise subjected to image reversal processing and the image-formed copy sheet is discharged onto the non-sort tray 401 through the same route of transport as that for the sheet $P_1$. The condition in which two sheets $P_1$, $P_2$ are loaded on the tray 401 is shown in FIG. 57. By carrying out image reversal processing it is possible to enable sheets of different sizes to be arranged in alignment on the tray 401.

(Non-Sort Mode with Z-Folding)

Figure 58:
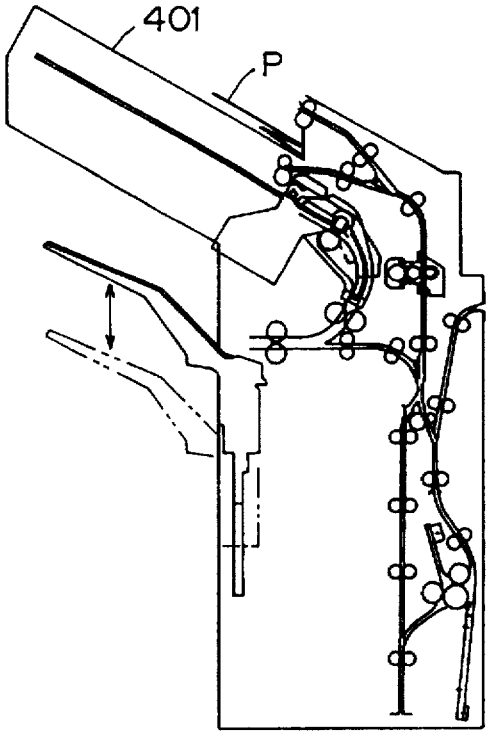
FIG. 58 is an explanatory view showing a form of sheet transporting in non-sort/Z-folding mode.

The manner of operation in which Z-folding is effected with respect to sheets delivered to the finisher 40 is illustrated in FIGS. 6 through 9. The Z-folded sheet P is discharged onto the non-sort tray 401 and loaded thereon, with its image-formed surface turned down (see FIG. 58).

(Non-Sort Mode with Two-Folding)

Figure 11:
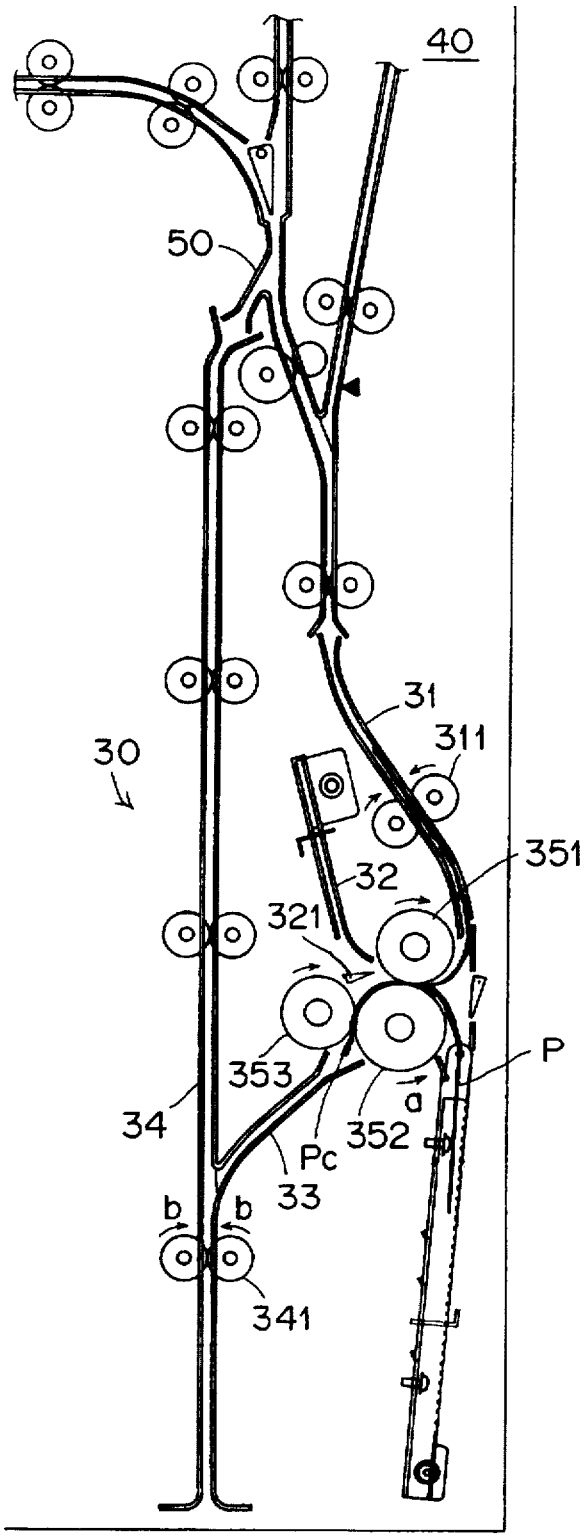
Figure 12:
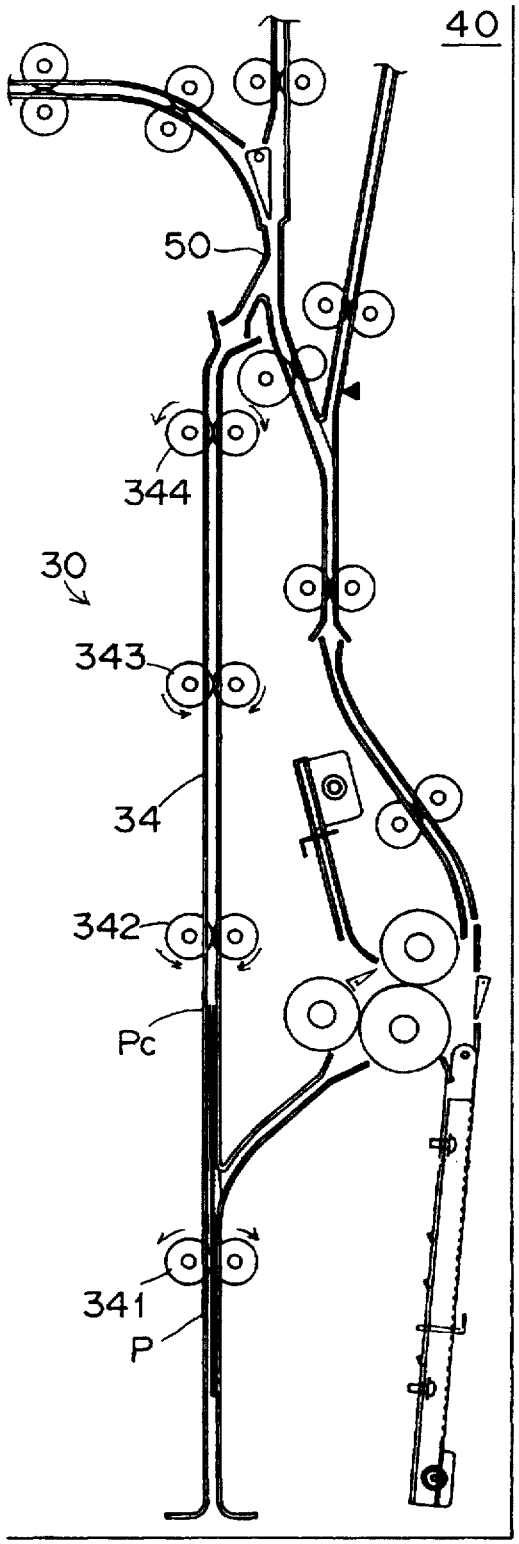
Figure 59:
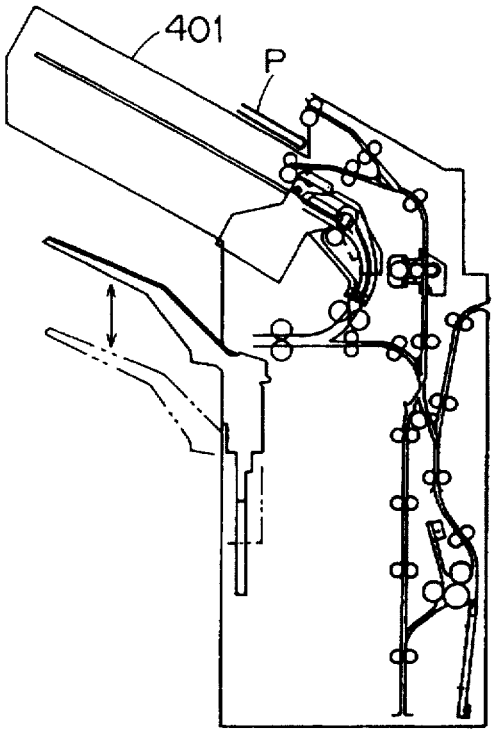
FIG. 59 is an explanatory view showing a form of sheet transporting in non-sort/two-folding mode.

The manner of operation in which a sheet delivered to the finisher 40 is folded in two is illustrated in FIGS. 10, 11 and 12. The two-folded sheet P is discharged onto the non-sort tray 401 and loaded thereon, with the fold oriented toward the upstream side of the direction of discharge (see FIG. 59).

(Leading Portion Stapling Mode)

The manner of sheet transport in the leading portion stapling mode will be explained. It is assumed that two sets of copies made from two documents are to be stapled at the leading portion.

Figure 60:
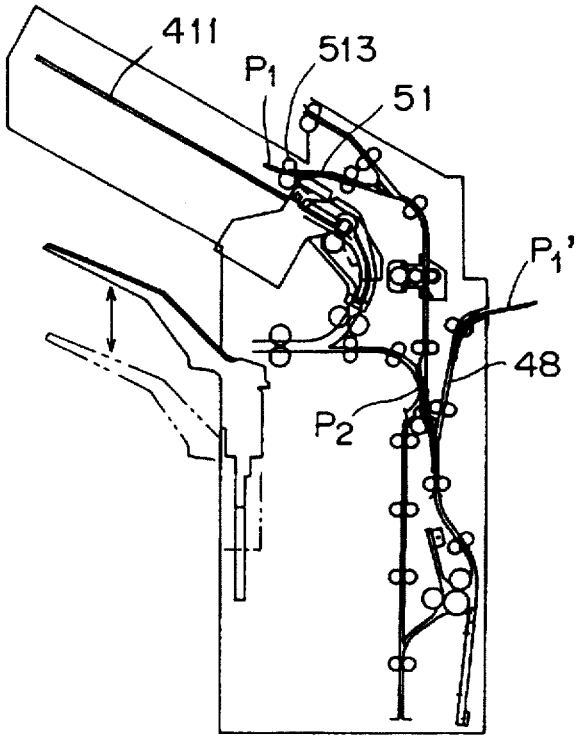
FIGS. 60 to 71 are explanatory views showing a form of sheet transporting in leading portion stapling mode.
Figure 61:
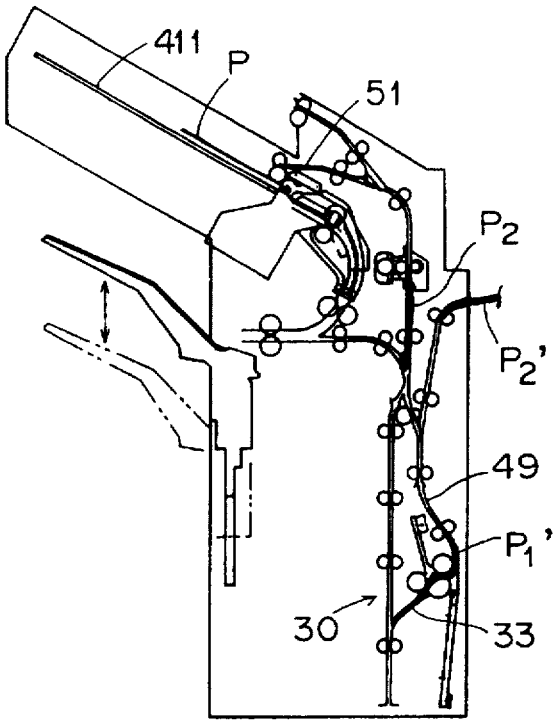
Figure 62:
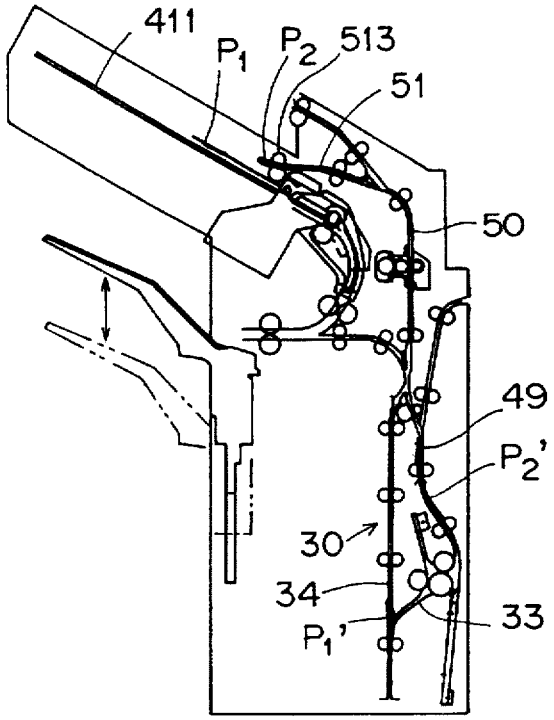

The first set of sheets $P_1$, $P_2$ is transported through the paths 48, 49 and 50 as illustrated in FIGS. 43 through 46. The sheets $P_1$, $P_2$ are directed by the changeover pawl 521 to the transport path 51 and is discharged under deceleration through the discharge roller pair 513 onto the stacking tray 411 (see FIGS. 60 through 63). In succession to the final sheet $P_2$ of the first set, the first sheet $P_1'$ of the second set goes through the process of copy processing at the same interval as the sheets $P_1$, $P_2$ and is transported into the path 48 (see FIG. 60). This sheet $P_1'$ is transferred from the path 49 to the folding mechanism 30 through which it passes without being folded (see FIGS. 61, 62, and 15 through 17). The second sheet $P_2'$ of the second set is also subjected to copy processing at the same interval as the sheets $P_1$, $P_2$, $P_1'$ and is transported into the path 48 (see FIG. 61). The sheet $P_1'$ is switched back on the fourth transport path 34 through the third transport path 33 for being transported upward, and the sheet $P_2'$ is switched back on the transport path 49 to be directed toward the transport path 50 (see FIG. 62).

Figure 63:
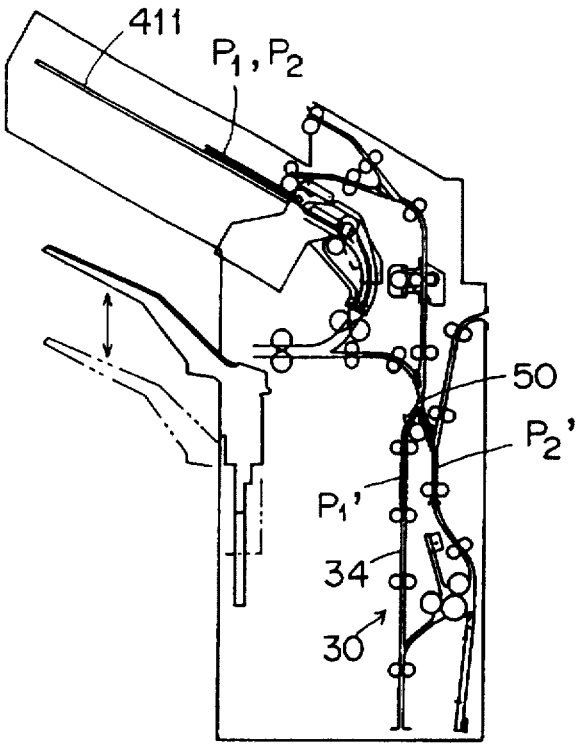
Figure 64:
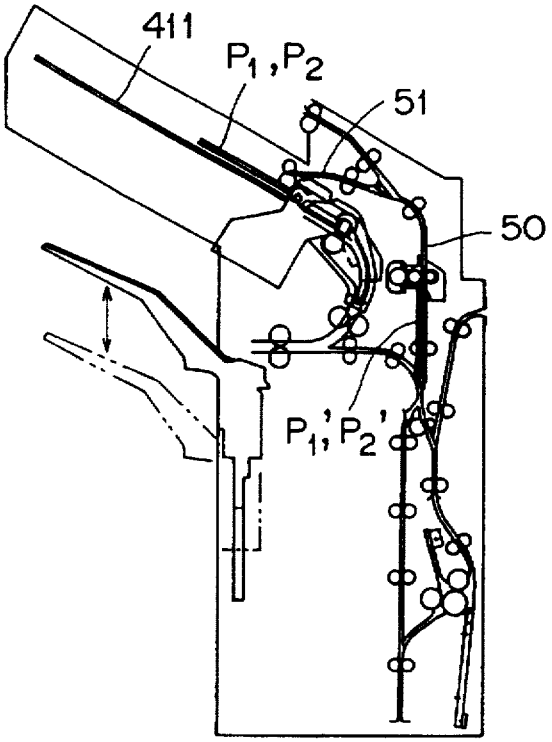

Thus, the sheet $P_1'$ which has been transported along the fourth transport path 34 and the sheet $P_2'$ which has been transported along the transport path 50 meet at the point of meeting of the two paths so that the leading edges of the two sheets are placed one over the other (see FIG. 63). In this case, the image-formed surfaces of the sheets $P_1'$, $P_2'$ face the left in FIG. 63. Thereafter, the sheets $P_1'$, $P_2'$, in superposed relation, are transported on the transport paths 50 and 51 (see FIG. 64).

Figure 65:
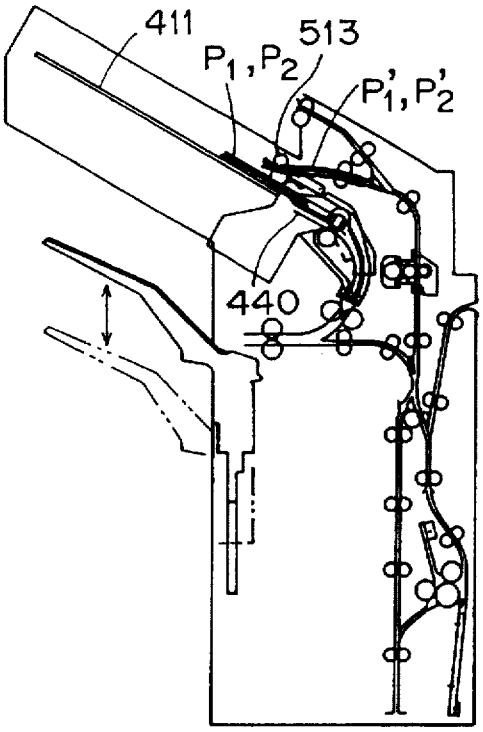
Figure 66:
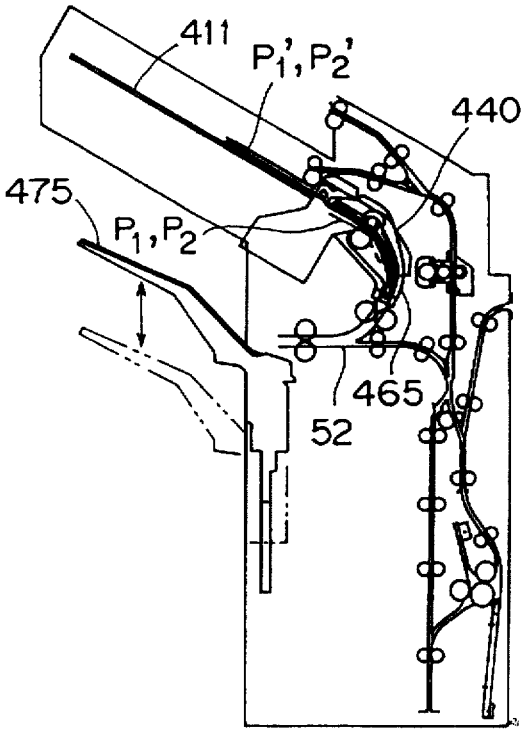
Figure 67:
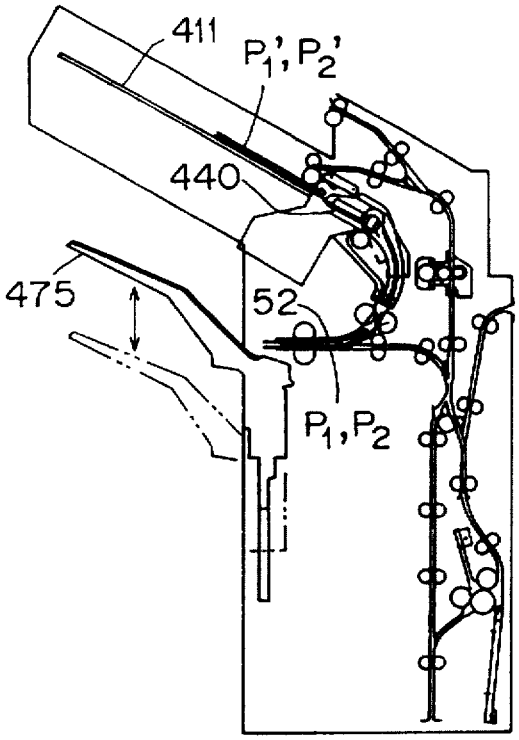
Figure 68:
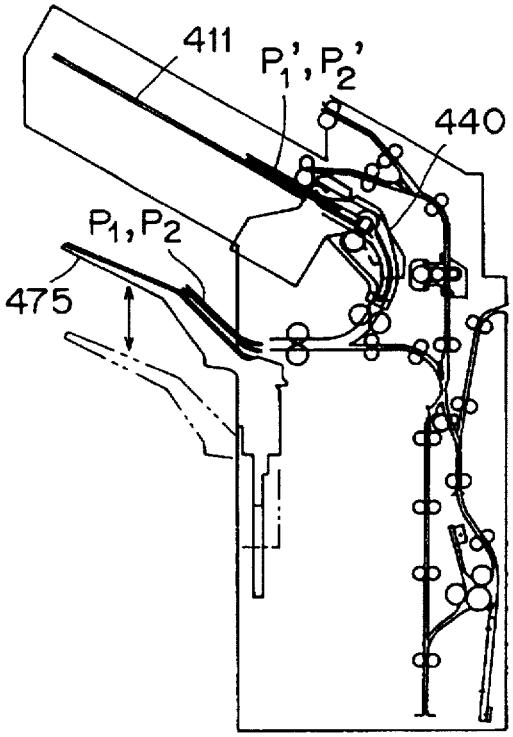

Whilst, the first set of sheets $P_1$, $P_2$ discharged and aligned on the stacking tray 411 earlier, at the leading edge thereof, is delivered by the first chucking device 415 to the stapling station 440 at which stapling is carried out by the stapling unit 441 (see FIG. 65). At this moment, the second set of sheets $P_1'$, $P_2'$ reaches the discharge roller pair 513. After the end of stapling, the sheets $P_1$, $P_2$ are conveyed through the transport unit 465 by the first chucking device 415 and transport rollers 469, 470 and are transported into the storing tray 475 via the transport path 52 (see FIGS. 20, 24, and 66 to 68).

Figure 69:
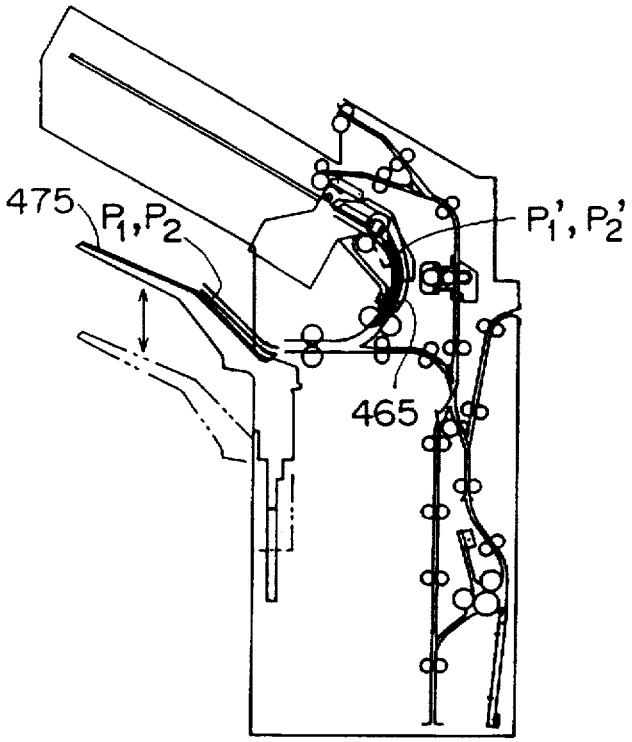
Figure 70:
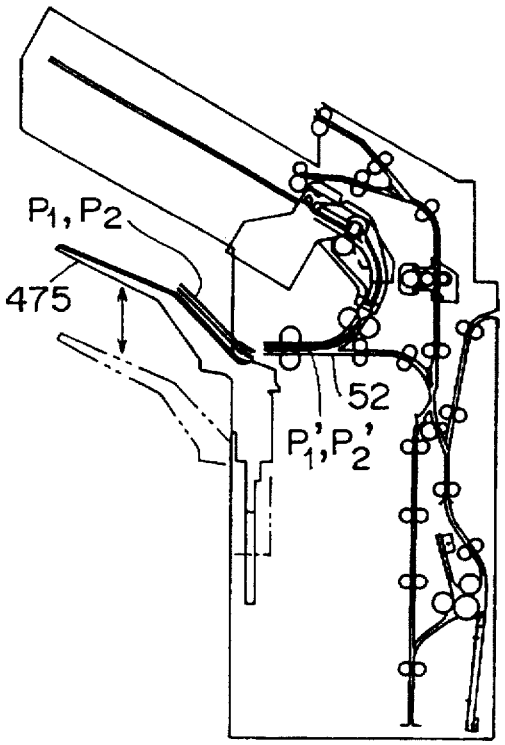
Figure 71:
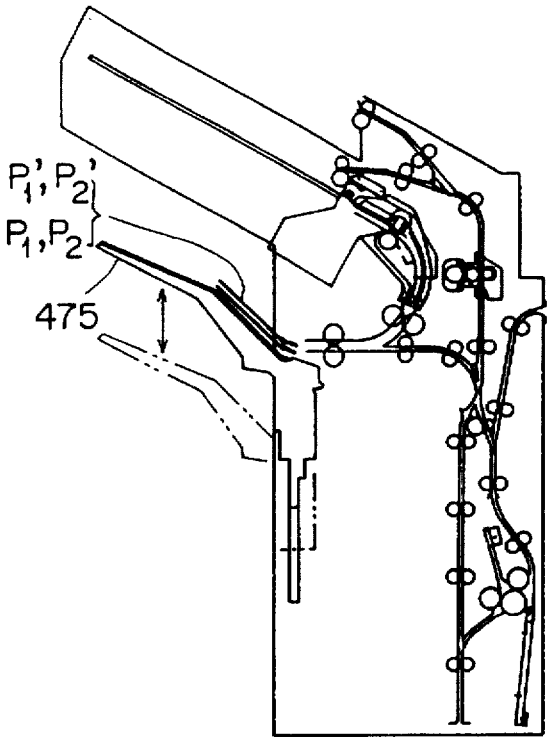

The second set of sheets $P_1'$, $P_2'$ is discharged and aligned on the stacking tray 411 (see FIG. 66) while the preceding sheets $P_1$, $P_2$ are being transported through the transport unit 465, and is then delivered by the first chucking device 415 to the stapling station 440 (see FIG. 67) at which stapling is carried out by the stapling unit 441. Thereafter, the sheets $P_1'$, $P_2'$ are transported through the transport unit 465 (see FIG. 69), and are transported to the storing tray 475 via the transport path 52 (see FIGS. 70 and 71).

In this way, where plural sets of copies are handled in the leading portion stapling mode, each first sheet of the second set and each subsequent set is caused to make a detour round the sheet folding mechanism 30 and then join a second sheet in superposed relation midway on the transport path 50. Therefore, even if a preceding set of sheets is in the course of being stapled and is still present on the stacking tray 411, the copying operation of the machine 10 need not be held on standby, it being thus possible to reduce the time required for the copying/stapling as a whole.

(Trailing Portion Stapling Mode)

The manner of sheet transport in the trailing portion stapling mode will be explained. As in the description made for sheet transport in the leading portion stapling mode, it is assumed that two sets of copies are prepared from two documents and are to be trailing portion stapled.

The manner in which the first set of sheets $P_1$, $P_2$ are transported within the finisher 40 is same as that in the leading portion stapling mode. Also, the manner of transport of the second set of sheets $P_1'$, $P_2'$ such that they are transported along the transport path 50 in superposed relation is the same as that in the leading portion stapling mode (see FIGS. 60 through 64).

Figure 72:
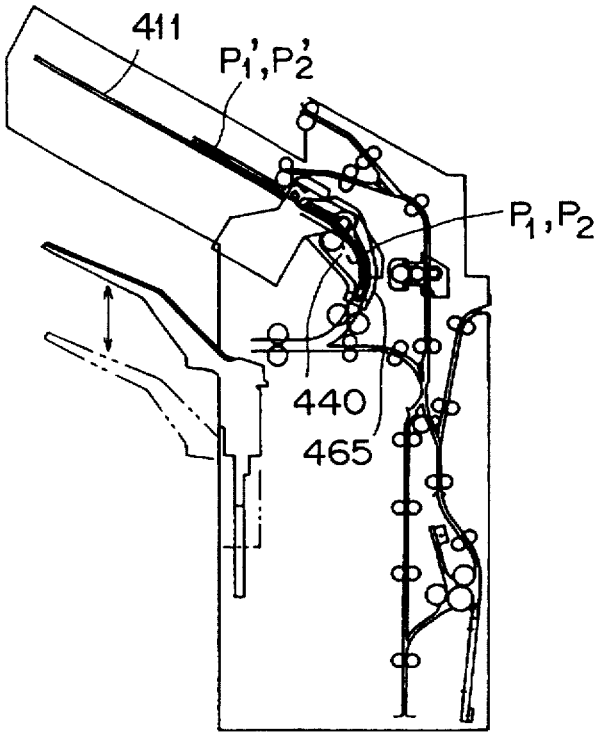
FIGS. 72 to 76 are explanatory views showing a form of sheet transporting in trailing portion stapling mode.
Figure 73:
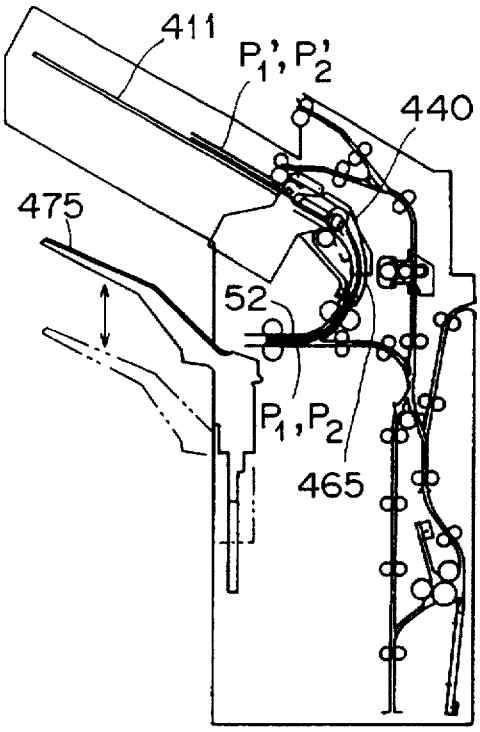

The first set of sheets $P_1$, $P_2$ which is previously discharged onto the stacking tray 411 and aligned thereon is transported by the first chucking device 415 to the stapling station 440. Then, the sheets $P_1$, $P_2$ are transported by the transport rollers 469, 470 and, when their trailing portions reach a stapling position, they are stopped once and subjected to stapling by the stapling unit 441 at that position (see FIG. 72). At this point of time, the stacking tray 411 is empty and accordingly the second set of sheets $P_1'$, $P_2'$ is discharged onto the stacking tray 411 and aligned thereon. After being stapled, the sheets $P_1$, $P_2$ are transported through the transport unit 465 by transport rollers 469, 470 (see FIG. 73), and are then transported through the transport path 52 onto the storing tray 475 (see FIG. 74).

Figure 74:
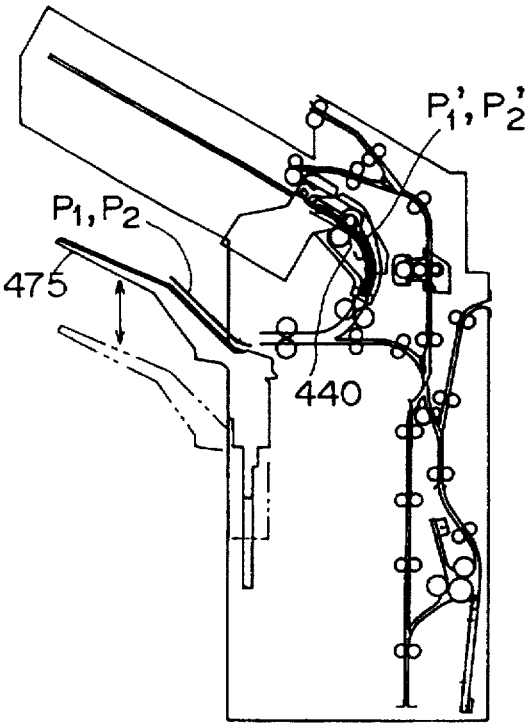
Figure 75:
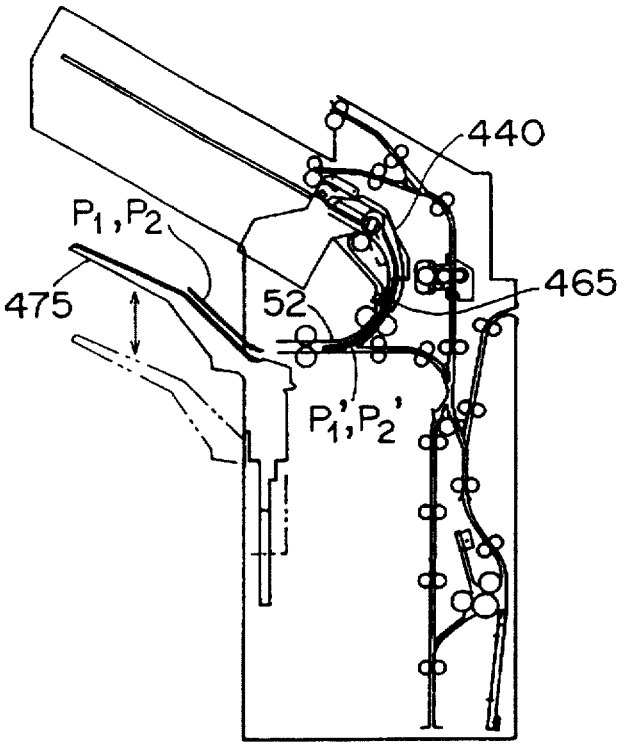
Figure 76:
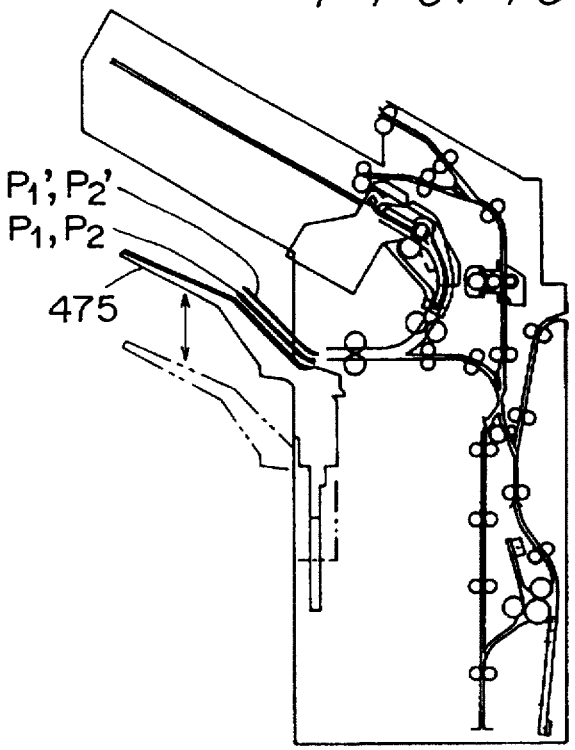

When the preceding sheets $P_1$, $P_2$ have been transported from the transport unit 465, the sheets $P_1'$, $P_2'$ of the second set are transported by the transport rollers 469, 470 until their trailing edges reach the stacking tray 411, and are subjected to stapling by the stapling unit 441 (see FIG. 74). After being stapled, the sheets $P_1'$, $P_2'$ are transported through the transport unit 465 by the transport rollers 469, 470 (see FIG. 75), and are then transported through the transport path 52 onto the storing tray 475 (see FIG. 76).

(Z-Folding/Trailing Portion Stapling Mode)

Figure 77:
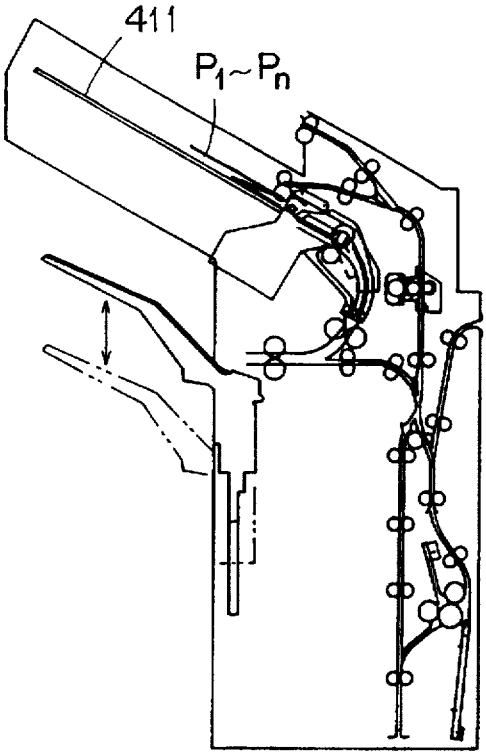
FIGS. 77 to 80 are explanatory views showing a form of sheet transporting in Z-folding/trailing portion stapling mode.
Figure 78:
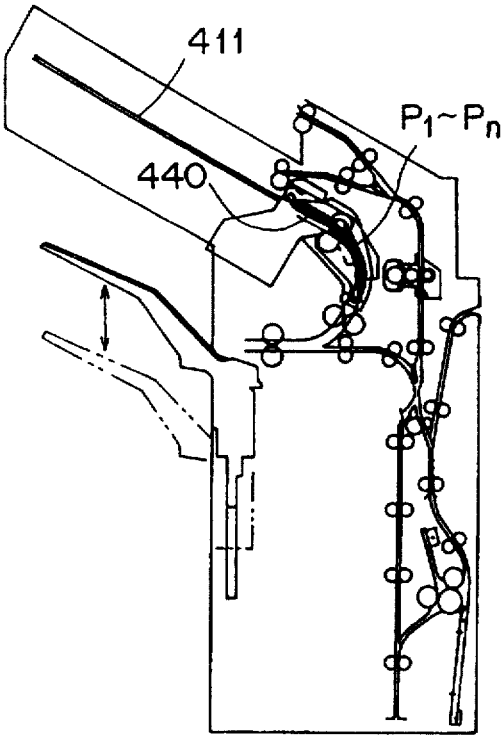
Figure 79:
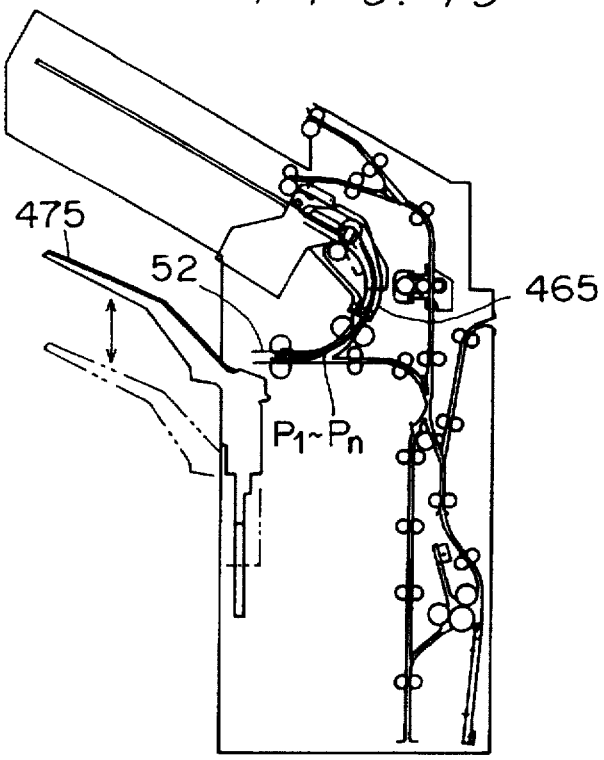
Figure 80:
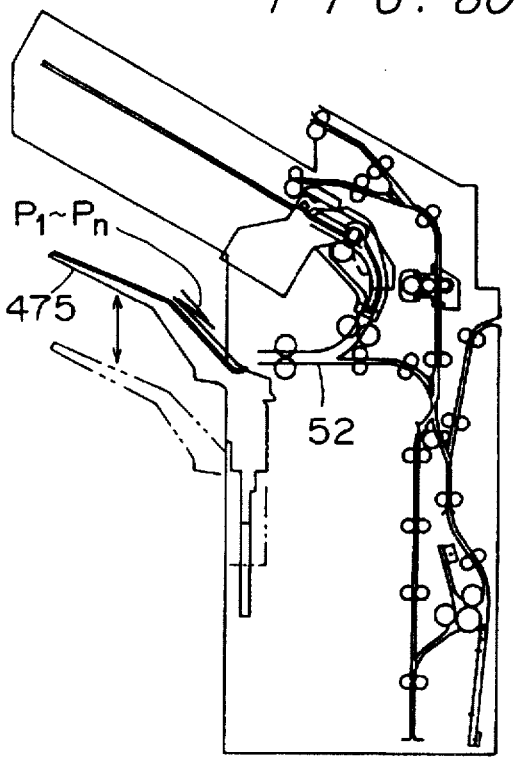

The manner of sheet transport in the case of z-folding is shown in FIGS. 6 through 9. After being subjected to Z-folding, sheets are discharged from the transport path 51 onto the stacking tray 411 so that a predetermined number of sheets $P_1$ to $P_n$ are received onto the tray 411 and aligned thereon (see FIG. 77). Z-folded sheets $P_1$ to $P_n$ are delivered by the first chucking device 415 to the stapling station 440. Then, transported by the transport rollers 469, 470, the sheets $P_1$ to $P_n$ are once stopped when their trailing portions reach the stapling position at which stapling is carried out by the stapling unit 441 (see FIG. 78). After stapling operation, the sheets $P_1$ to $P_n$ are transported by the transport rollers 469, 470 and the transport roller pair 474 along the transport unit 465 and the transport path 52 (see FIG. 79) and are then delivered onto the storing tray 475 (see FIG. 80).

(Two-Folding/Trailing Portion Stapling Mode)

Figure 81:
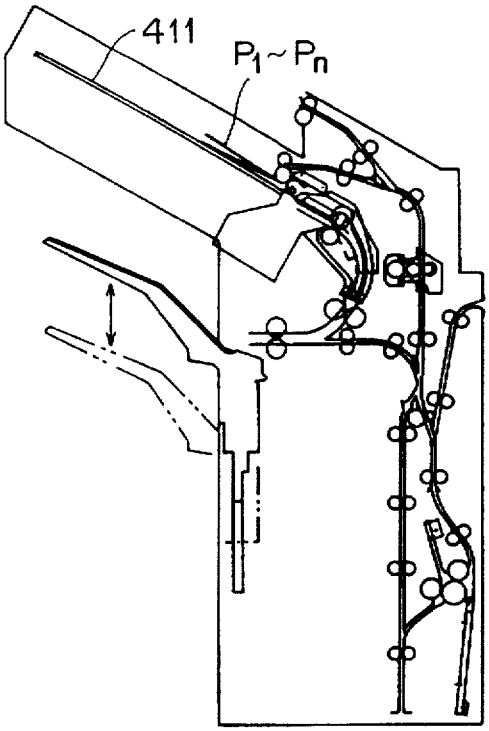
FIGS. 81 to 84 are explanatory views showing a form of sheet transporting in two-folding/trailing portion stapling mode.
Figure 82:
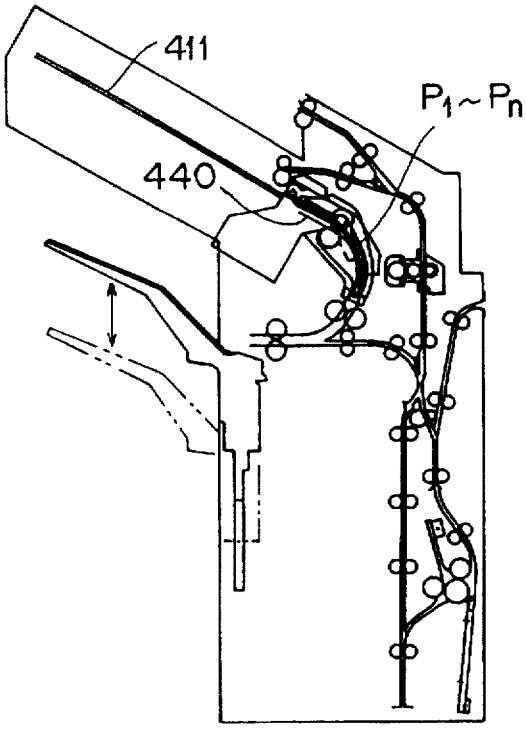
Figure 83:
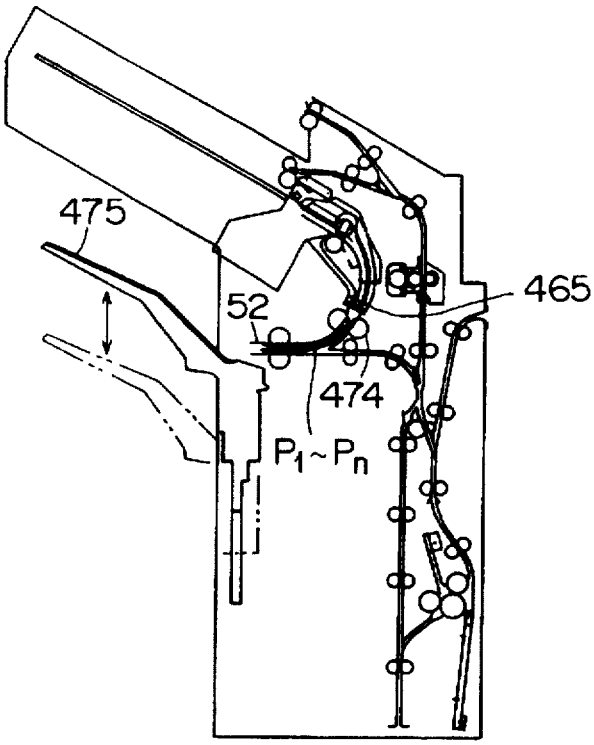
Figure 84:
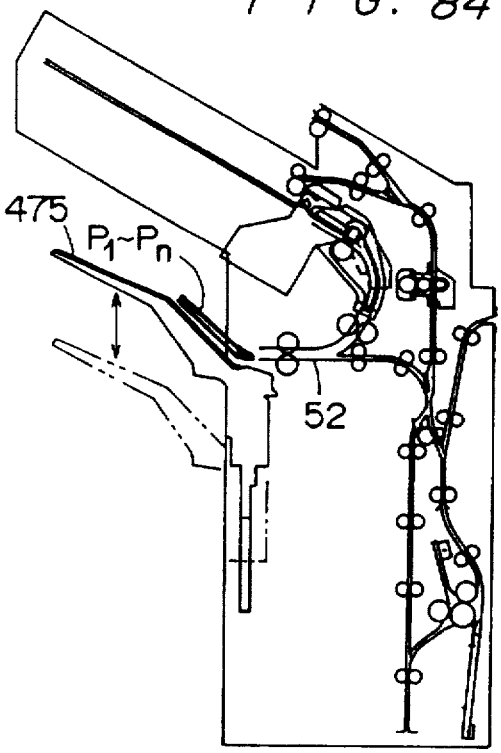

The manner of sheet transport in the case of two-folding is shown in FIGS. 10, 11 and 12. After being folded in two, sheets are discharged from the transport path 51 onto the stacking tray 411 so that a predetermined number of sheets $P_1$ to $P_n$ are received onto the tray 411 and aligned thereon (see FIG. 81). The two-folded sheets $P_1$ to $P_n$ are delivered by the first chucking device 415 to the stapling station 440. Then, transported by the transport rollers 469, 470, the sheets $P_1$ to $P_n$ are once stopped when their trailing portions reach the stapling position at which stapling is carried out by the stapling unit 441 (see FIG. 82). After stapling operation, the sheets $P_1$ to $P_n$ are transported by the transport rollers 469, 470 and the transport roller pair 474 along the transport unit 465 and the transport path 52 (see FIG. 83) and are then delivered onto the storing tray 475 (see FIG. 84).

(Trailing Portion Stapling Mode/Different Sizes Sheets)

The manner of sheet transport in the case of trailing portion stapling. It is assumed that original documents are two in number, one of A4Y size and the other of A3T size, which are to be copied one each in number. In this case, A3T sheet is Z-folded so as to be enabled to match A4Y size.

Figure 85:
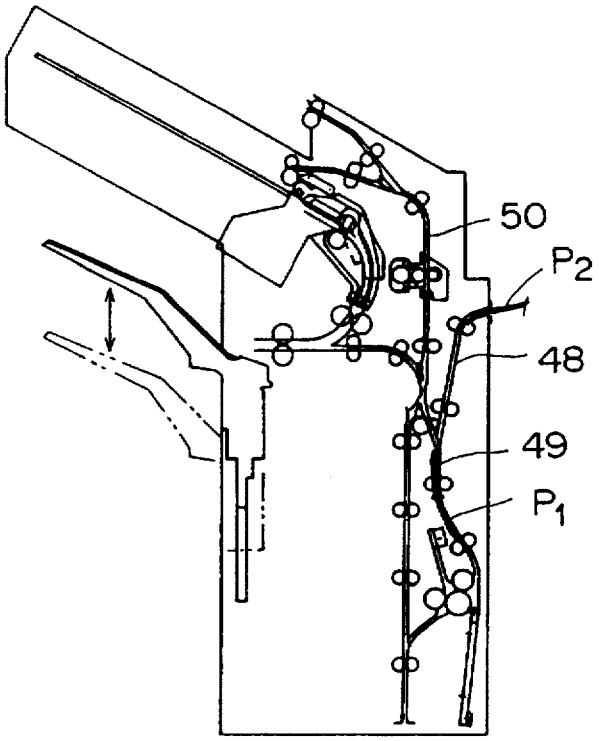
FIGS. 85 to 94 are explanatory views showing a form of sheet transporting in trailing portion stapling mode with sheets of different sizes transported in mixture.
Figure 86:
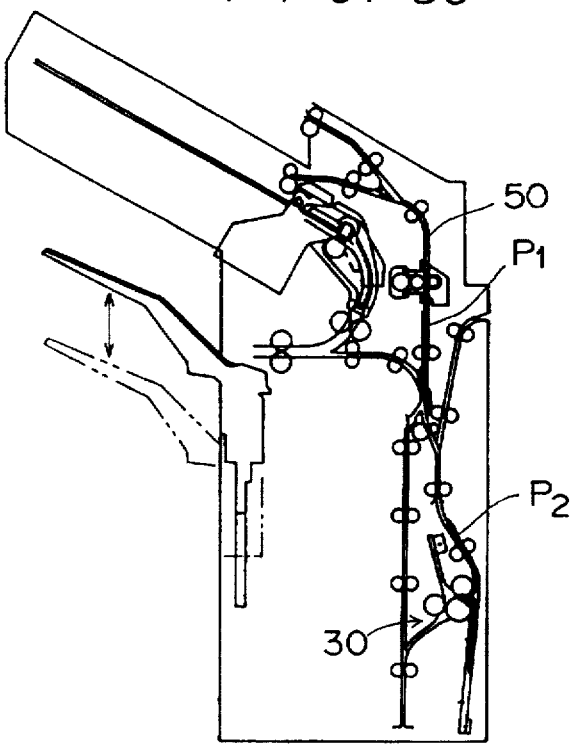
Figure 87:
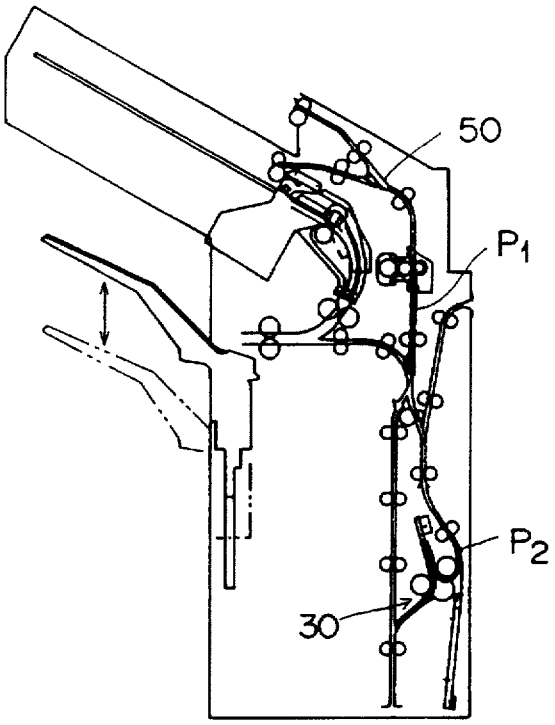
Figure 88:
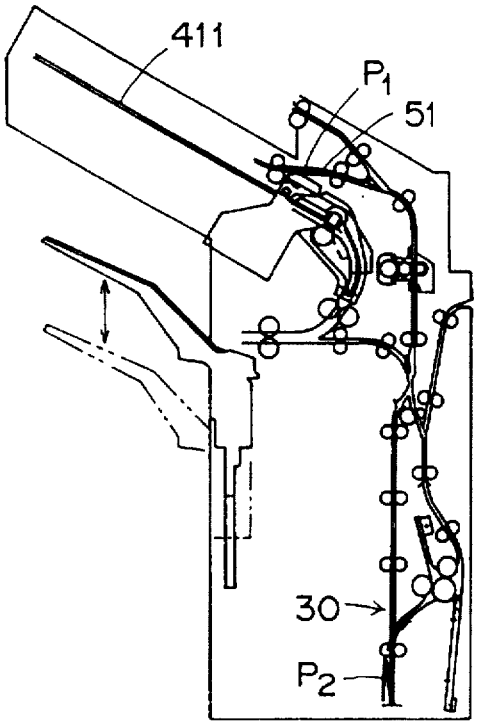
Figure 89:
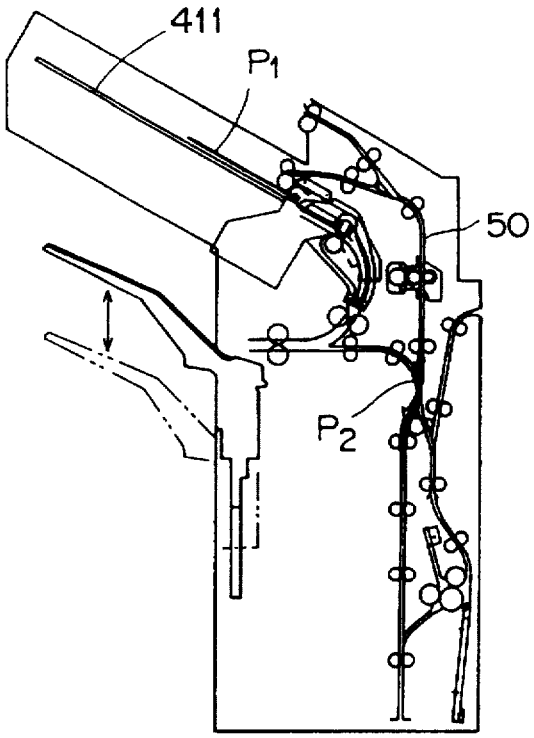
Figure 90:
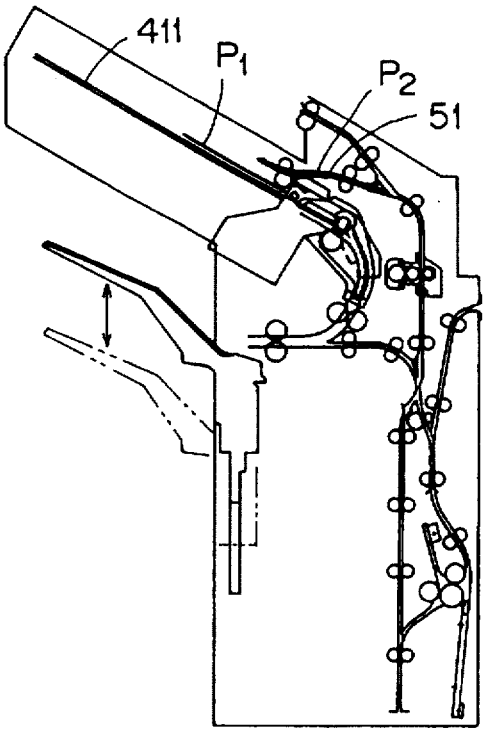
Figure 91:
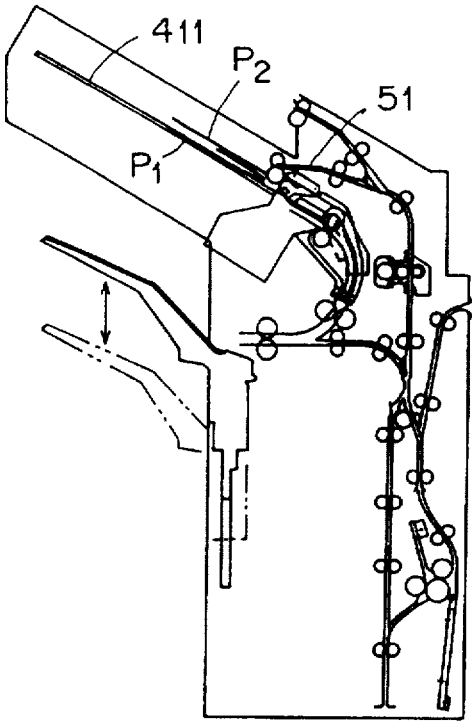
Figure 92:
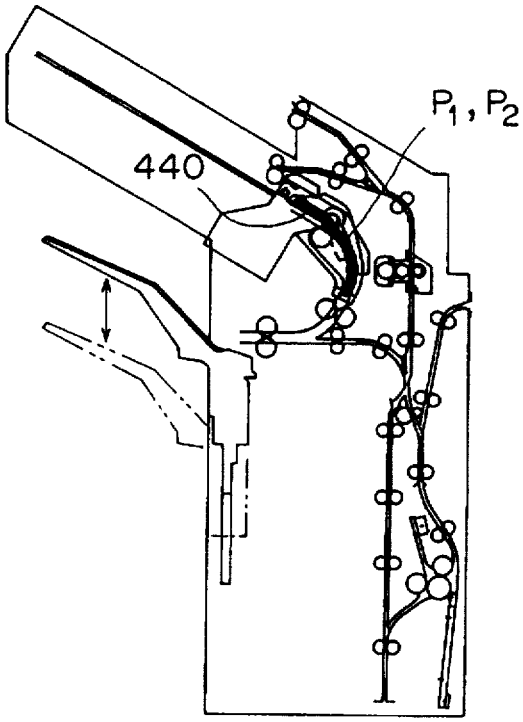
Figure 93:
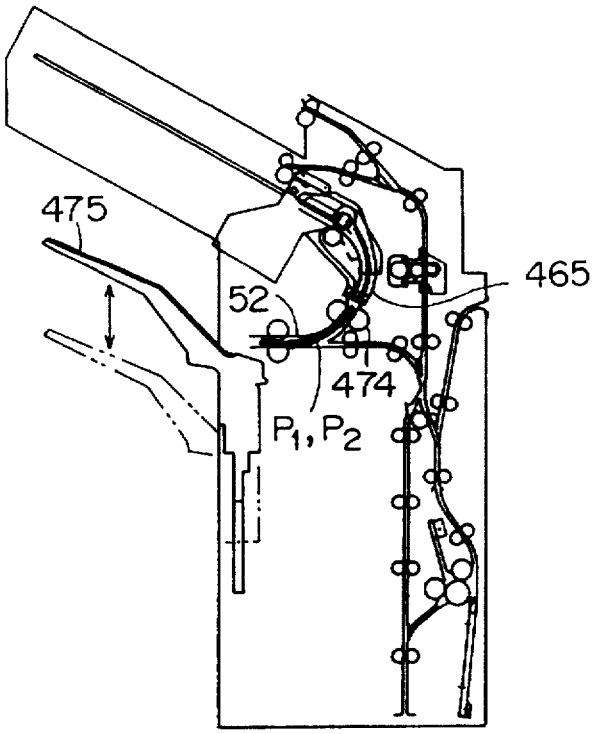
Figure 94:
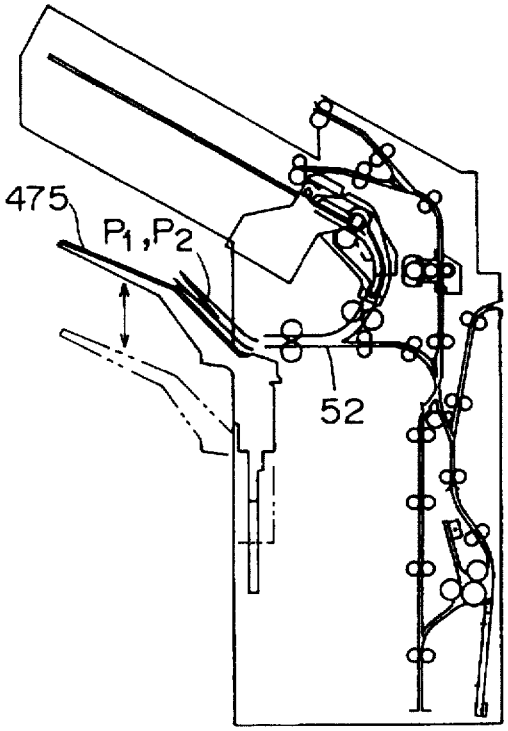

The first sheet (A4Y) $P_1$ is switched back on the transport path 49 so that it is transported along the transport path 50 (see FIGS. 85, 86, and 87), and is discharged from the transport path 51 onto the stacking tray 411 (see FIGS. 88 and 89). In succession to the sheet $P_1$, the second sheet (A3T) $P_2$ is transported into the transport path 48 and is Z-folded by the folding mechanism 30 (see FIGS. 85 to 88), being then transported into the transport path 50 (see FIG. 89). Then, the Z-folded sheet $P_2$ is discharged from the transport path 51 onto the stacking tray 411 and is aligned on the sheet $P_1$ (see FIGS. 90 and 91). Then, the sheets $P_1$, $P_2$ are transported by the first chucking device 415 onto the stapling station 440 and are further transported by the transport rollers 469, 470, being once stopped when the trailing portions of the sheets have reached the stapling position (see FIG. 92). At this position, the stapling operation is carried out with respect to the trailing portions of the sheets $P_1$, $P_2$. After the stapling operation, the sheets $P_1$, $P_2$ are transported by the transport rollers 469, 470 and the transport roller pair 474 along the transport unit 465 and the transport path 52 (see FIG. 93) and are then delivered onto the storing tray 475 (see FIG. 94).

(Center Stapling Mode)

Figure 14:
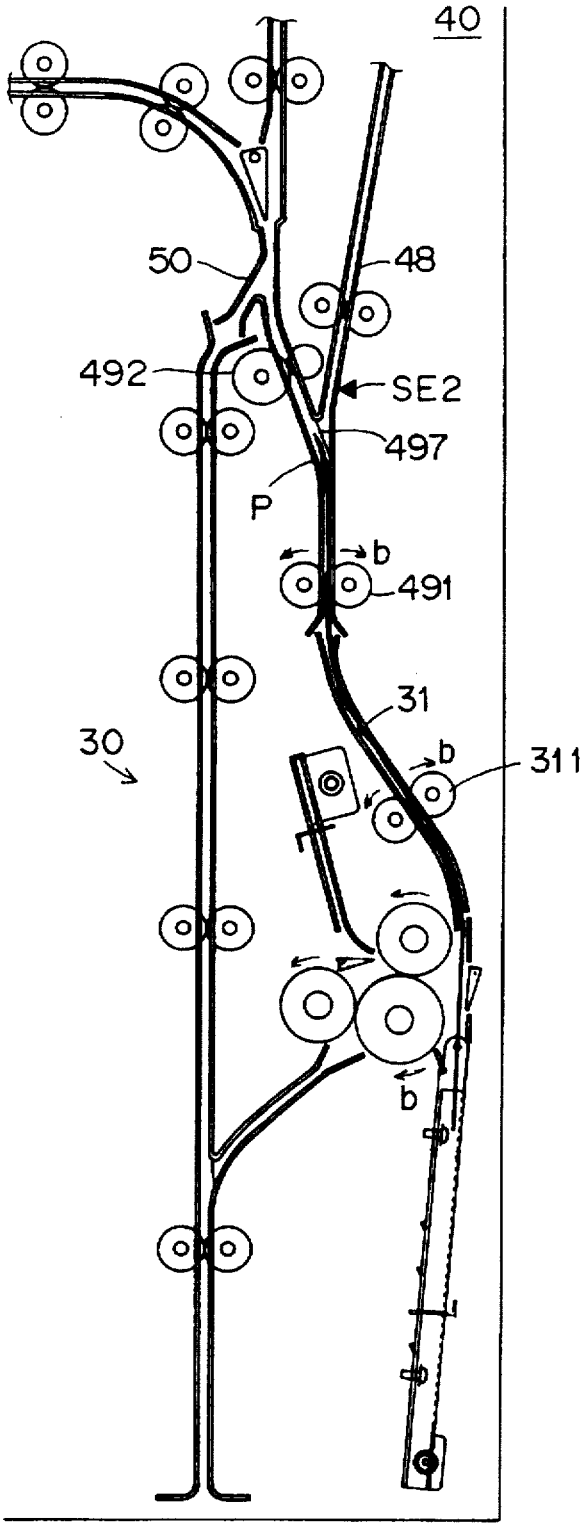
Figure 95:
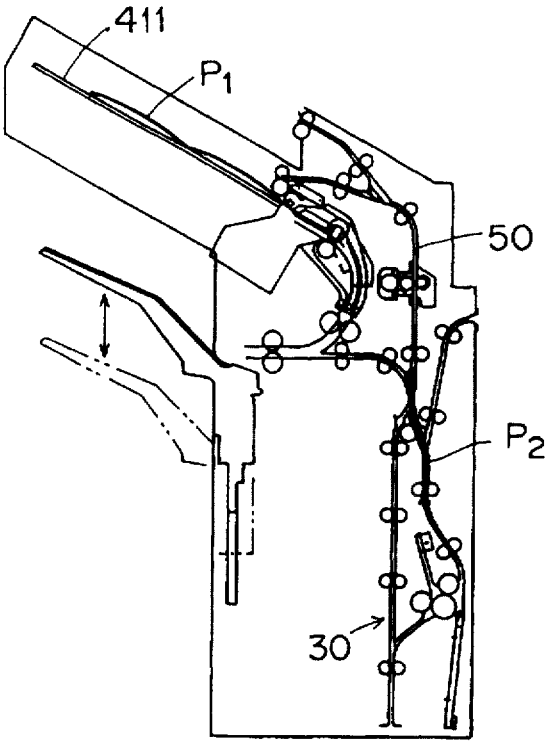
FIGS. 95 to 100 are explanatory views showing a form of sheet transporting in center stapling mode.
Figure 96:
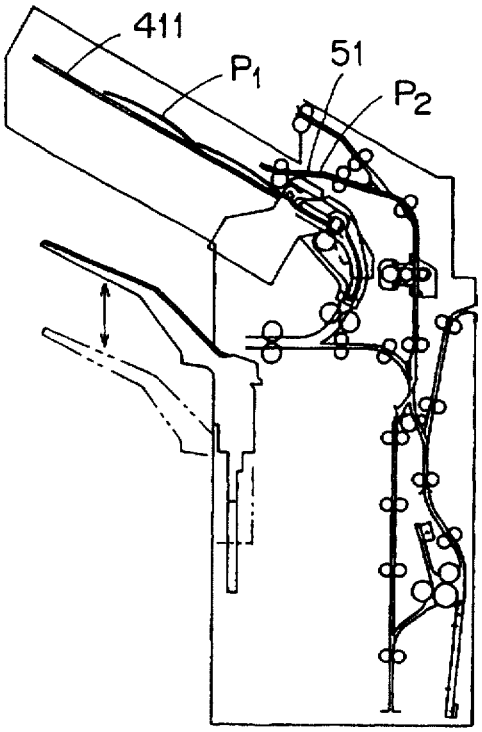
Figure 97:
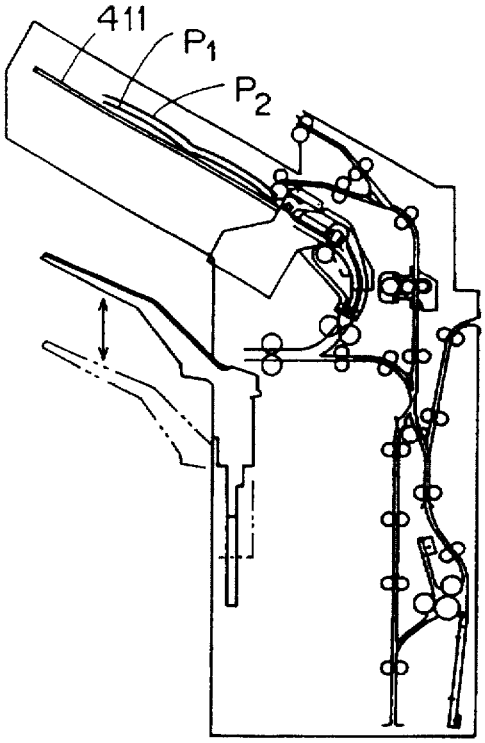

Sheets transported into the finisher 40 undergo the process of fold line forming by the folding mechanism 30. The process of fold line forming is illustrated in FIGS. 13 and 14. The first sheet $P_1$, with a fold line formed along a center portion, is discharged onto the stacking tray 411 and aligned thereon (see FIG. 95). At this point of time, the second sheet $P_2$, having undergone the process of fold line forming by the folding mechanism 30, reaches the transport path 50. Then, the sheet $P_2$ is discharged through the transport path 51 onto the stacking tray 411 and is aligned thereon (see FIGS. 96 and 97).

Figure 98:
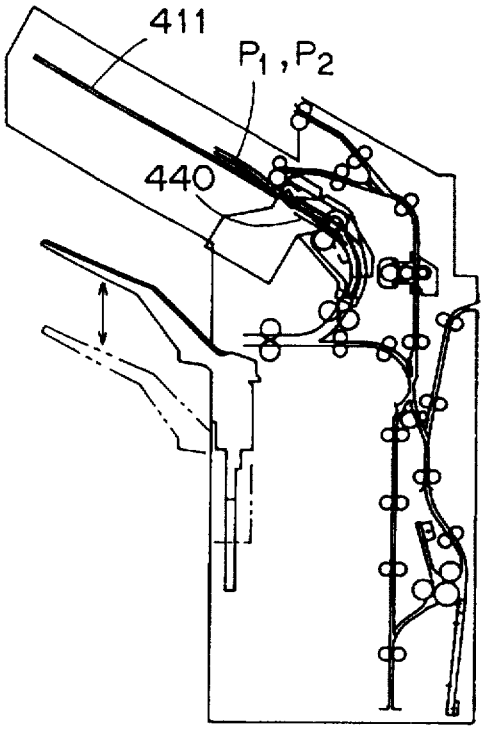
Figure 99:
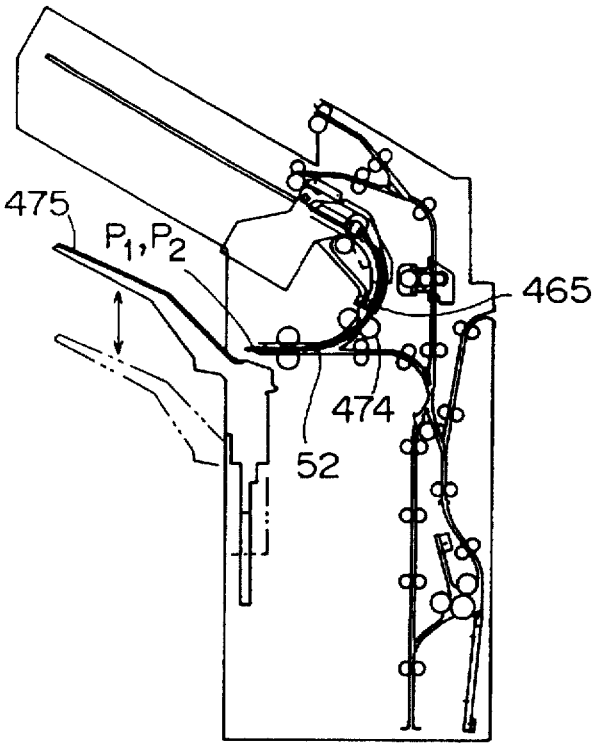
Figure 100:
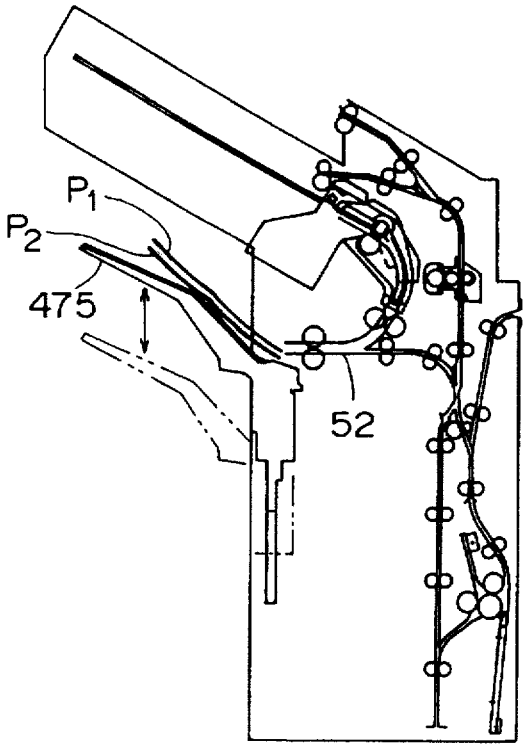

Next, the sheets $P_1$, $P_2$ are transported by the first chucking device 415 onto the stapling station 440 and are further transported by the transport rollers 469, 470; and they are once stopped when their center portions have reached the stapling position (see FIG. 98). At this position, the stapling operation is effected on the fold line of the sheets $P_1$, $P_2$. After the stapling operation, the sheets $P_1$, $P_2$ are transported by the transport rollers 469, 470 and the transport roller pair 474 along the transport unit 465 and the transport path 52 (see FIG. 99) and are then delivered onto the storing tray 475 (see FIG. 100).

(Finishing of Copy)

Next, the condition of copy finish achievable through the use of the above described arrangement of the present embodiment will be explained.

Figure 101:
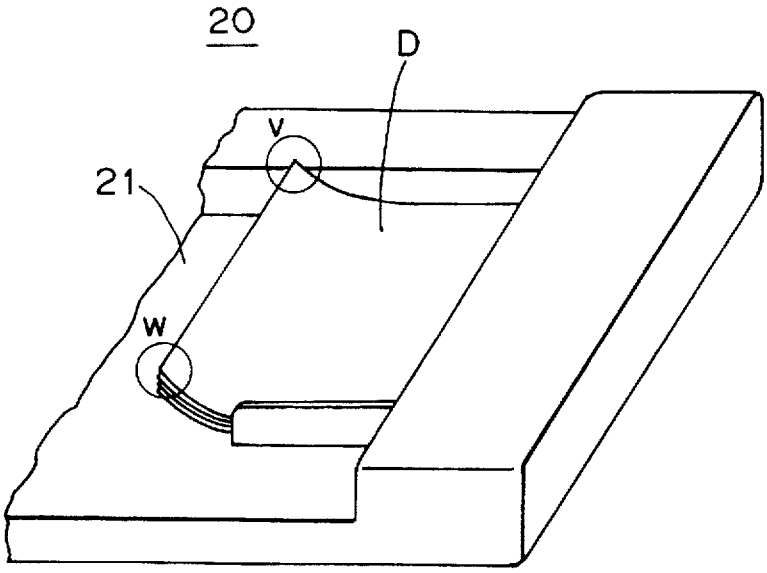
FIG. 101 is a perspective view showing document set on an auto document feeder.
Figure 102:
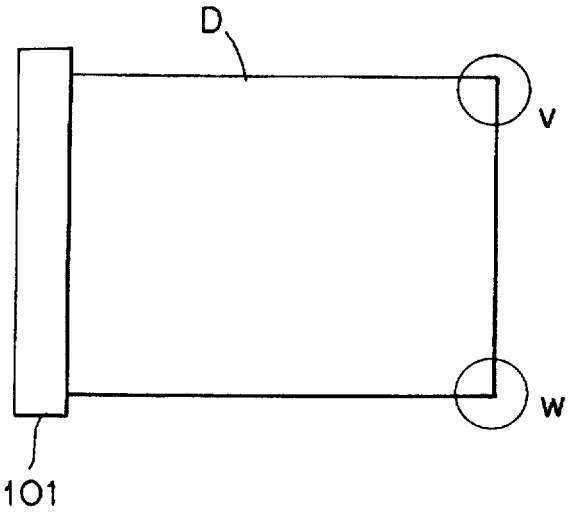
FIG. 102 is a plan view showing document set on a platen glass of the copying machine.

First, as FIG. 101 shows, document D is set on the feed tray 21 of the ADF 20, with the image side up and the stapling position set on the left side. In the case of the corner stapling, an operator selects one of corner portions v and w which is to be stapled. The document D is set on the platen glass of the machine 10 by the ADF 20, with the image turned down, as shown in FIG. 102. In this case, the document D is set at an exposure position as its leading edge contacts the scale 101.

Figure 103:
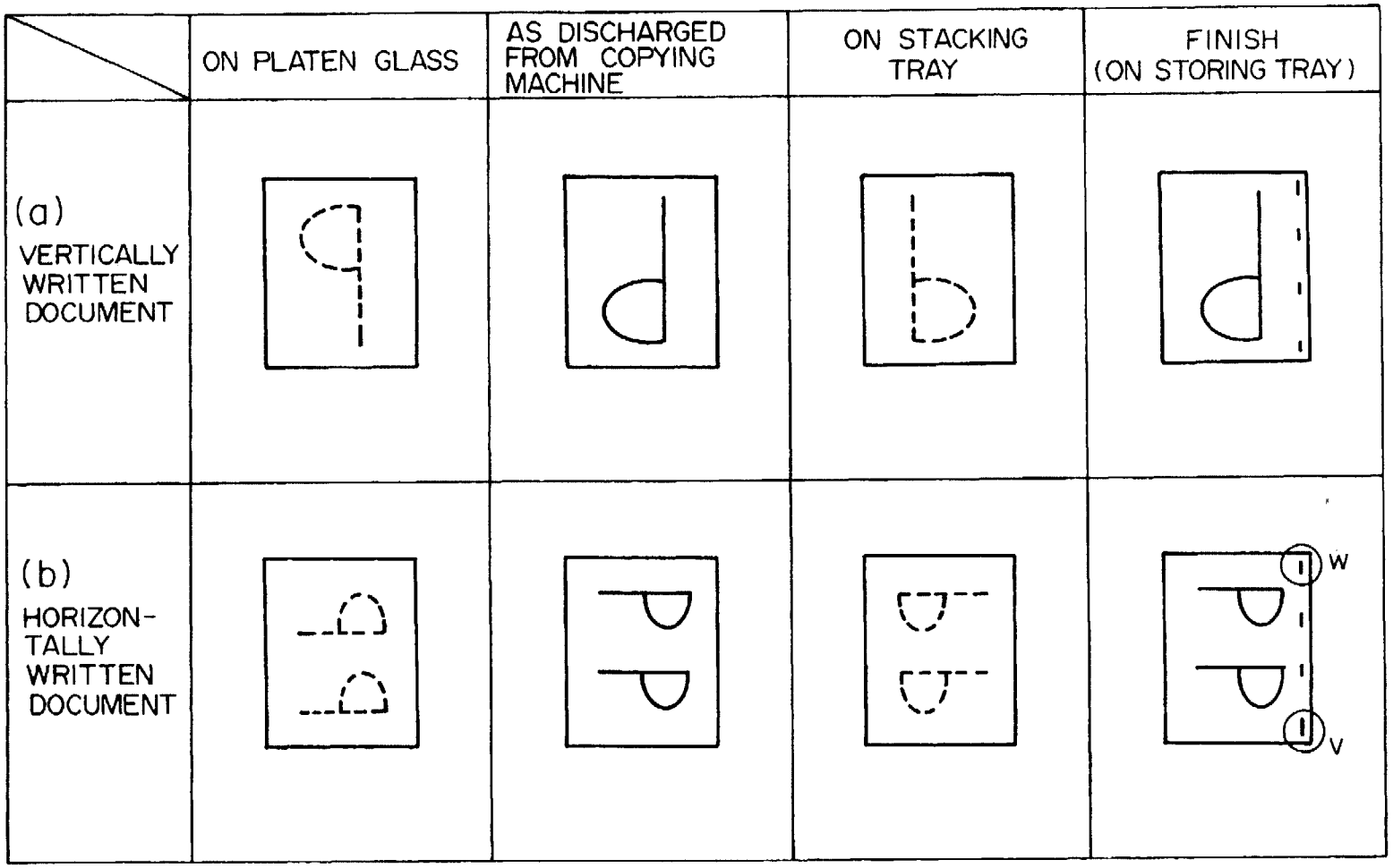
FIG. 103 is an explanatory view showing copies in a series of handling stages and a finished state of the copies.
Figure 104:
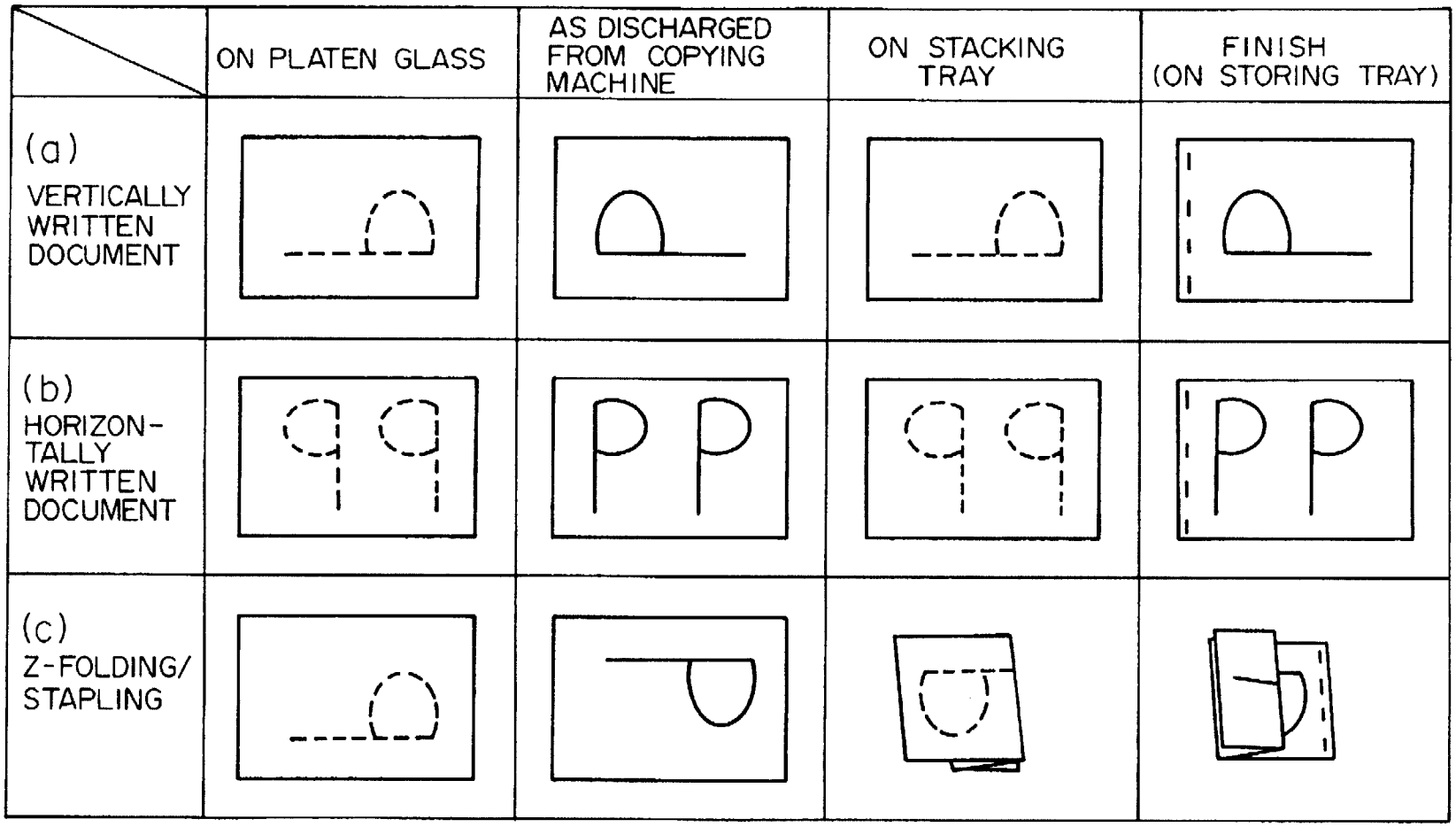
FIG. 104 is an explanatory view showing copies in a series of handling stages and a finished state of the copies.

Sheet sizes and the condition of copy finish in finishing mode are as follows.

Where a small size document is placed on the platen glass, with longer side as leading side relative to the scale 101 (i.e., in such relation that the shorter side of the document is particular to the scale 101), a copy is discharged from the machine 10 in such a condition as is shown in FIG. 103. FIG. 103 also shows the condition in which copies are stacked and aligned on the stacking tray 411, and the condition in which stapled copies are received on the storing tray 475. In this case, the controller of the machine 10 performs image formation on a sheet without image inversion, and also carries out the trailing portion stapling with respect to each set of sheets stacked on the stacking tray 411. (a) in FIG. 103 shows the case of a vertically written document, and (b) in FIG. 103 shows the case of a horizontally written document.

Where a small size document is placed on the platen glass, with shorter side as leading side relative to the scale 101 (i.e., in such relation that the longer side of the document is perpendicular to the scale 101), aspects of respective stages and state of finish are as illustrated (a) in FIG. 104. In the case of a large size document (with shorter side as leading side relative to the scale 101), aspects of respective stages and state of finish are as illustrated (b) in FIG. 104. In these cases of (a) and (b) in FIG. 104, the controller of the machine 10 performs image inversion processing, and carries out stapling the leading portion of each sheet set collected on the stacking tray 411.

In the case of Z-fold finishing, aspects of respective stages and state of finish are as shown (c) in FIG. 104. In this case, image inversion is not carried out and each set of sheets is stapled at a trailing portion.

Figure 105A:
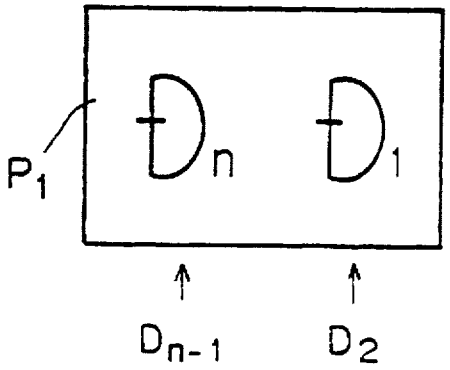
FIGS. 105*a* and 105*b* are explanatory views showing a copy condition in center stapling mode.
Figure 105B:
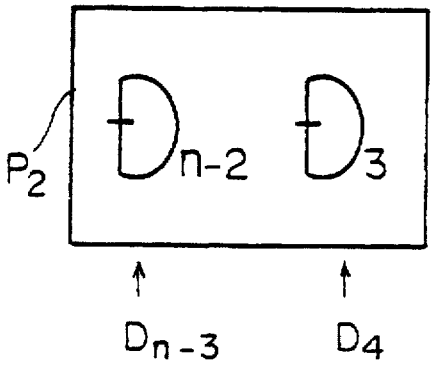

In the case of center stapling mode, assuming that there is n-number of documents, as FIG. 105 shows, images $D_n$, $D_1$ are formed on the front side of the first sheet $P_1$ and images $D_{n-1}$, $D_2$ are formed on the back of the sheet. Subsequently, images are formed in a similar sequence.

Figure 106:
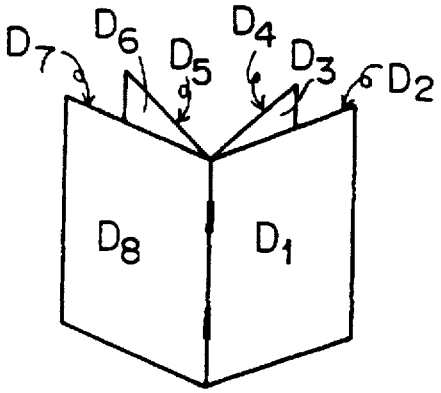
FIG. 106 is a perspective view showing a finished state in center stapling mode.

Image-formed, duplexed copy sheets $P_1$, $P_2$ are subjected to center fold line formation by the folding mechanism 30, then discharged onto the stacking tray 411 and aligned thereon, and are stapled on the fold line (see FIGS. 95 through 100). Assuming that the number of documents is 8, copy sheets are finished in such a state as is shown in FIG. 106.

Figure 107A:
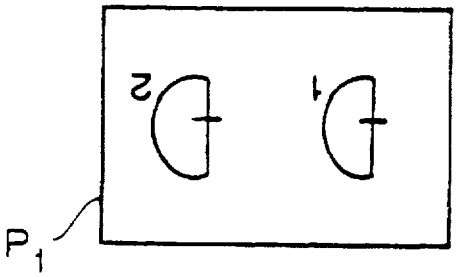
FIGS. 107*a* and 107*b* are explanatory views showing a copy condition in double-edge stapling mode.
Figure 107B:
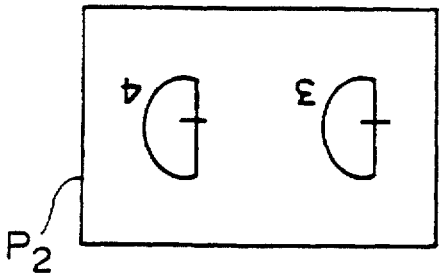
Figure 108:
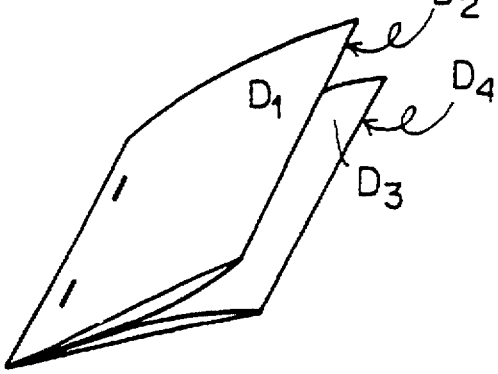
FIG. 108 is a perspective view showing a finished state in double-edge stapling mode.

In the case of double-edge stapling, as FIGS. 107*a* and 107*b* show, images $D_1$, $D_2$ are formed on the first sheet $P_1$, images $D_3$, $D_4$ on the second sheet $P_2$, and similarly two images each are formed on succeeding sheets in the order of pages, which images are presented in upside down condition when the copy sheets are discharged from the machine 10. The sheets $P_1$, $P_2$ are folded in two by the folding mechanism 30 and are discharged onto the stacking tray 411 and aligned thereon, being then stapled at a trailing portion (see FIGS. 77 to 80). Assuming that the number of documents is 4, copy sheets are finished in such a state as is shown in FIG. 108.

(Control Panel)

Figure 109:
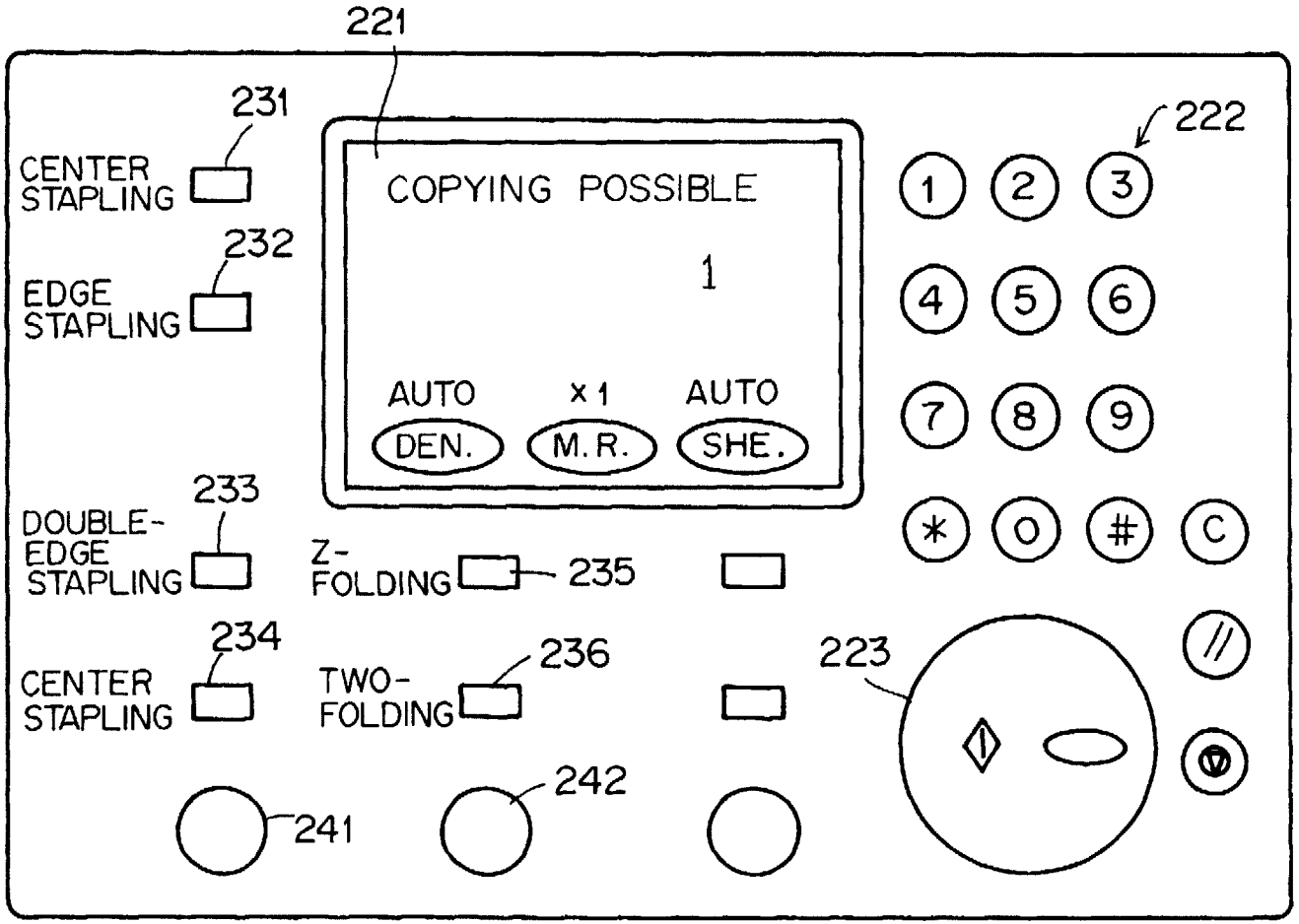
FIG. 109 is a plan view showing a control panel of the copying machine.

FIG. 109 shows a control panel 220 mounted on the machine 10. Disposed on the control panel 220 are liquid crystal touch panel 221, ten key 222, copy start key 223, stapling mode selector key 241, folding mode selector key 242, corner stapling mode indicator 231, side stapling mode indicator 232, double-edge stapling mode indicator 233, center stapling mode indicator 234, Z-folding mode indicator 235, and two-folding mode indicator 236.

Each time the stapling mode selector key 241 is turned on one time, indicators 231–234 light in sequential order, and an applicable selection mode is selected. Each time the folding mode selector key 242 is turned on one time, indicators 235, 236 light sequentially, and an applicable folding mode is selected.

(Control Section)

Figure 110:
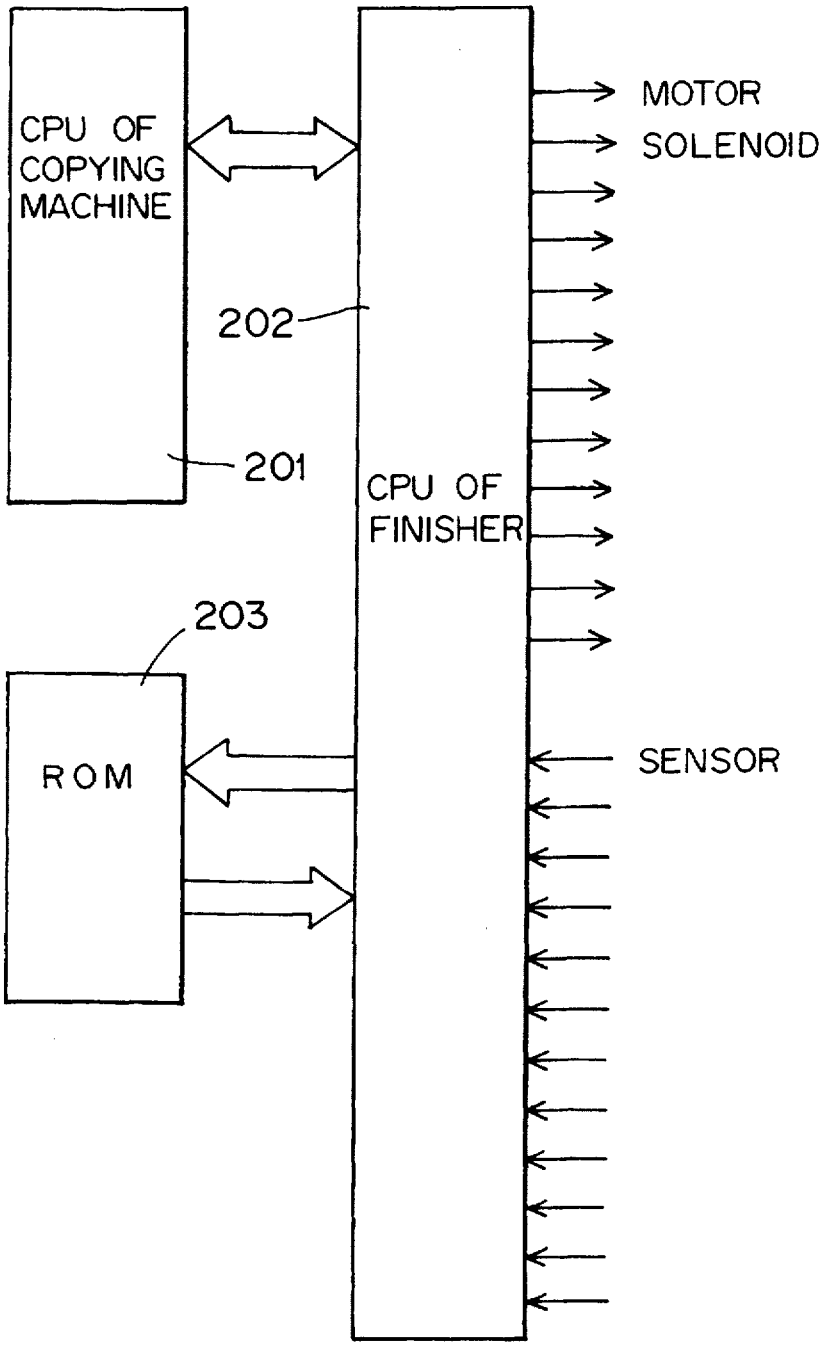
FIG. 110 is a block diagram showing a control section of the copying machine.

FIG. 110 shows the control section of the copying system which comprises, as main units, CPU 201 for controlling the machine 10, and CPU 202 for controlling the finisher 40. The CPU 202 includes ROM 203 having control information stored therein and issues control signals to the loads of various motors, solenoids, etc. The CPU 202 also receives detection signals from detectors, such as sheet detecting sensor.

(Control Procedure)

Figure 111:
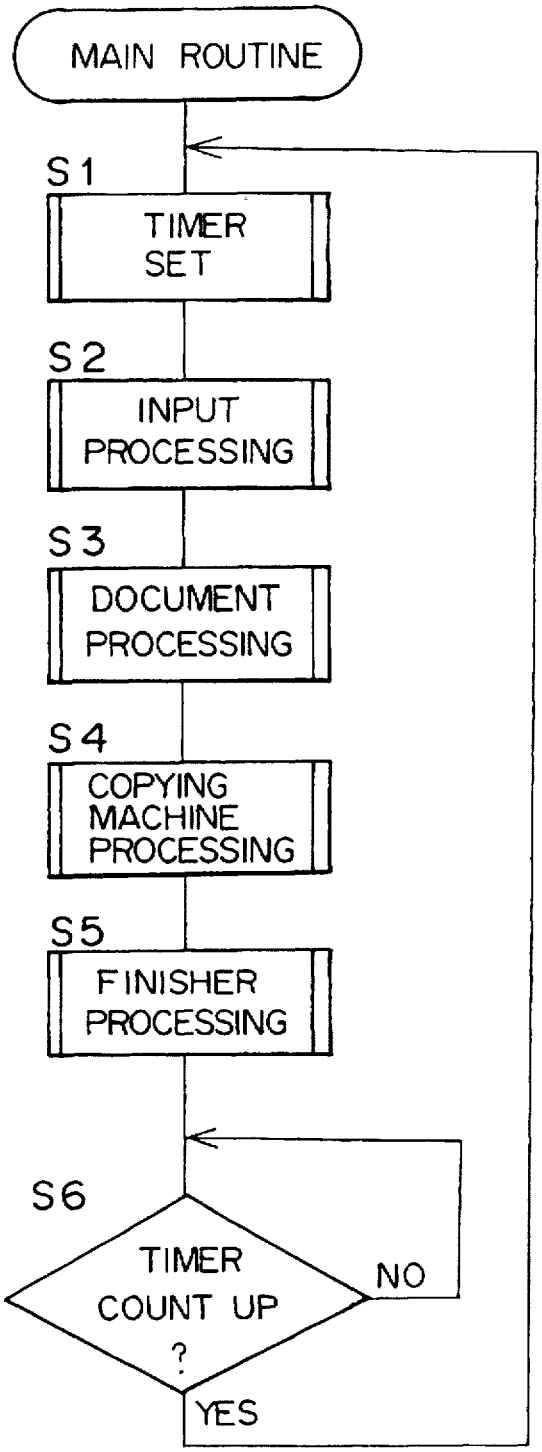
FIG. 111 is a flow chart showing a main routine of control procedure.

FIG. 111 shows a main routine of the copying system. At step S1, internal timer is set, and at step S2 an appropriate processing mode is determined on the basis of information input from the control panel 220.

Next, at step S3, the ADF 20 is operated to run documents one round thereby to count the number of documents and, at the same time, decision is made whether or not staple processing is possible in relation to processing mode. Next, at step S4, the copying machine 10 is operated to carry out copying; and at step S5, the finisher 40 is operated to process sheets in a predetermined mode. At step S6, when count up of the internal timer is verified, the controller returns to step S1.

Figure 112:
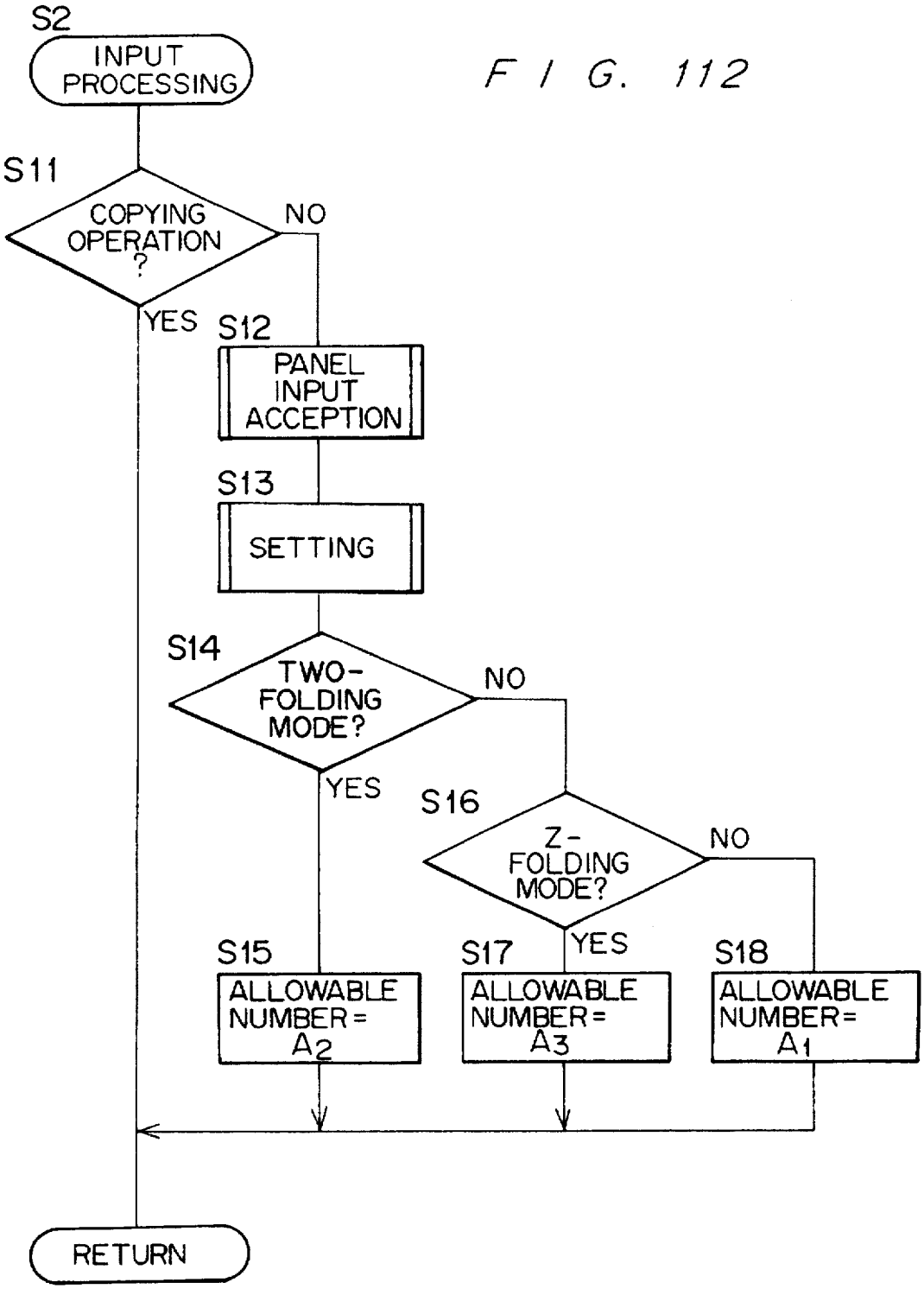
FIG. 112 is a flow chart showing a sub-routine for input processing.

FIG. 112 shows a sub-routine for the input processing as indicated in step S2. In this sub-routine, at step S1, it is ascertained that the machine 10 is not in copying operation; at step S12, an input from the control panel 220 is accepted; and at step S13, processing mode is set in various ways on the basis of information from the control panel 220. Next, at step 14, whether the two-folding mode has been selected or not is judged. If already selected, at step S15, staple allowable number of sheets is set at $A_2$ (for example, 30). If the two-folding mode has not been selected, at step S16, whether the Z-folding mode has been selected or not is judged. If the Z-folding mode has been selected, at step S17, staple allowable number of sheets is set at $A_3$ (for example, 20). If none of aforesaid modes have been selected, that is, no folding is being carried out, at step S18, staple allowable number of sheets is set at $A_1$ (for example, 60).

As described above, in the present embodiment, the staple allowable number of sheets is varied according to the type of sheet folding mode. In view of the fact that in the case of the two-folding mode, the thickness of a sheet set is about two times that in the case where no folding mode is required, and in the case of the Z-folding mode, about 2.5 times, the staple allowable number of sheets is decreased accordingly when sheet folding mode is selected.

In particular, where folded sheets and non-folded sheets are present in mixture, the staple allowable number of sheets is set at $A_2$ or $A_3$. For example, in case where documents include A3T size sheets and A4Y size sheets in mixture, if the Z-folding/stapling mode is selected, the Z-folding processing is carried out with respect to A3T size copy sheets, but A4Y size sheets are discharged as they are onto the stacking tray 411, without sheet fold processing being carried out with respect to such copy sheet. In such a case, if at least one Z-folding copy sheet is present in the sheet set, staple allowable number of sheets is set at $A_3$ for the Z-folding mode. Likewise, in case where documents include both A3T size and A4Y size sheets and where the two-folding/stapling mode is selected, staple allowable number of sheets is set at $A_2$.

When an operator, without using the ADF 20, manually sets a document on the platen glass to carry out copying, there may be a case such that stapling mode is previously selected, but the two-folding mode or the Z-folding mode is selected with respect to one large-size document. In such a case, the mode input is accepted at step S12, and accordingly, at step S15 or S17, the staple allowable number of sheets is set to a corresponding allowable number $A_2$ or $A_3$.

Figure 113:
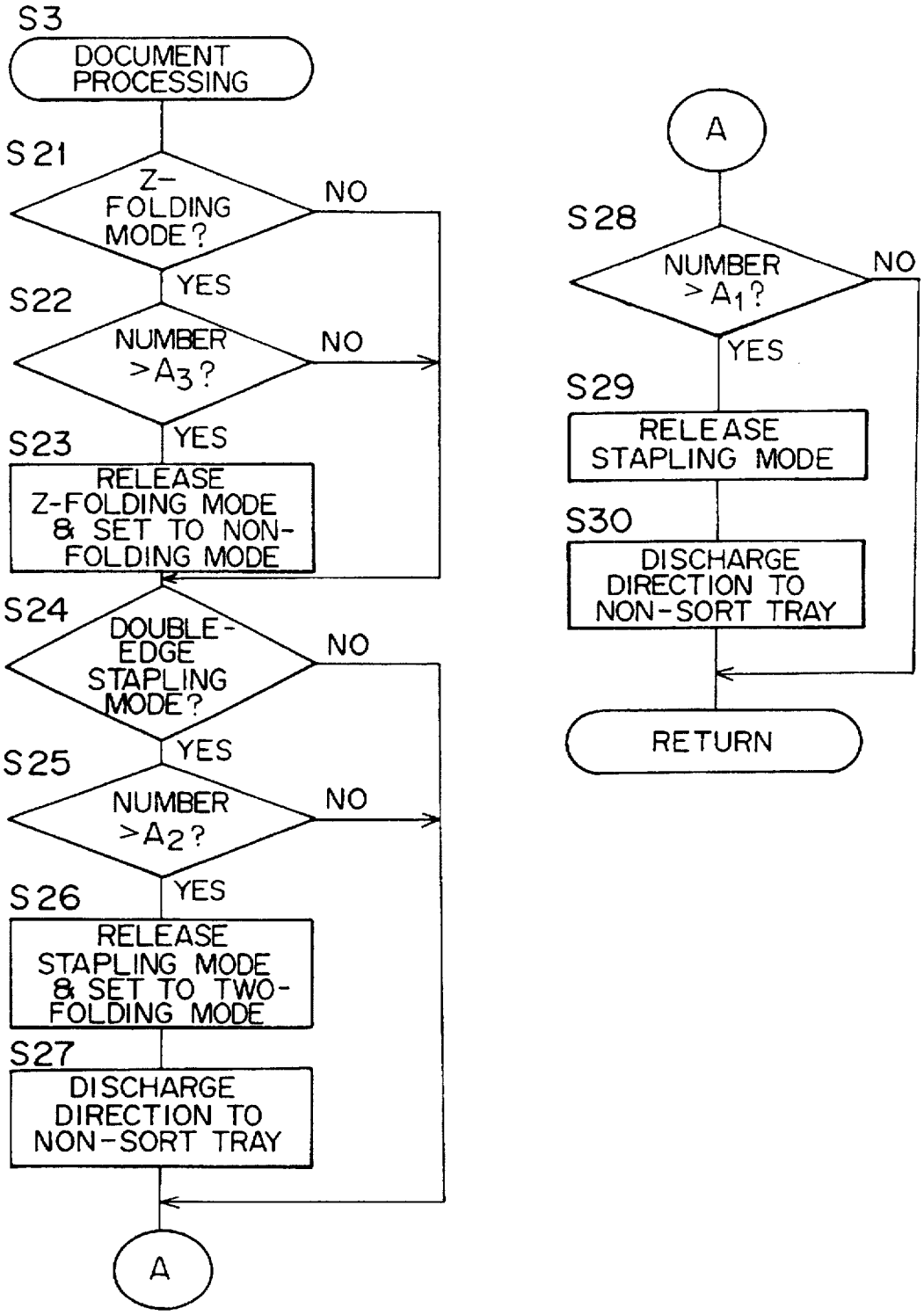
FIG. 113 is a flow chart showing a sub-routine for document processing.

FIG. 113 shows a sub-routine for the document processing as indicated at step S3 of the main routine. It is assumed here that the ADF 20 has been operated to count the number of documents. Alternatively, the number of documents is previously input on the control panel 220.

When the controller gets information on the number of documents, at step S21, it judges whether the Z-folding mode has been selected or not. If yes, at step S22, whether the number of documents exceeds allowable number $A_3$ or not. If the number>$A_3$, at step S23, the Z-folding mode is released and the non-folding mode is set as such.

At step S24, judgment is made as to whether or not the double-edge stapling mode has been selected; and if yes, at step S25, judgment is made whether the number of documents exceeds the allowable number $A_2$ or not. If number>$A_2$, at step S26, the stapling mode is released and the two-folding mode is set as such. At step S27, direction is given to discharge sheets onto the non-sort tray 401.

At step S28, judgment is made as to whether the number of documents exceed allowable number $A_1$, and if number>$A_1$, at step S29, the stapling mode is released. At step S30, direction is given to discharge the sheets onto the non-sort tray 401.

Figure 114:
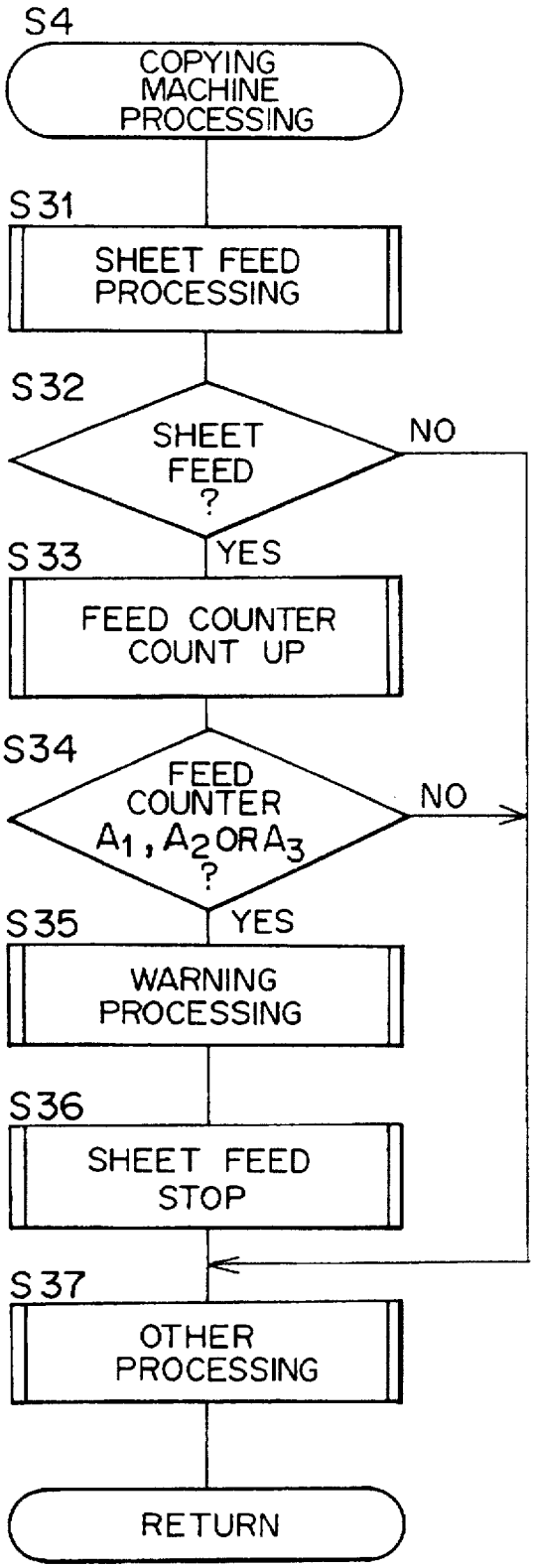
FIG. 114 is a flow chart showing a sub-routine for copying machine processing.

FIG. 114 shows a sub-routine for the copying machine processing as indicated at step S4 of the main routine. First, at step S31, sheets stored in the sheet feed section of the machine 10 are fed to image transfer section, one sheet at a time. Next, if, at step S32, it is ascertained that sheet feed has been made, at step S33, a feed counter within the controller is counted up.

Next, at step 34, judgment is made whether the count of the feed counter has exceeded the currently set allowable number $A_1$, $A_2$, or $A_3$. If yes, at step S35, warning is given, and at step S36, subsequent sheet feed is inhibited. Processing at the foregoing steps S34, S35, S36 is executed when document is manually set on the platen glass without using the ADF 20. However, in the copying system which is not equipped with the ADF 20, processing is carried out in these steps to cope with any excess in the number of sheets in the stapling mode.

Further, at step S37, other processing required for copying is carried out within the machine 10.

Figure 115:
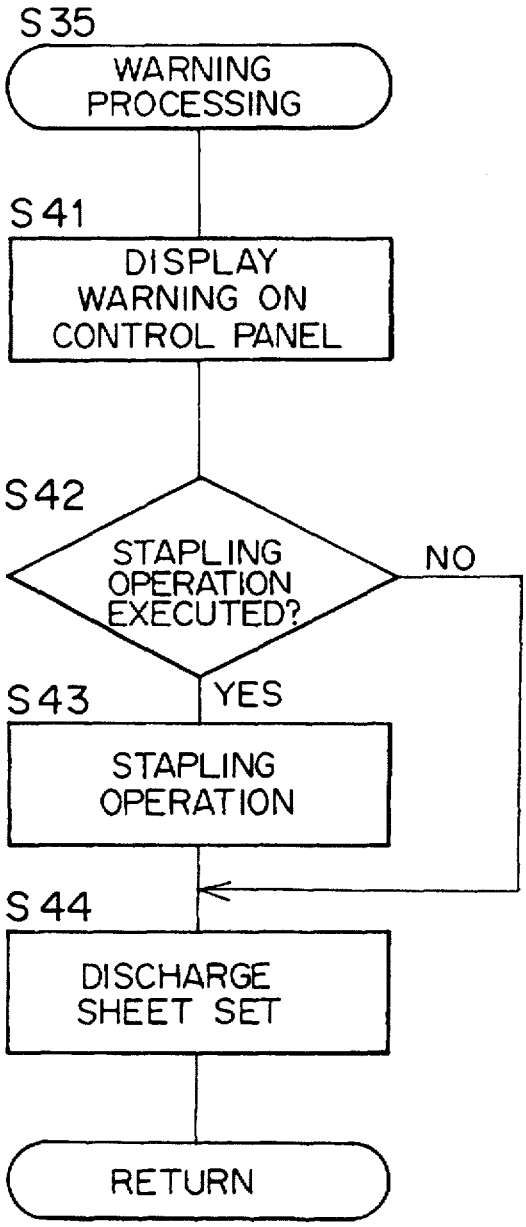
FIG. 115 is a flow chart showing a sub-routine for warning processing.

FIG. 115 shows a sub-routine for the warning processing as indicated at step S35. First, at step S41, a display is given on the control panel 220 to indicate that the number of sheets fed has exceeded the staple allowable number. Next, at step S42, judgment is made whether stapling operation be executed with respect to presently stored sheets on the stacking tray 411. If yes, at step S43, stapling operation is carried out, and at step S44 a sheet set is discharged onto the storing tray 475.

(Other Process of Forming Fold Line)

In the sheet folding mechanism 30, processing such that a sheet is once folded in two and then unfolded to form a fold line on the center portion of the sheet is carried out in such a way that, as shown in FIGS. 10, 11, and 12, the sheet, threaded between the folding rollers 351, 352 driven forward, is brought back into the transport path 49 through reverse rotation of the rollers. In addition to such manner of processing, the process of unfolding the sheet may be carried out by employing the transport roller pair 341 disposed on the third transport path 33.

Figure 116:
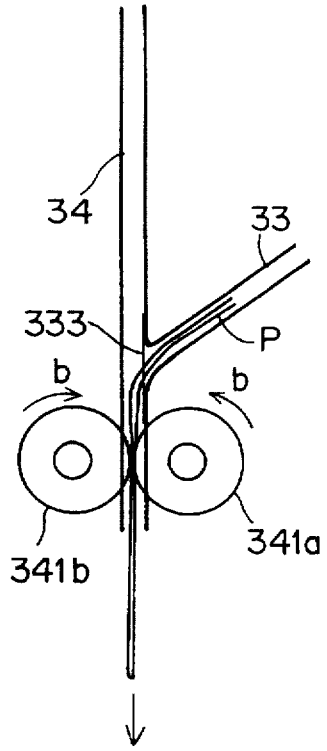
FIGS. 116 to 118 are explanatory views showing another manner of scoring by the sheet folding mechanism.
Figure 117:
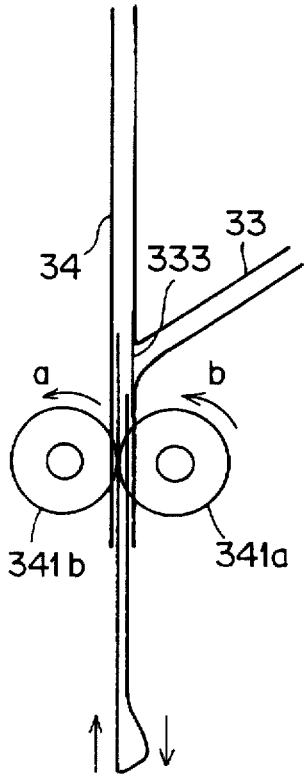
Figure 118:
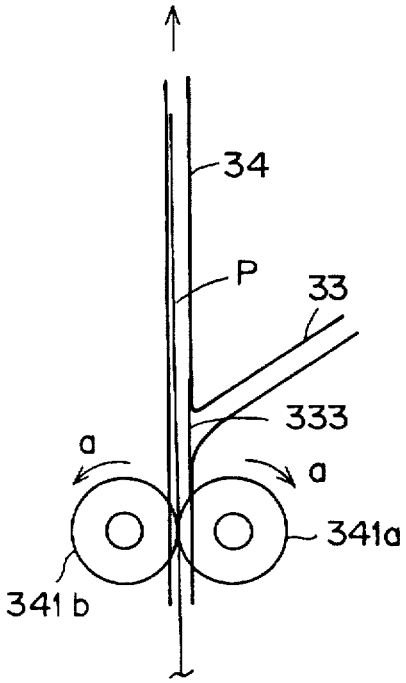

For this purpose, as FIGS. 116, 117, and 118 show, it is arranged that the roller 341*a*, 341*b* are capable of forward/reverse rotation in the directions of arrow a and arrow b independently of each other respectively. Sheet P is folded in two at the sheet folding station 35, and is then transported from the third transport path 33 into the nip between the rollers 341*a* and 341*b*, with the fold positioned leading side (see FIG. 116). In this case, the rollers 341*a*, 341*b* are rotated in the direction of arrow b, the sheet P being thus transported downward along the fourth transport path 34.

When the trailing edge of the sheet P clears the resin sheet 333, the roller 341*a* is allowed to continue rotation in the direction of arrow b, and the roller 341*b* is switched to rotate in the direction of arrow a. Thus, the right half portion of the sheet P is transported downward by the roller 341*a* and the left half portion is transported upward by roller 341*b* (see FIG. 117). When the right side portion clears the nip between the rollers 341*a* and 341*b*, the roller 341*a* is switched into rotation in the direction of arrow a (see FIG. 118). Through the rotation of the rollers 341*a*, 341*b* in the direction of arrow a, the sheet P, with a fold line centrally formed thereof, is transported upward along the fourth transport path 34.

With respect to the roller 341*a*, it is arranged that the roller 341*a* is switchable between powered rotation and free rotation, only in the direction of arrow b. Further, as FIG. 118 shows, when the roller 341*a* is switched for rotation in the direction of arrow a, its rotation may be switched to free rotation. In this case, the roller 341*a* rotates following the rotation of the roller 341*b* in the direction of arrow a.

(Modification of Sheet Folding Mechanism)

Figure 119:
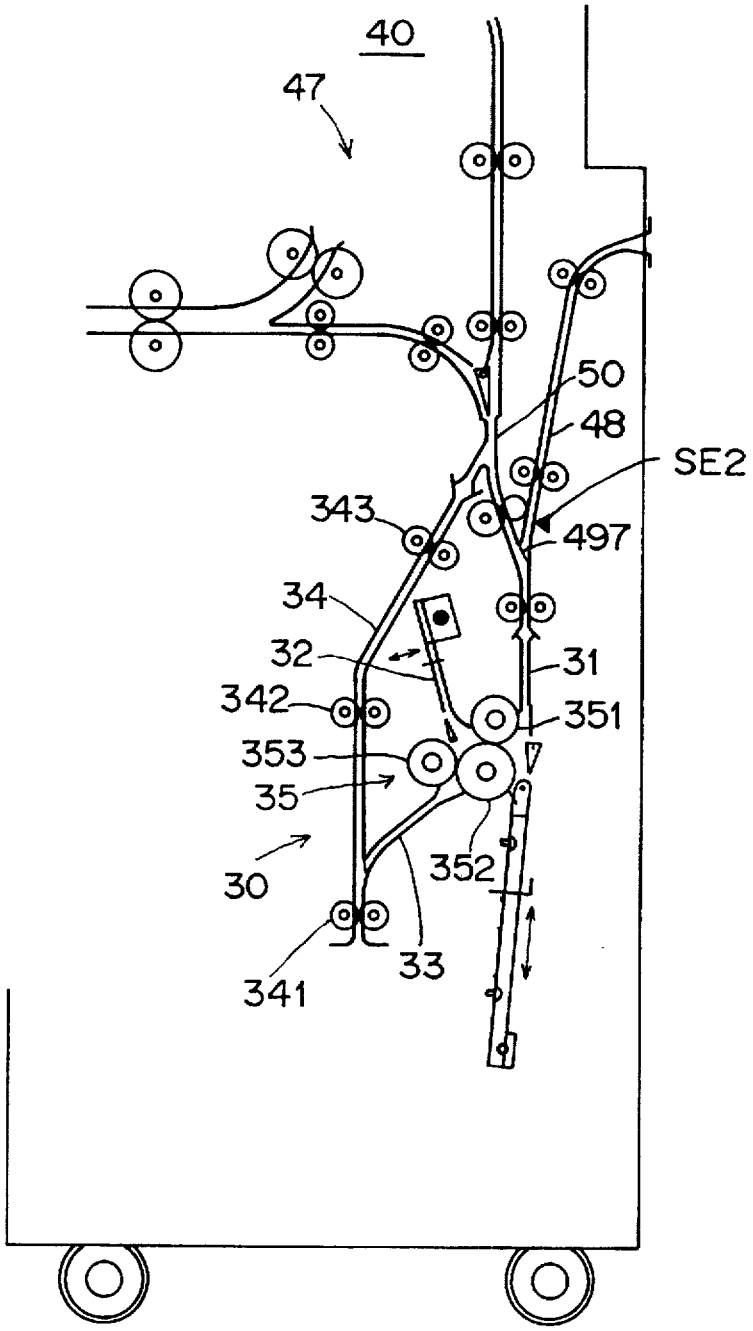
FIG. 119 is an elevational view showing a modification of the sheet folding mechanism.

In order to make the sheet folding mechanism 30 more compact in construction, as FIG. 119 shows, it may be arranged that the first transport path 31 is made shorter in length and the fourth transport path 34 is inclined.

With such arrangement, however, the problem is that the distance between the rollers 351 and 352 is reduced, with the result that when fold line forming is carried out in manner as shown in FIGS. 10, 11, 12, a trailing portion of a large-size sheet many not positively clear the resin sheet 497 so that when switched back the sheet may be sent back into the transport path 48 instead of being guided into the transport path 50.

In order to avoid such trouble, the folding rollers 351, 352 are rotated forward to control the quantity of bite between the rollers with respect to a center portion of a sheet so as to increase the quantity of such bite, if the sheet is of a large size. That is, in the case of a large size sheet, the quantity of bite a as shown in FIG. 13 should be increased, whereby it is possible to allow the trailing edge of the sheet to accurately clear the resin sheet 497, even if the first transport path 31 is short.

For example, when the sensor SE2 detected the trailing edge of the sheet, timer is caused to start, and the position of trailing edge of the sheet being transported is judged from the count of the timer. After the trailing edge of the sheet has cleared the resin sheet 497, the folding rollers 351, 352 are rotated reverse to switch back the sheet.

A leading edge of a sheet folded in two may be fed into the second transport path 32 or may be fed from the folding roller 353 to the third transport path 33.

(First Modification of Stapling Unit)

Figure 120:
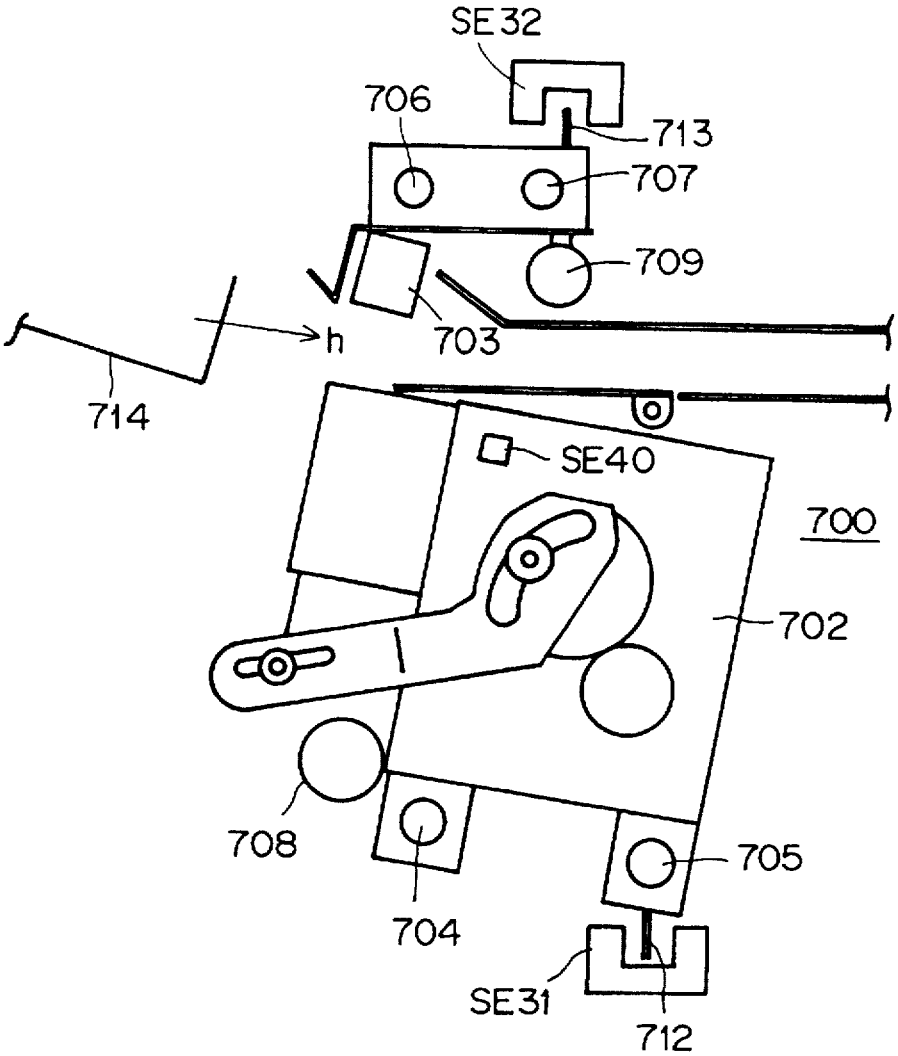
FIG. 120 is a front view showing a first modification of the stapling unit.
Figure 121:
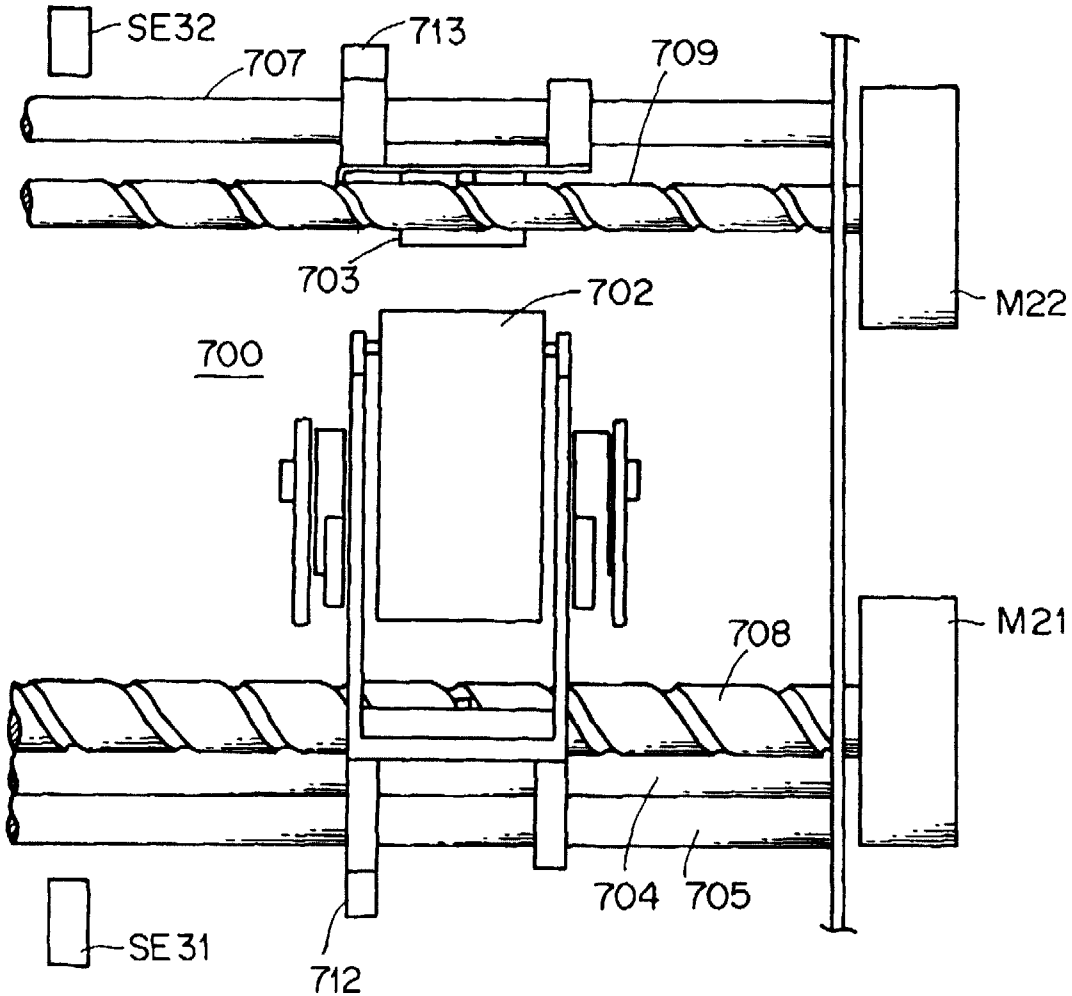
FIG. 121 is a side view thereof.

FIGS. 120 and 121 show a stapling unit 700 of another form. This stapling unit 700 comprises a staple head 702 for driving staples and a staple anvil 703 for receiving and bending driven staples, the staple head 702 and the staple anvil 703 being independently movably disposed. The staple head 702 is slidably mounted on two guide shafts 704, 705 and is movable in a direction perpendicular to the direction of sheet transport h in conjunction with the forward/reverse run of a spiral shaft 708 driven by a stepping motor M21. The staple anvil 703 is slidably mounted on two guide shafts 706, 707 and is movable in a direction perpendicular to the direction of sheet transport h in conjunction with the forward/reverse run of a spiral shaft 709 driven by a stepping motor M22.

The staple head 702 and the staple anvil 703 have light shield plates 712 and 713 fixed respectively thereto such that positions at which the shield plates 712 and 713 are detected by light transmission type sensors SE31, SE32 are respective home positions of the staple head 702 and the staple anvil 703. The stepping motors M21, M22 are controllable by the number of driving pulses with respect to their number of revolutions, and the staple head 702 and the staple anvil 703 can be stopped at any desired position independently of their home positions.

The staple head 702 incorporates a staple cartridge not shown and has a sensor SE 40 for detecting that the cartridge is empty.

Next, the manner of the stapling operation by the stapling unit 700 will be explained. When a set of sheets is stored in the stacking tray 714, the set of sheets is transported by a transport device not shown from the tray 714 in a direction of arrow h. The transport device can transport the sheet set to and stop at any desired location relative to the stapling unit 700. When the sheet set stops at a predetermined point, the staple head 702 and the staple anvil 703 are caused to move from their home positions to stapling points by driving the stepping motors M21, M22. When the staple head 702 and the staple anvil 703 stop at a predetermined stapling point, the staple head 702 begins operation to drive staples onto the sheet set. Where there are plural stapling points, the staple head 702 and the staple anvil 703 move sequentially to the stapling points while performing stapling operation in the mean time.

(Second Modification of Stapling Unit)

Figure 122:
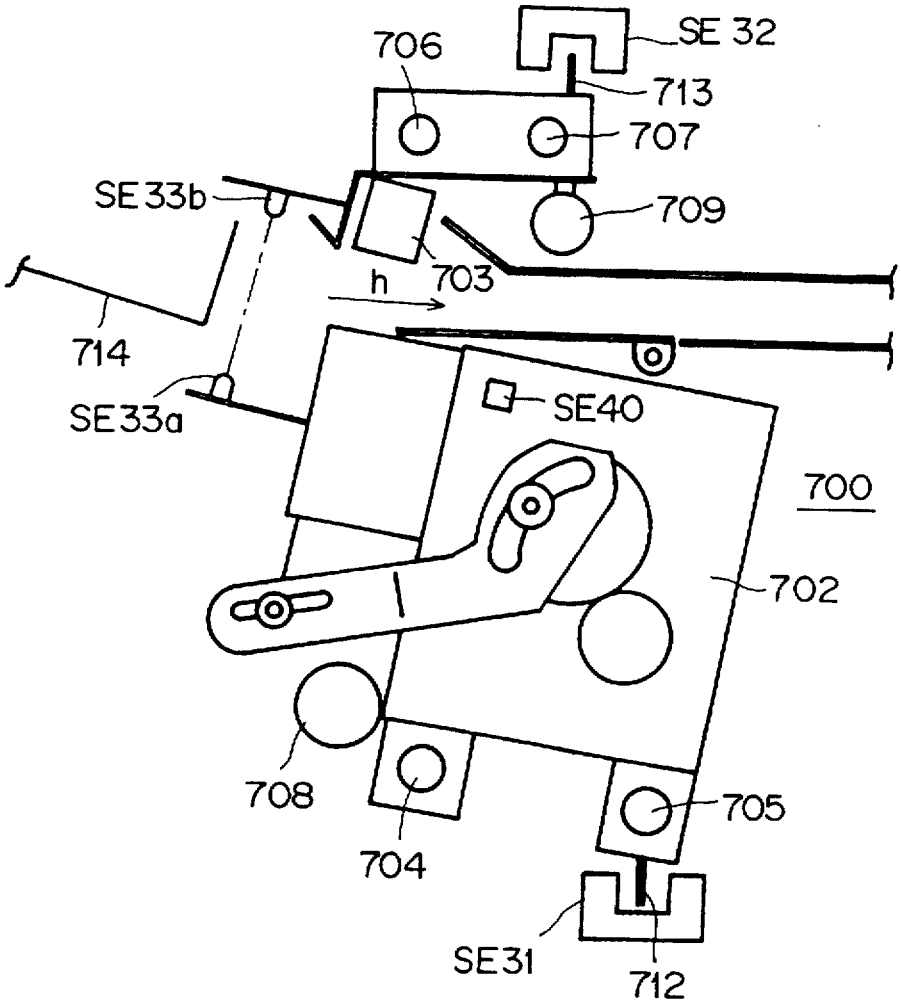
FIG. 122 is a front view showing a second modification of the stapling unit.
Figure 123:
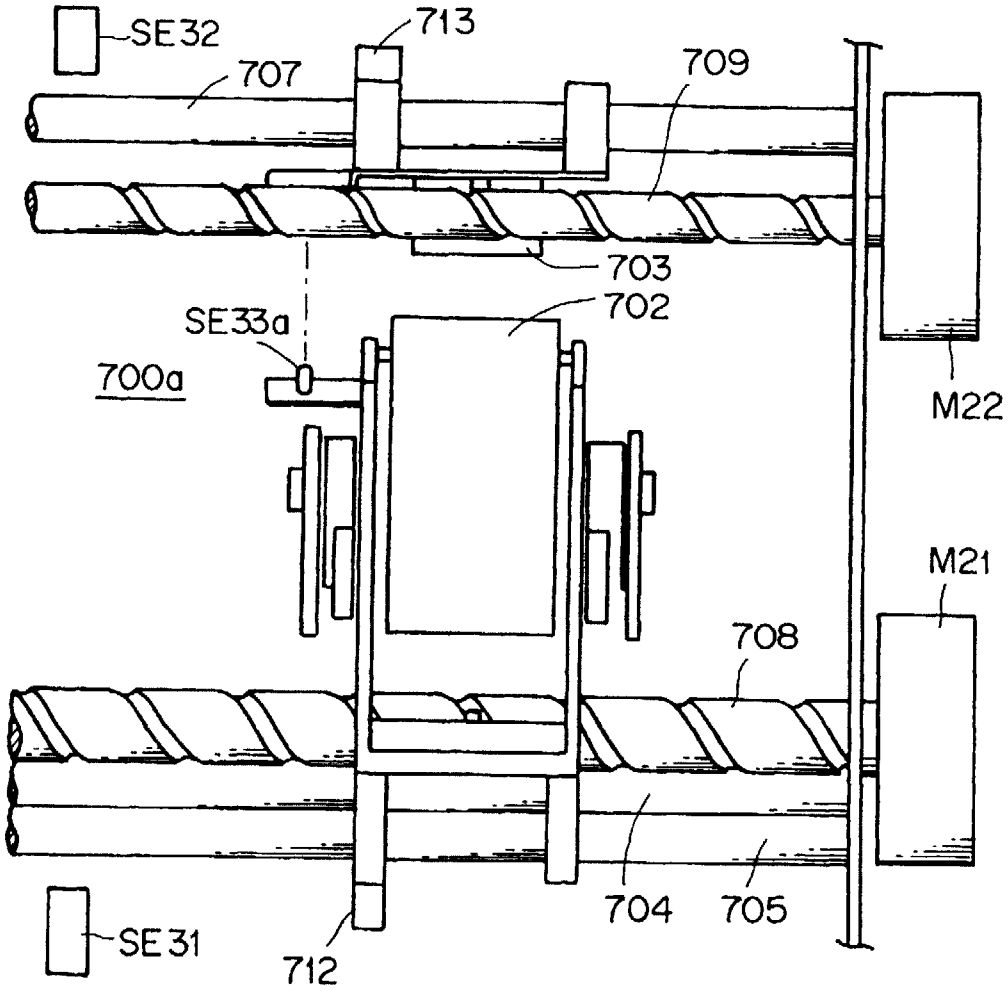
FIG. 123 is a side view thereof.

FIGS. 122 and 123 illustrate a stapling unit 700*a* similar in construction to above described stapling unit 700. In order to ensure accurate alignment of the staple head 702 and the staple anvil 703 at stapling points, the stapling unit 700*a* is provided with a light-transmission type photosensor. It is to be noted that in FIGS. 122, 123, parts identical with those in FIGS. 120, 121 are designated by like reference numerals.

The staple head 702 is fitted with a light emitter element SE33*a*, and the staple anvil 703 is fitted with a light receptor element SE33*b*. The stapling unit 700*a* is specially designed to carry out stapling with respect to a trailing portion of a sheet set. For a stapling operation, a sheet set is transported from the tray 714 in such a way that the trailing portion of the sheet set stops at a position past the optical axis of the elements SE33*a*, SE33*b* in the direction of transport h. The stapling operation is carried out in such a sequence that through actuation of the stepping motor M21. The staple head 702 first moves to the predetermined stapling point and stops thereat, then the staple anvil 703 moves. The staple anvil 703 is caused to stop at a point at which the light receptor element SE33*b* receives light from the light emitter element SE33*a*. In this way, accurate alignment in point is carried out of the staple head 702 and the staple anvil 703.

The sequence of movement may be made in an opposite way, that is, the staple anvil 703 may move first. It is also possible that the light emitter element SE33*a* is attached to the staple anvil 703 and the light receptor element SE33*b* is attached to the staple head 702.

(Third Modification of Stapling Unit)

Figure 124:
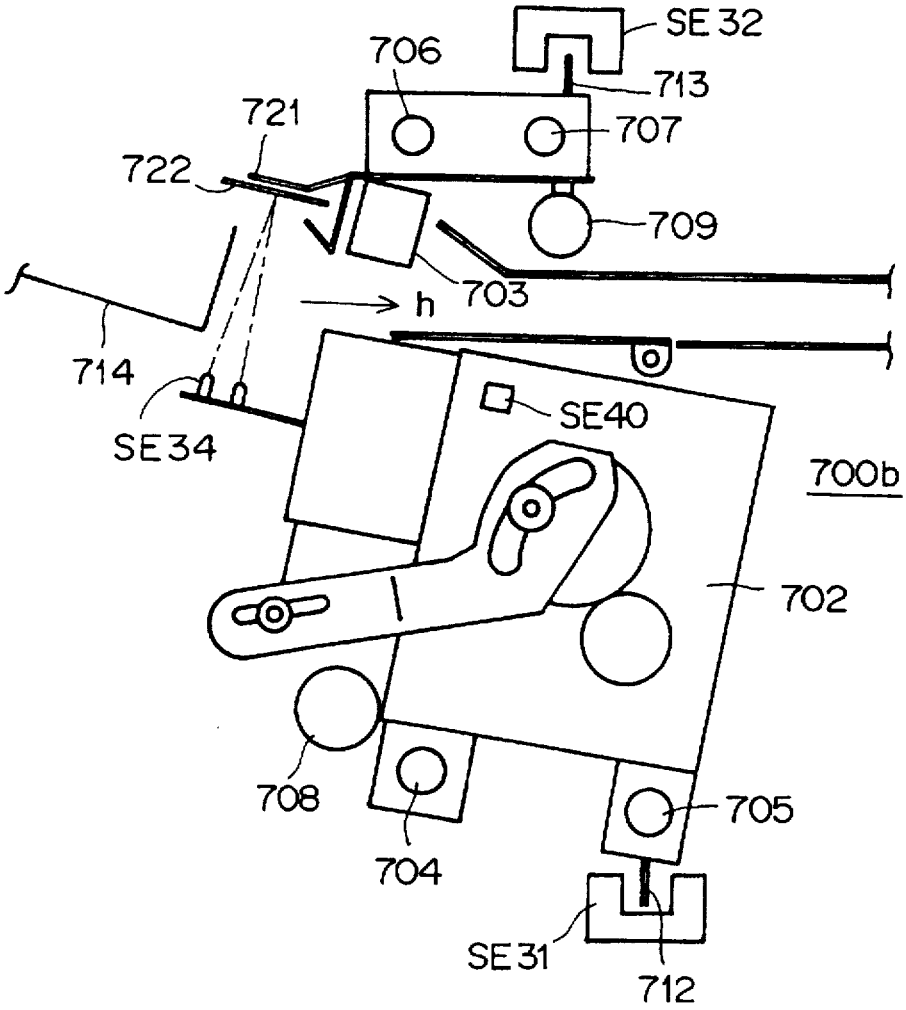
FIG. 124 is a front view showing a third modification of the stapling unit.
Figure 125:
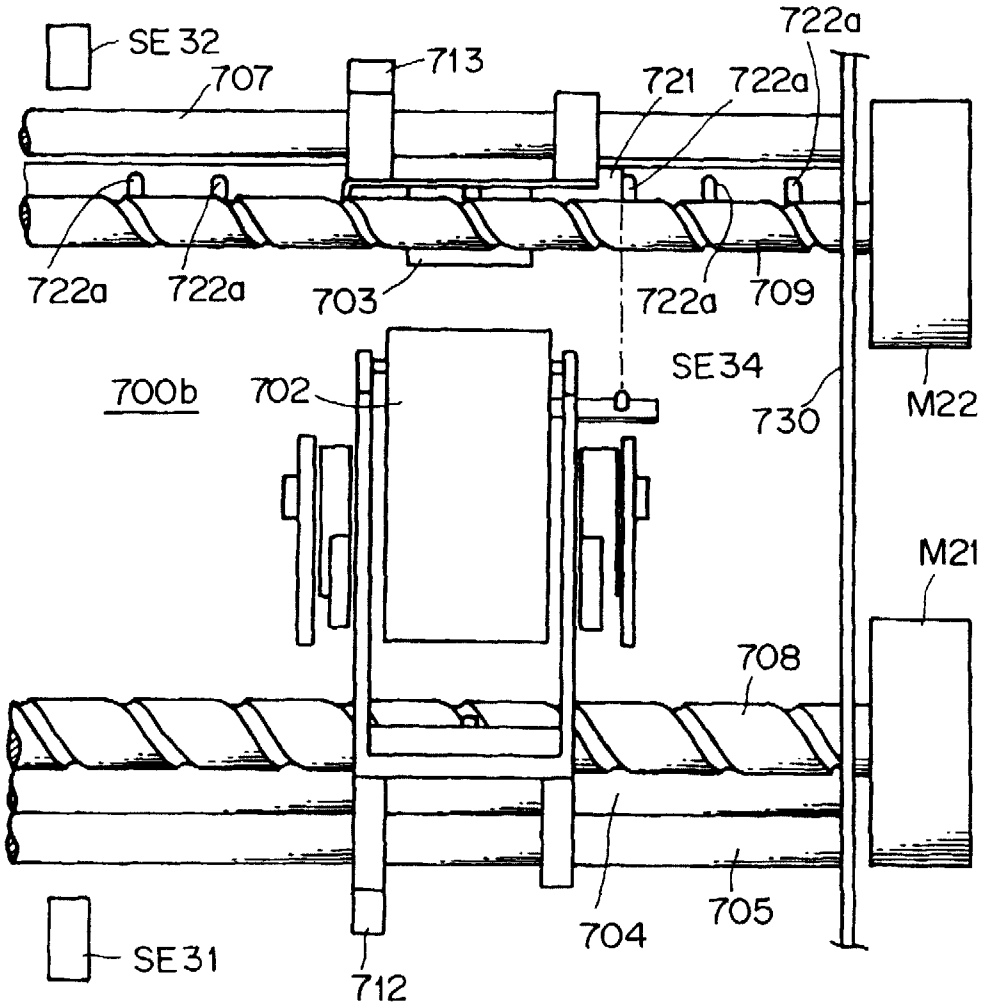
FIG. 125 is a side view thereof.

FIGS. 124 and 125 show a stapling unit 700*b* similar in construction to above described stapling unit 700. In order to ensure accurate alignment of the staple head 702 and the staple anvil 703 at stapling points, the stapling unit 700*b* is provided with a light-reflection type photosensor. It is to be noted that in FIGS. 124, 125, parts identical with those in FIGS. 120, 121 are designated by like reference numerals.

The staple head 702 is fitted with a light reflection type photosensor SE34, and the staple anvil 703 is fitted with a reflector plate 721. Immediately below the reflector plate 721 there is positioned another reflector plate 722 fixed to a frame 730. The reflector plate 722 is formed with a plurality of openings 722*a* in corresponding relation to predetermined stapling positions.

This stapling unit 700*b*, as is the case with above described stapling unit 700*a*, is specially designed to carry out stapling with respect to a tailing portion of a sheet set. For a stapling operation, a sheet set is transported from the tray 714 in such a way that the trailing portion of the sheet set stops at a position past the optical axis of the photosensor SE34 in the direction of transport h. In the stapling operation, the staple head 702 first moves to a predetermined stapling point and stops thereat. In the present instance, when light emitted from the photosensor 34 enters an opening 722*a* so that the light is no longer reflected, that is, the sensor 34 goes into off condition, movement of the staple head 702 is stopped. The sensor SE34 goes into off condition each time when it passes opening 722*a*. Therefore, by counting the number of times sensor SE34 is turned off it is possible to judge whether the staple head 702 is at a predetermined stapling point or not.

Next, the staple anvil 703 is moved. The reflector plate 721 moves in conjunction with the staple anvil 703. Upon reaching a location above opening 722*a*, the reflector plate 721 reflects the light from the sensor SE34 through the opening 722*a*. Then, the sensor SE34 turns on to stop movement of the staple anvil 703*a*. Needless to say, the staple head 702 and the staple anvil 703 are so set as to face toward each other at the moment when the reflector plate 721 causes the sensor SE34 to turn on.

The sensor SE34 may be attached to the staple anvil 703, and the reflector plate 721 is attached to the staple head 702. In this case, the staple anvil 703 is moved first.

(Sheet Set Transport after Stapling)

In various stapling modes shown in FIGS. 34 through 38, where the stapling unit 441 carries out staple driving at its home position H, even if the sheet set is transported at high speed immediately after the end of the stapling operation, there is no possibility of interference by the connector 445 with respect to the sheet set, because the connector 445 has been shunted out of the track of sheet set transport. However, in other stapling modes, there come up as problems the relationship between the timing for shunting of the stapling unit 441 from the stapling points $R_0$, $R_n$ and its speed of movement, and that between the timing for start of sheet set transport and the speed of sheet set transport. In order to carry out stapling operations in efficient sequence, it is desirable to transport the sheet set promptly after the end of final staple driving at high speed, but if the timing is too early, there may be possibilities of the connector 445 interfering with the sheet set.

Figure 126:
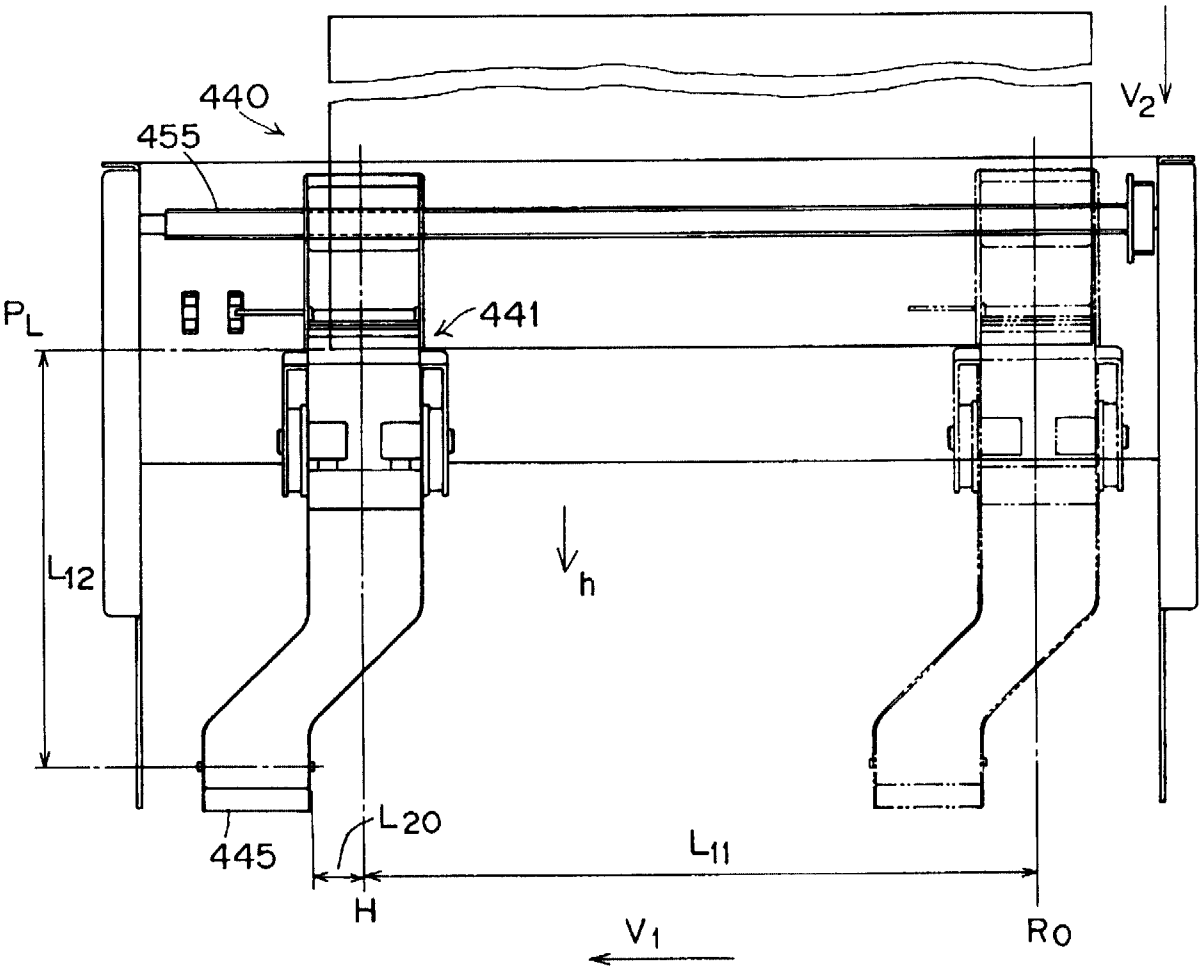
FIG. 126 is an explanatory view showing the process of leading portion stapling.

Therefore, let's consider conditions that will permit efficient transport of the sheet set. Shown in Table 1, by stapling mode and by sheet size, are sheet set positions during stapling operation, positions of stapling unit 441, and transport speeds involving no possible interference caused to the sheet set. As shown in FIG. 126, it is noted that the transport distance $L_5$ is 235 mm; and the distance $L_{20}$ from center of stapling point to the connector 445 is 20 mm. The speed of the stapling unit 441 movement is 250 mm/s.

TABLE 1

| Sheet size | Stapling mode | Distance to stapling unit shunt position (mm) | Distance from leading edge of sheet set to connector (mm) | Sheet set transport speed (mm/s) |
|---|---|---|---|---|
| A4Y | Corner stapling | 0(0) | 32(0.107) | 300 |
| | Trailing portion stapling | 64.7(0.259) | 32(0.4) | 80 |
| A4T | Corner stapling | 184.5(0.738) | 228(0.76) | 300 |
| | Leading portion stapling | 30(0.12) | 228(0.76) | 300 |
| | Center stapling | 30(0.12) | 86.5(0.288) | 300 |
| A3T | Corner stapling | 265.5(1.062) | 228(1.14) | 200 |
| | Leading portion stapling | 73.5(0.294) | 228(0.7) | 300 |
| | Center stapling | 64.7(0.259) | 25(0.313) | 80 |

Shown in parentheses: travel time(s).

Table 2 shows stapling points with respect to sheets in the various stapling modes.

TABLE 2

| Stapling mode | In sheet transport direction | In sheet widthwise direction |
|---|---|---|
| Corner stapling | 7 mm from sheet edge | 11.5 mm from sheet edge |
| Leading/ Trailing portion stapling | 7 mm from sheet edge | 110 mm spacing in right-and-left symmetry across center |

TABLE 2-continued

| Stapling mode | In sheet transport direction | In sheet widthwise direction |
|---|---|---|
| Center stapling | Center | 110 mm spacing in right-and-left symmetry across center |

Under these conditions and assuming that the start of shunting of the stapling unit 441 from final staple driving to the home position H is simultaneous with the start of sheet set transport, the speed of sheet transport is set so that the stapling unit 444 will be shunted out of the track of sheet set transport (to the home position H) before the leading edge of the sheet set reaches the connector 445. If there is some time allowance for the shunting of the stapling unit 441, the transport speed is set faster, and if there is no such allowance, the transport speed is set slower.

Specifically, the speed of sheet set transport before the shunting of the stapling unit 441 to its home position H is set as shown under the rightmost column in Table 1. Transport speed is classified into 80 mm/s, 200 mm/s, and 300 mm/s. Depending upon conditions, transport speed is classified as shown in Table 3.

TABLE 3

| No. | Distance to stapling unit shunt position | Distance form leading edge of sheet set to connector | Sheet set transport speed |
|---|---|---|---|
| 1 | 100 mm or less | 50 mm or less | 80 mm/s |
| 2 | 200 mm or more | 200 mm or more | 200 mm/s |
| 3 | Others | | 300 mm/s |

After the stapling unit 441 has been shunted to its home position H, in the case of Nos. 1 and 2 in Table 3, the speed of sheet set transport is increased to 300 mm/s. In the case of No. 3, the same speed is maintained.

(Other Sheet Set Transport Control)

Besides above described manner of control after stapling operation, transport may be controlled in the following way.

In all stapling modes, the speed of sheet set control after stapling operation is uniformly controlled to even speed, for example, 300 mm/s. In this case, the No. 3 case in Table 3 involves no problem. In No. 1 and No. 2 cases, this transport speed is too fast and the connector 445 may interfere with the sheet set, in which case only the start of sheet set transport should be delayed. Specifically, sheet set transport may be started at the time when the stapling unit 441 has been shunted to its home position H.

Figure 127:
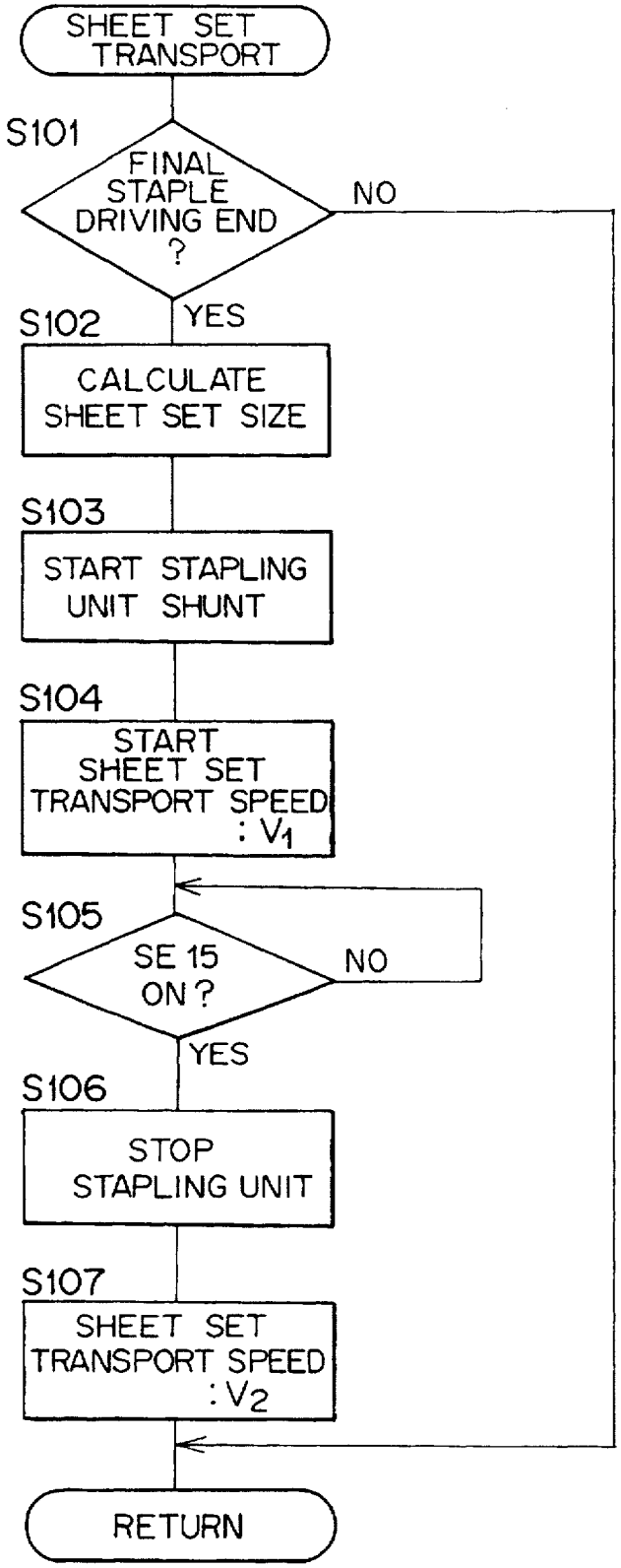
FIG. 127 is a flow chart showing a first example of control procedure for transport of a set of sheets after the set of sheets having been stapled.

FIG. 127 shows a first example of the control sequence for the transport of sheet set after stapling operation.

First, at step S101, the end of final staple driving is verified. Then, at step S102, the size of sheet set is calculated, and at step S103, the shunting of the stapling unit 441 to its home position H is started. In this case, the transport speed $V_1$ to be set is the corresponding value given under the rightmost column in Table 1, as previously set optimally according to the size of sheet set and the stapling mode.

Next, at step S105, it is verified that the sensor SE15 is on, i.e., that the stapling unit 441 has been shunted to its home position H. Then, at step S106, the stapling unit 441 is stopped, and at step S107, the speed of sheet set transport is increased to $V_2$ (300 mm/s).

Figure 128:
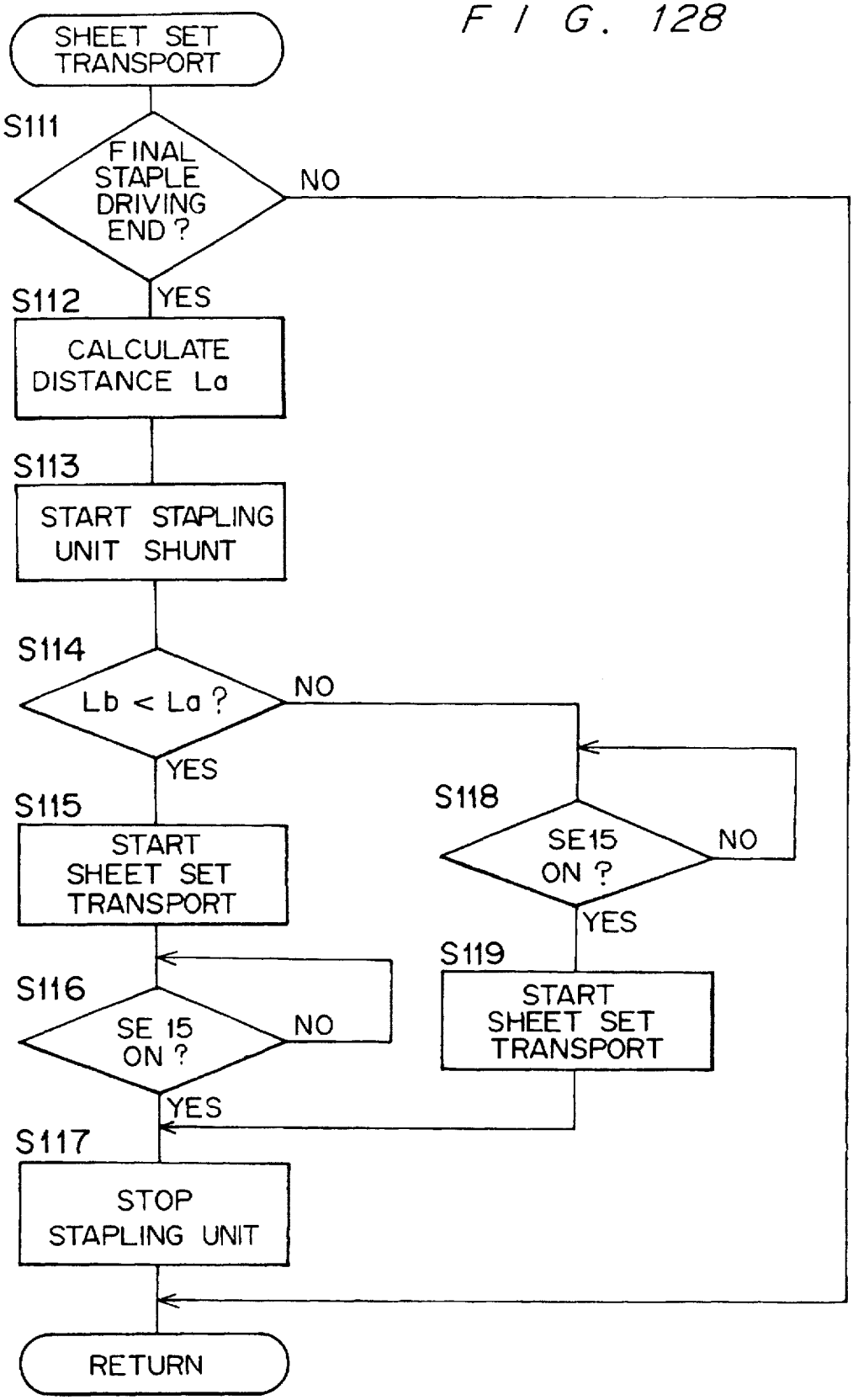
FIG. 128 is a flow chart showing a second example of control procedure for transport of a set of sheets after the set of sheets having been stapled.

FIG. 128 is a second example of the control sequence for the transport of sheet set after stapling operation.

First, at step S111, it is verified that the final staple driving is ended. Then, at step S112, the distance La between the leading edge of the sheet set and the connector 445 is calculated, and at step S113, the shunting of the stapling unit 441 to its home position H is started. At step S114, the distance La is calculated with the distance Lb. the distance Lb correspond to the shortest distance which involves no possible interference of the connector 445 with the sheet set even if the shunting of the stapling unit 441 and the transport of the sheet set are started simultaneously. Where Lb<La, there is no interference and, therefore, at step S115, the transport of the sheet set is started. Next, at step S116, it is verified that the sensor SE15 is on, i.e., that the stapling unit 441 has been shunted to its home position H. Then, at step S117, the stapling unit 441 is stopped.

If Lb≧La, there is possible interference. Therefore, at step S118, check is made to see the sensor SE15 is on and, at step 119, the transport of the sheet set is commenced. Then, at step S117, the stapling unit 441 is stopped.

(Change of Stapling point)

When a plurality of stapled sheet sets are stored on the storing tray 475, the sheet sets on the tray 475 tend to go out of alignment because of the bulkiness of the stapled portions. In order to avoid such a trouble, a good solution is to change the stapling point with respect to odd number'th sheet sets and even number'th sheet sets. Handling procedure for this purpose will be explained below.

Figure 129:
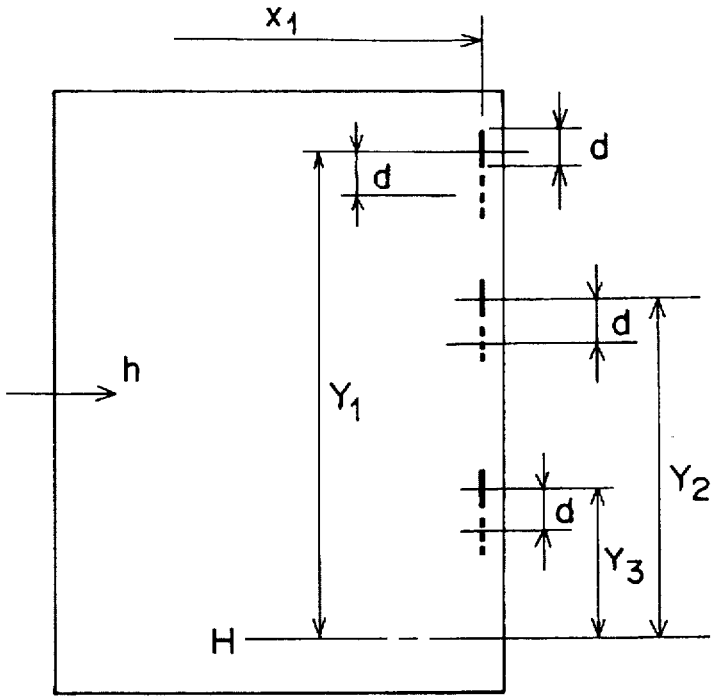
FIG. 129 is an explanatory view showing stapling points changed (lengthwise of staple) with respect to the set of sheets.
Figure 130:
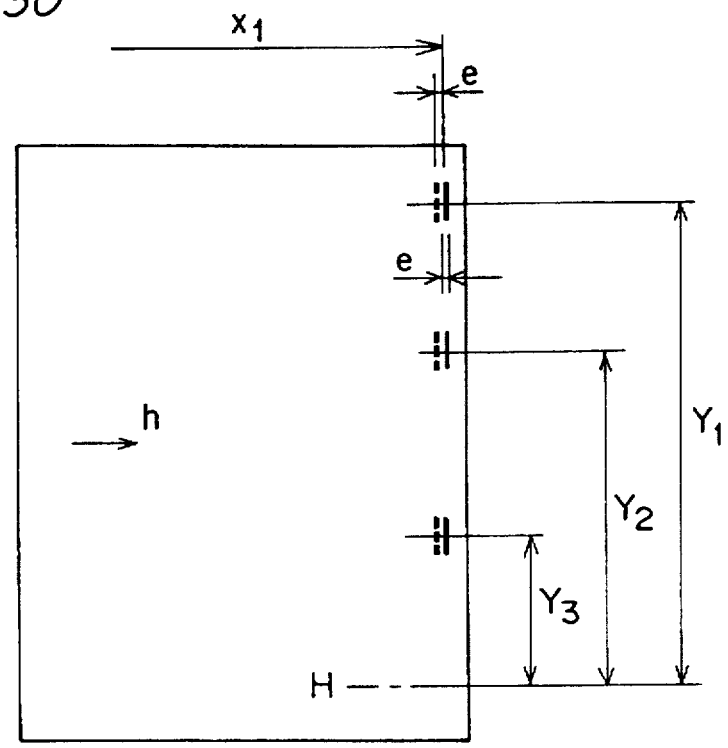
FIG. 130 is an explanatory view showing stapling points changed (widthwise of staple) with respect to the set of sheets.
Figure 131:
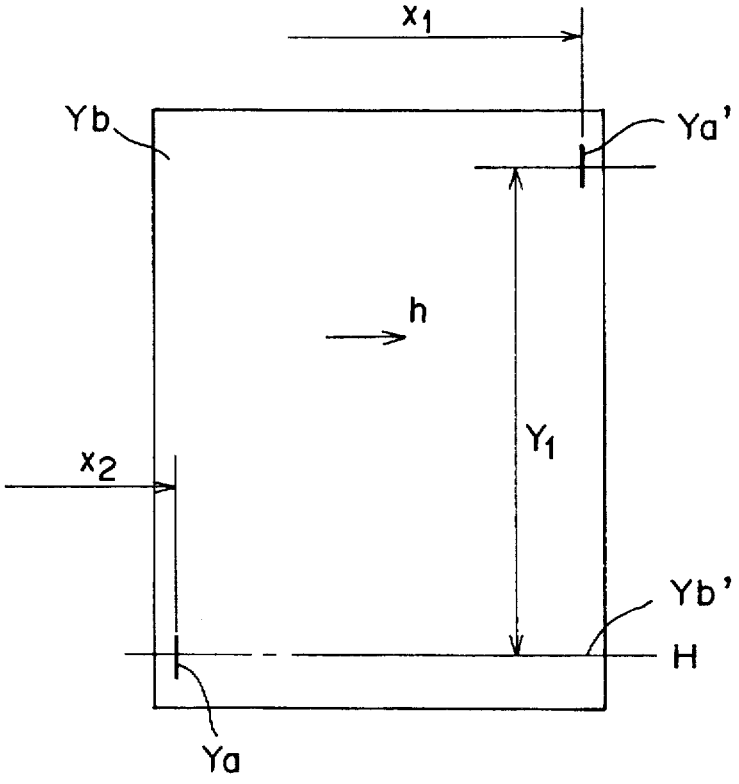
FIG. 131 is an explanatory view showing stapling point changed (to leading portion or trailing portion) with respect to the set of sheets.

Specifically, as FIG. 129 shows, the stapling point is shifted correspondingly to the length of each staple (type 1); as FIG. 130 shows, the stapling point is shifted correspondingly to the width of each staple (type 2); or as FIG. 131 shows, leading portion stapling and trailing portion stapling are alternately carried out (type 3). Types 1, 2 are applicable to both leading portion stapling and trailing portion stapling.

(Type 1)

Referring to type 1, as FIG. 129 shows, in the case of corner stapling, the stapling unit 441 moves distance $Y_1$ from the home position H to apply a staple with respect to an odd number'th sheet set, and moves distance $Y_1$–d to apply a staple with respect to an even number'th sheet set. In the case of side stapling (at 2 points), the stapling unit 441 moves distance $Y_2$ and distance $Y_3$ from the home position H to apply staples with respect to an odd number'th sheet set, and moves $Y_2$–d and distance $Y_3$–d to apply staples with respect to an even number'th sheet set. FIG. 129 illustrates the case of leading portion stapling, but the same applies to trailing portion stapling. It is noted, however, that in the case of trailing portion stapling, the stapling unit 441 applies staple at the home position H. Therefore, the stapling unit 441 does not move for stapling an odd number'th sheet set, but moves distance d only for stapling an even number'th sheet set.

Figure 132:
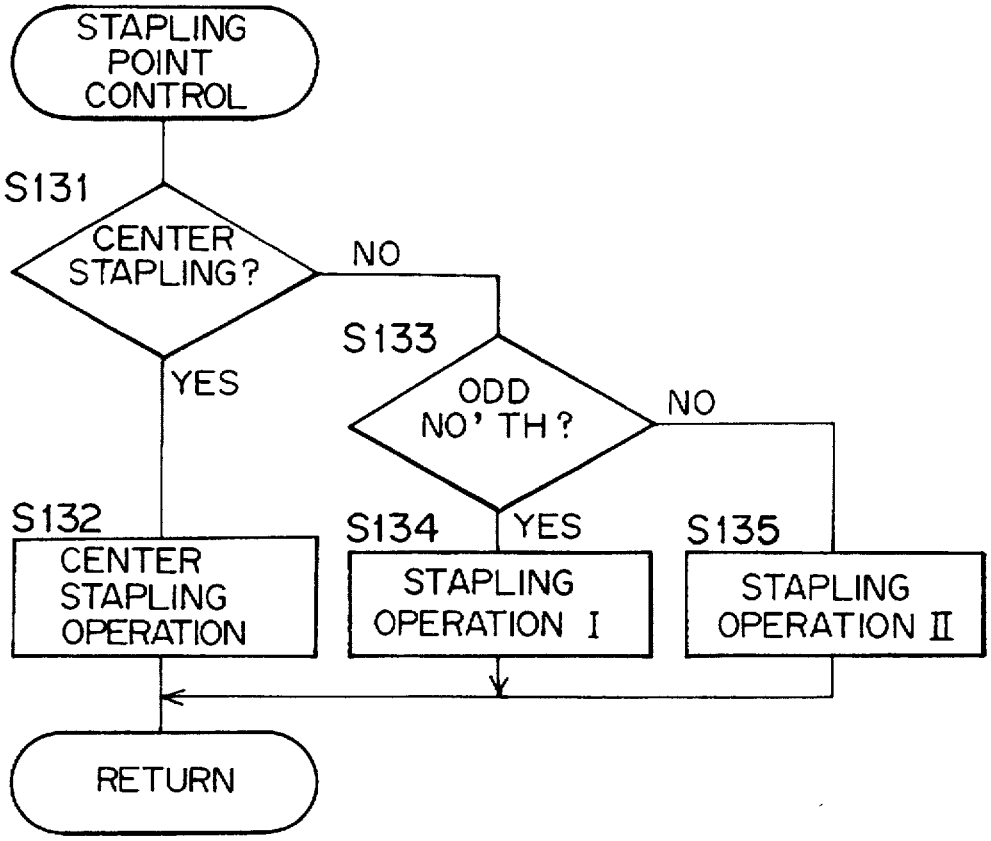
FIG. 132 is a flow chart showing staple point control procedure (type 1 and 2)
Figure 133:
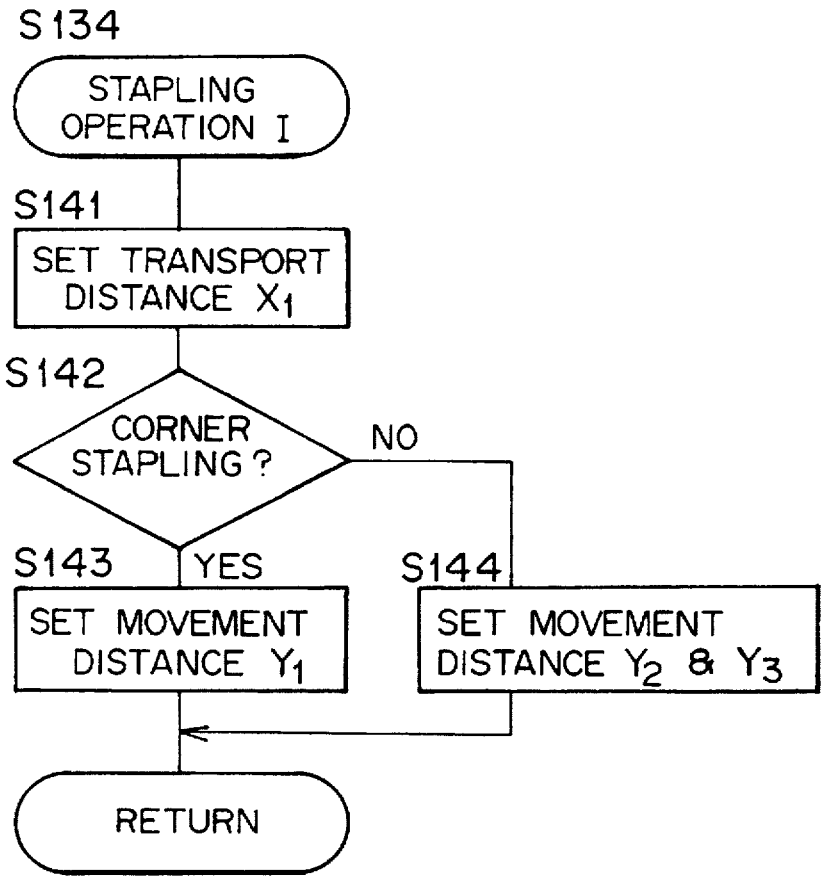
FIG. 133 is a flow chart showing stapling operation I (type 1 and 2)
Figure 134:
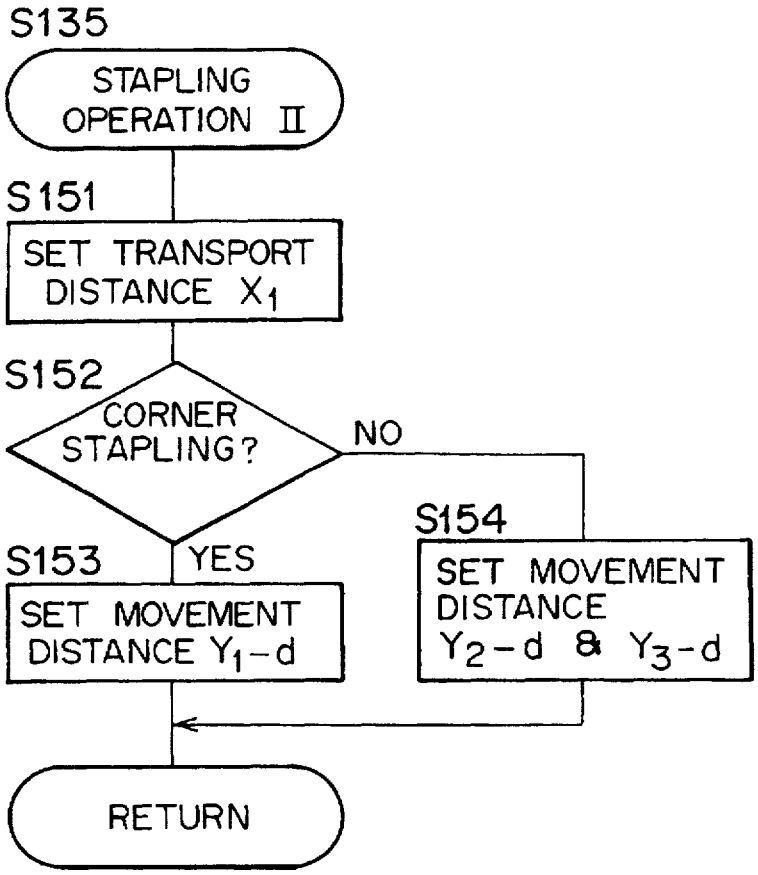
FIG. 134 is a flow chart showing stapling operation II (type 1)

FIGS. 132, 133 and 134 show procedures for the stapling point control in the case of type 1. In FIG. 132, first at step S131, judgment is made whether the required stapling mode is the center stapling or not. If yes, the center stapling operation is executed at step S132. In the center stapling operation, no change is made in the stapling point. If not, the required stapling mode is the leading portion stapling or the trailing portion stapling. In that case, at step S133, Judgment is made whether the sheet set to be stapled is an odd number'th set or not. If odd number'th, at step S134, stapling operation I is executed. If even number'th, at step S135, stapling operation II is executed.

FIG. 133 shows the control procedure for the stapling operation I (odd number'th) at step S134. For the present purpose, the leading portion stapling will be explained. First, at step S141, the distance of sheet set transport by the first chucking device 415 is set to $x_1$ and transport is effected. Sheet set transport is carried out after the leading edge of sheet set transported by the first chucking device 415 is detected by the sensor SE18, and by controlling the time for stopping motor M2.

Next, at step S142, judgment is made whether the required stapling mode is the corner stapling or not. If yes, at step S143, the distance of movement of the stapling unit 441 is set to $Y_1$ (see FIG. 129), and the corner stapling operation is carried out. Where the opposite corner is to be stapled, the stapling unit 441 carries out the stapling operation as it is positioned at its home position H.

If the side (2 points) stapling (NO at step S142), at step S144, the distance of movement of the stapling unit 441 is set to $Y_2$ and $Y_3$ (see FIG. 129) and the side stapling operation is carried out.

FIG. 134 shows the control procedure for the stapling operation II (even number'th ) at step S135. In this case, too, the leading portion stapling will be described. First, at step S151, the distance of sheet set transport is set to $x_1$ and transport is made accordingly. This processing is the same as that at step S141. Next, at step S152, judgment is made whether the required stapling mode is the corner stapling or not. If the corner stapling, at step S153, the distance of movement of the stapling unit 441 is set to $Y_{1-d}$ (see FIG. 129) and the stapling operation is carried out. For the purpose of opposite corner stapling, the distance of movement involved is either +d or −d.

If the side (2 points) stapling (NO at step S152), then at step S154, the distance of movement of the stapling unit 441 is set to $Y_2$−d and $Y_3$−d (see FIG. 129) and the side stapling operation is performed. In the present case, the distance of movement of the stapling unit 441 may be $Y_2$−d and $Y_3$−d.

(Type 2)

In the case of type 2, as FIG. 130 shows, each odd number'th sheet set is transported the distance $X_1$ by the first chucking device 415 and is subjected to stapling. Each even number's sheet set is transported the distance $x_1$−e and is subjected to stapling. The distance of movement of the stapling unit 441 is the same for all sheet sets, say, $Y_1$, $Y_2$ and $Y_3$. While FIG. 130 shows the leading portion stapling, for the purpose of the trailing portion stapling, the distance of sheet set transport may be shifted by the amount of e with respect to each even number'th sheet set.

Figure 135:
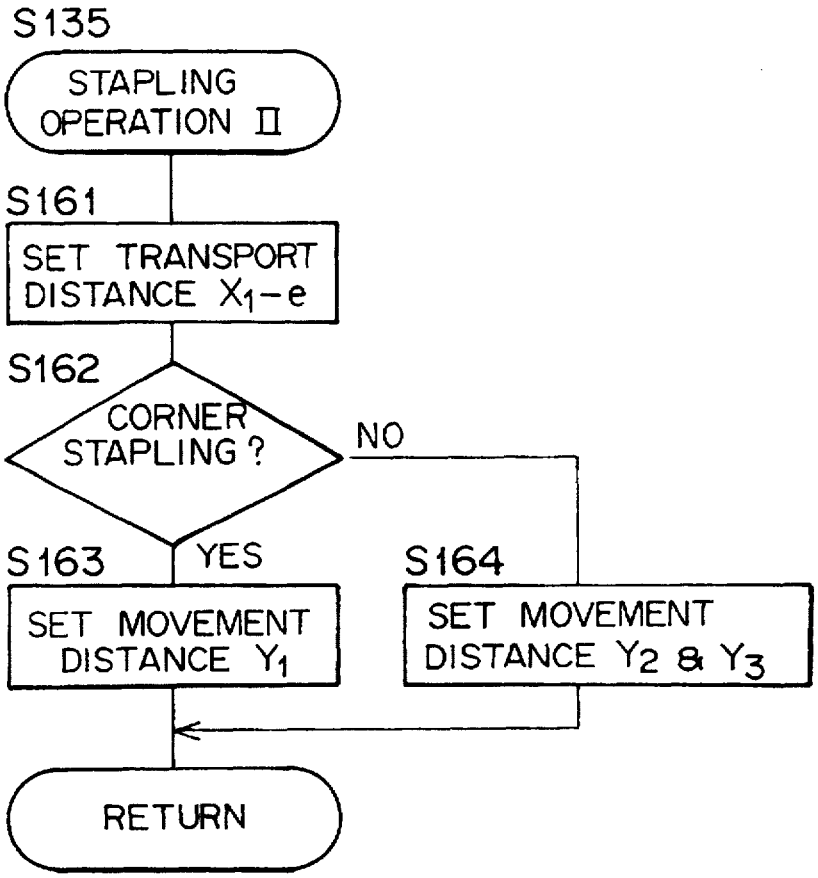
FIG. 135 is a flow chart showing stapling operation II (type 2)

The control procedure for type 2 is basically the same as that for type 1. Thus, processing operations as shown in FIGS. 132 and 133 are carried out. The stapling operation II for each even number'th sheet set at step S135 is executed in accordance with the flow chart shown in FIG. 135, instead of FIG. 134. According to the control procedure shown in FIG. 135, first, at step S161, the distance sheet set transport is set to $x_1$−e and the transport is carried out. Transport of each sheet set is carried out after the leading edge of the sheet set transported by the first chucking device 415 is detected by the sensor SE18, and by controlling the timing for stopping the motor M2. In this case, the distance of sheet set transport may be $x_1$+e.

Next, at step S162, judgment is made whether the required stapling mode is the corner stapling or not. If yes, at step S163, the distance of movement of the stapling unit 441 is set to $Y_1$ and the stapling is performed. If the side (2 points) stapling, at step S164, the distance of movement of the staple unit 441 is set to $Y_2$ and $Y_3$ and the side stapling is carried out.

In the case of the trailing portion stapling, a sheet set is delivered from the first chucking device 415 to the transport rollers 469, 470, and the distance of sheet set transport is determined after the leading edge of the sheet set transported by the transport rollers 469, 470 is detected by sensor SE19 and by controlling the timing for stopping the rotation of the transport rollers 469, 470. Therefore, by controlling the time involved after the sensor SE19 is turned on until the rotation of the transport rollers 469, 470 is stopped it is possible to shift the distance of transport by quantity e.

(Type 3)

Type 3 mode is executed in case where the length of sheet set as viewed in the direction of transport is shorter than the length $L_9$ shown in FIG. 24, or in other words, the length of sheet set in the direction of transport is less than ½ of a maximum available transport length of the transport unit 465, and that both the leading portion stapling and the trailing portion stapling are possible. As FIG. 131 shows, each odd-number'th sheet set is transported the distance $x_1$ and subjected to the leading portion stapling, and each even number'th sheet set is transported the distance $x_2$ and subjected to the trailing portion stapling.

Figure 136:
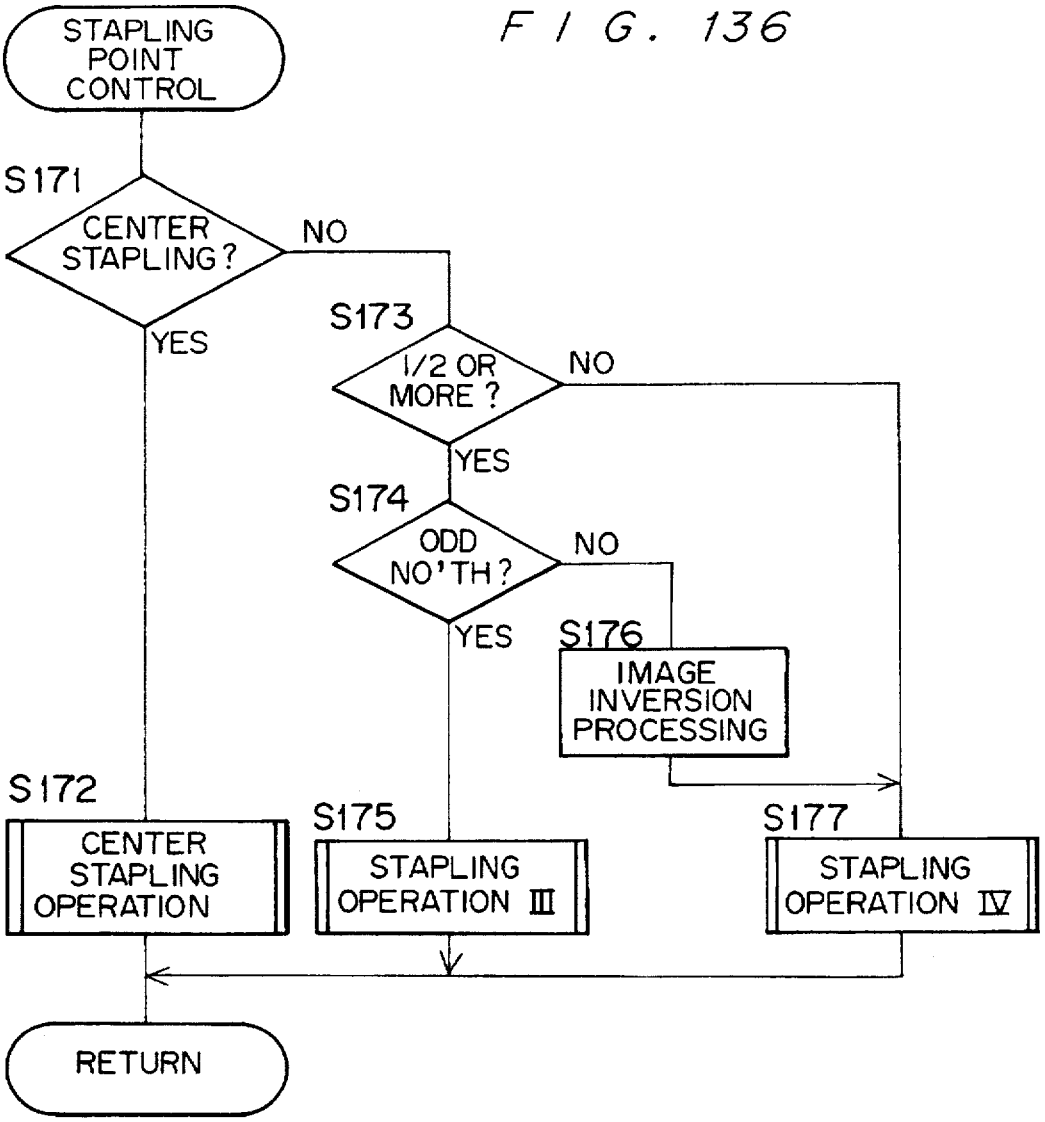
FIG. 136 is a flow chart showing stapling point control procedure (type 3)
Figure 137:
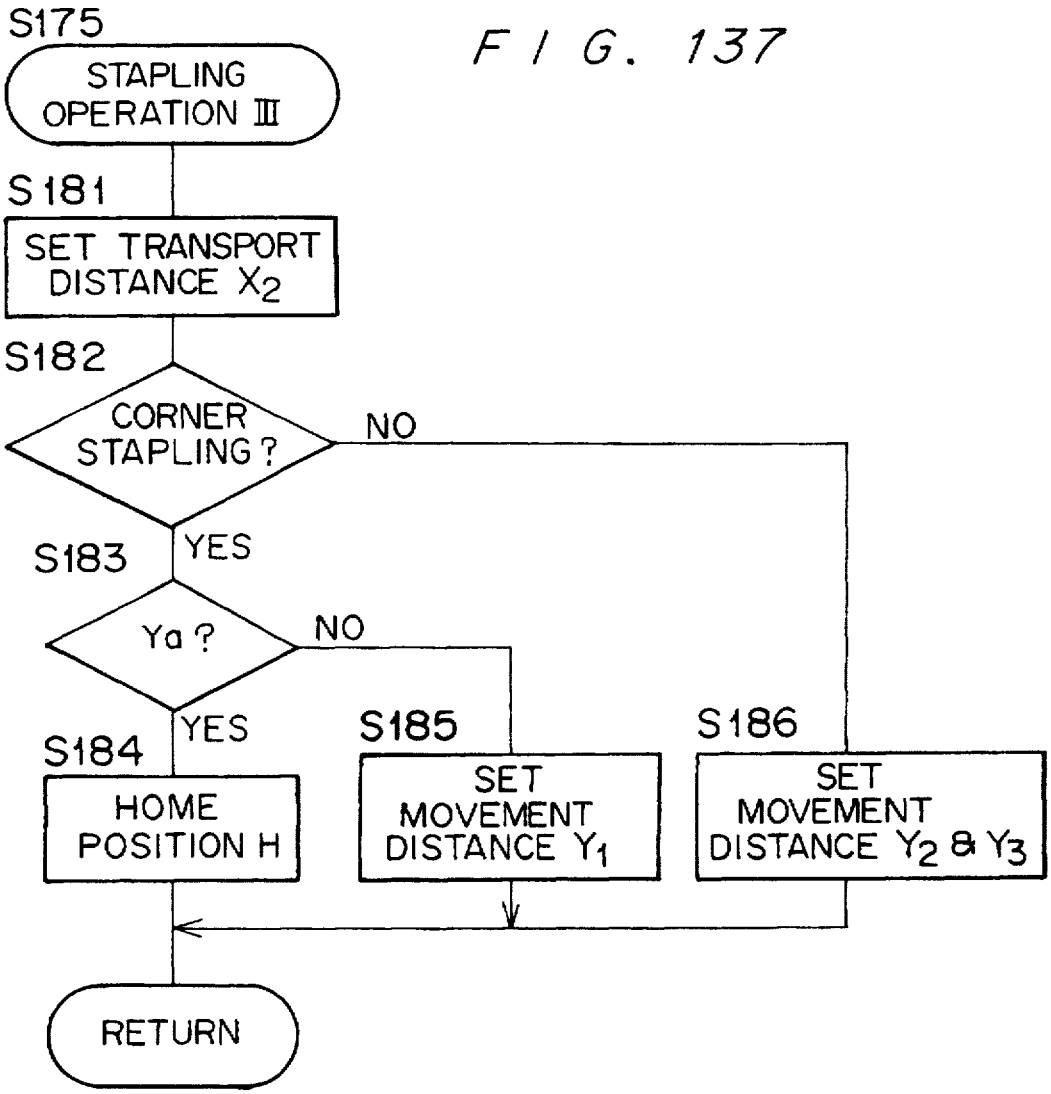
FIG. 137 is a flow chart showing stapling operation III (type 3)
Figure 138:
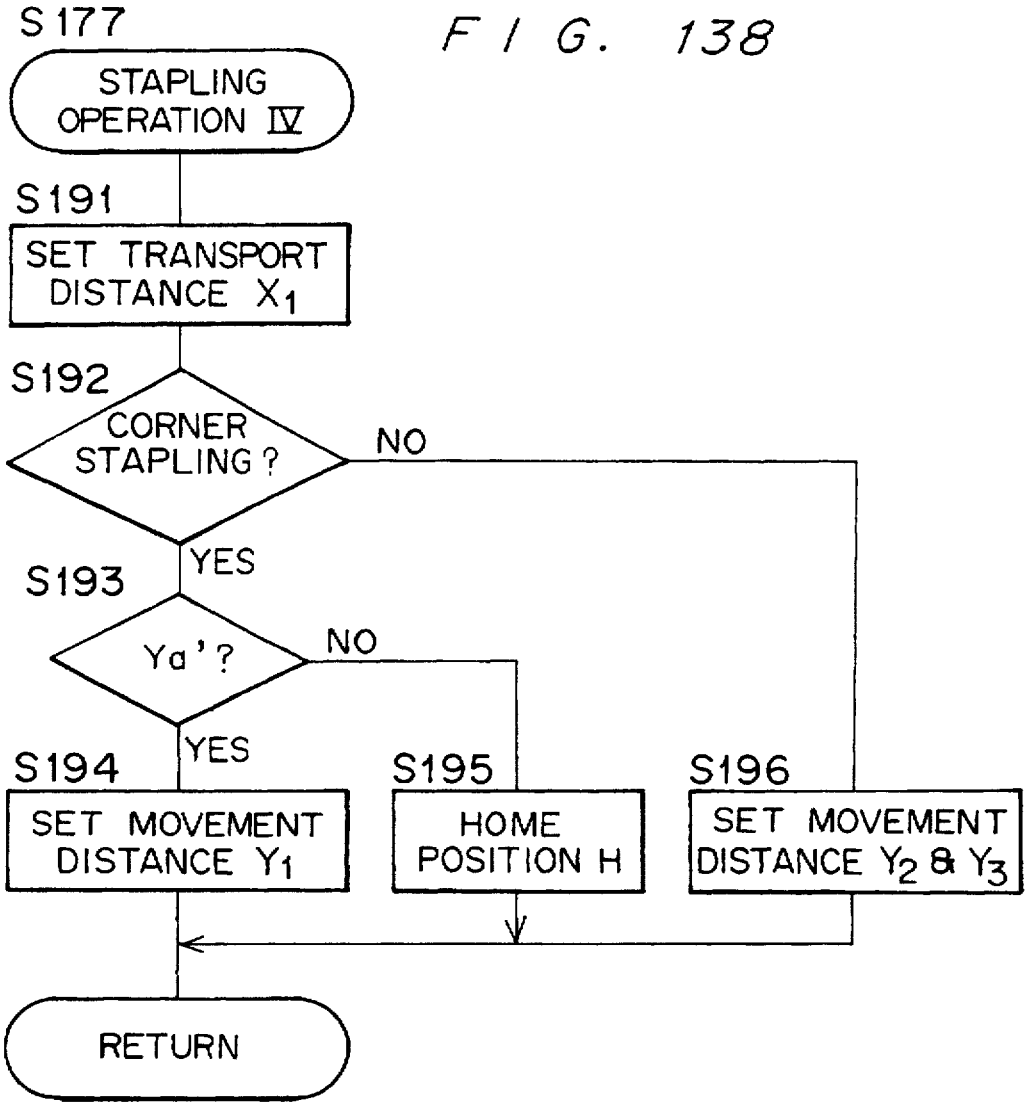
FIG. 138 is a flow chart showing stapling operation IV (type 3)

FIGS. 136, 137, 138 show procedures for the stapling point control in the case of type 3. In FIG. 136, first at step S171, judgment is made whether operation is of the center stapling mode. If the mode is the center stapling, at step S172 the center stapling is carried out. If not, at step S173, judgment is made whether the length of the sheet set is less than ½ of the maximum available transport length of the transport unit 465. If less than ½, at step S174, Judgment is made whether the sheet set is odd-number'th or not in order to allow the leading portion stapling and the trailing portion stapling to be executed in alternate intervals. If the sheet is odd-number'th, at step S175, the stapling operation III (trailing portion stapling) is executed. If the sheet is even-number'th, at step S176, image inversion processing for 180° image inversion is carried out at the machine 10 so that images are formed on sheets, and with respect to sets of such sheets, the stapling operation IV (leading portion stapling) is executed. The reason why 180° image inversion is carried out in the case of the leading portion stapling is that the left-hand staple relative to the image is intended to be made possible.

In case that the length of the sheet set is more than ½ of the maximum available transport length of the transport unit 465, the trailing portion stapling is impossible. Therefore, at step S177, the stapling operation IV (leading portion stapling) is carried out.

FIG. 137 shows procedure for the stapling operation III (odd number'th set/trailing portion stapling) at step S175. First, at step S181, the distance of sheet set transport is set to $x_2$ and each sheet set is transported by the first chucking device 415 and the transport rollers 469, 470. Then, at step S182, judgment is made whether the mode is the corner stapling or not. If yes, at step S183, judgment is made whether the stapling point relative to the first sheet set is Ya (see FIG. 131) or not. If yes, at step S184, the corner stapling is carried out with the stapling unit 441 set at its home position H. If the stapling point is Yb (NO at step S183), at step S185, the distance of movement of the stapling unit 441 is set to $Y_1$ and the corner stapling is carried out.

If stapling operation is the side (2 points) stapling (NO at step S182), at step S186, the distance of movement of the stapling unit 441 is set to $Y_2$ and $Y_3$, and the side stapling is carried out.

FIG. 138 shows procedure for the stapling operation IV (even number'th/leading portion stapling or large-size sheet leading portion stapling). First, at step S191, the distance of sheet set transport is set to $x_1$, and the sheet set is transported by the first chucking device 415. Then, at step S192, judgment is made whether the mode is the corner stapling or not. If yes, at step S193, judgment is made whether the stapling point relative to the first sheet set is Ya' (see FIG. 131) or not. If yes, at step S194, the distance of movement of the stapling unit 441 is set to $Y_1$ and the corner stapling is carried out. If the stapling point is Yb' (NO at step S193), at step S195, the corner stapling is carried out with the stapling unit 441 set at its home position H.

If the mode is the side (2 points) stapling (NO at step S192), at step S196, the distance of movement of the stapling unit 441 is set to $Y_2$ and $Y_3$, and the side stapling is carried out.

In he case of type 3, sheets of each odd number'th set are subjected to 180° image inversion processing for image formation, and each set of such sheets is stapled at leading portion. For sheets of each odd number'th set, it is possible that image is formed without image inversion, each set of such sheets being stapled at trailing portion. As shown in FIGS. 136, 137 and 138, however, sheets of each odd number'th set need not be subjected to the image inversion processing when each set of such sheets is stapled at trailing portion. In this case, when the first document image has not entirely been read by image reader, the copying operation can be started while reading is still in progress, or when the first set of sheets is still in the course of being stapled, a next set of sheets can be delivered onto the stacking tray 411. This provides for improvement of copy productivity.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A finisher in which sheets discharged from an image forming apparatus are collected through a predetermined path of sheet transport, and in which a stapling finish is given to a set of collected sheets, comprising:

sheet stacking means for receiving sheets discharged from the image forming apparatus and stacking them one over another;

transport means for transporting a set of sheets from the sheet stacking means; and stapling means for driving staples with respect to the set of sheets transported by the transport means from the sheet stacking means;

wherein the stapling means includes a sheet set transport section, a staple head, a staple anvil and a connector for interconnecting the staple head and the staple anvil, the staple head and the staple anvil being disposed across the sheet set transport section, and the staple head and the staple anvil having some positions set at a corner stapling position, the connector having a home position set at a location offset outward from a track of sheet set transport, the staple head, the staple anvil and the connector being integrally reciprocally shiftable from their respective home positions in a direction perpendicular to a direction of sheet set transport.

2. A finisher as set forth in claim 1, wherein the connector is comprised of a pair of curved members and includes guide plates for guiding a set of sheets to opposed interior sides of the curved members.

3. A finisher as set forth in claim 2, wherein the curved members are each fitted with rollers for sheet transport.

4. A finisher in which sheets discharged from an image forming apparatus are collected through a predetermined path of sheet transport, and in which a stapling finish is given to a set of collected sheets, comprising:

a stapling tray for receiving sheets to be stapled and stacking them one over another;

a non-sort tray for receiving sheets not to be stapled and stacking them one over another, the non-sort tray being positioned above the stapling tray;

stapling means for driving staples with respect to a set of sheets stacked on the stapling tray;

a storing tray capable of storing a large volume of sheets, the storing tray being positioned below the stapling tray;

sheet transport means for selectively transporting sheets discharged from the image forming apparatus to the stapling tray, the non-sort tray, or the storing tray; and sheet set transport means for transporting a sheet set stapled by the stapling means to the storing tray.

5. A finisher as set forth in claim 4, wherein the sheet transport means has a function such that when the non-sort tray is fully occupied with sheets, the sheet transport means transports succeeding sheets to the storing tray.

6. A finisher for effecting a stapling finish with respect to a set of sheets discharged from an image forming apparatus and collected as such, comprising:

stacking means for receiving sheets discharged from the image forming apparatus and stacking them one over another;

transport means for transporting a set of sheets from the stacking means;

stapling means for driving staples with respect to a set of sheets transported from the stacking means, the stapling means being shiftable in a direction perpendicular to a direction of sheet set transport and capable of driving staples at a plurality of points in the direction of shift movement of the stapling means;

a sheet set transport unit for transporting a stapled sheet set in the same direction as the direction of sheet set transport from the stacking means; and a sheet storing unit for storing sheet sets transported through the sheet set transport unit.

7. A finisher as set forth in claim 6, wherein a distance between a position for regulating a leading edge of sheets on the stacking means as viewed in the direction of sheet transport and a stapling position is longer than a distance between a trailing edge of a sheet set placed at a trailing portion stapling position and the stapling position.

8. A finisher for effecting a stapling finish with respect to a set of sheets discharged from an image forming apparatus and collected as such, comprising:

stacking means for receiving sheets discharged from the image forming apparatus and stacking them one over another;

stapling means for driving staples with respect to a set of sheets transported from the stacking means, the stapling means being shiftable in a direction perpendicular to a direction of sheet set transport and capable of driving staples at a plurality of points in the direction of shift movement of the stapling means, the stapling means being adapted to be shunted outward of a sheet transport path after the end of a stapling operation;

detecting means for detecting the shunting of the stapling means out of the sheet transport path;

sheet set transport means for transporting a stapled sheet set; and control means operative to increase the sheet set transport speed of the sheet set transport means upon detection by the detecting means of the shunting of the stapling means out of the sheet transport path.

9. A finisher for effecting a stapling finish with respect to a set of sheets discharged from an image forming apparatus and collected as such, comprising:

stacking means for receiving sheets discharged from the image forming apparatus and stacking them one over another;

stapling means for driving staples with respect to a set of sheets transported from the stacking means, the stapling means being shiftable in a direction perpendicular to a direction of sheet set transport and capable of driving staples at a plurality of points in the direction of shift movement of the stapling means, the stapling means being adapted to be shunted outward of a sheet transport path after the end of a stapling operation;

sheet set transport means for transporting a stapled sheet set; and control means for controlling the shifting of the stapling means and the sheet set transport operation of the sheet set transport means, the control means being operative to set timing for start of shifting of the stapling means to its shunted position after the end of a final staple driving so as to coincide with timing for start of sheet set transport by the sheet set transport means if, during the process of stapling, spacing between a position of a leading edge of the sheet set and a position of the stapling means interference with the sheet set is substantially large.

10. A finisher for effecting a stapling finish with respect to a set of sheets discharged from an image forming apparatus and collected as such, comprising:

stacking means for receiving sheets discharged from the image forming apparatus and stacking them one over another;

sheet set transport means for transporting a sheet set from the stacking means to selectively deliver the sheet set to a plurality of stapling positions;

stapling means for driving staples with respect to a sheet set transported by the sheet set transport means; and shift means for shifting the stapling means in a direction perpendicular to a direction of sheet set transport, the shift means being adapted to stop the stapling means once at any shifted position.

11. A finisher as set forth in claim 10, wherein the stapling means includes a staple head, a staple anvil and a connector for interconnecting the staple head and the staple anvil, the connector having a length of at least one half of a maximum sheet length allowable for sheet transport.

12. A finisher wherein sheets discharged successively from an image forming apparatus are stacked one over another into a set for being stapled, the finisher comprising:

a stacking tray for stacking sheets one at a time;

stapling means for effecting a stapling finish with respect to a set of sheets collected on the stacking tray;

a storing tray for storing stapled sets of sheets thereon; and control means for changing an on-the-sheet stapled point for each predetermined number of sheet sets.

13. A finisher as set forth in claim 12, wherein the control means offsets a stapling point in a lengthwise direction of staples on a set by set basis.

14. A finisher as set forth in claim 12, wherein the control means offsets a stapling point in a widthwise direction of staples on a set by set basis.

15. A finisher as set forth in claim 12, wherein the control means repeats a trailing portion stapling and a leading portion stapling in alternate sequence.

16. The finisher as set forth in claim 10, wherein the plurality of stapling positions are along a direction of sheet transport.

17. The finisher as set forth in claim 4, wherein the sheet transport means transports non-stapled sheets discharged from the image forming apparatus to the stapling tray, the non-sort tray, or the storage tray.

* * * * *

UNITED STATES PATENT AND TRADEMARK OFFICE

CERTIFICATE OF CORRECTION

PATENT NO. : 5,797,596

DATED : August 25, 1998

INVENTOR(S) : Yuusuke MORIGAMI et al.

It is certified that error appears in the above-identified patent and that said Letters Patent is hereby corrected as shown below:

In Column 39, line 54, delete "some" and insert -- home --.

Signed and Sealed this

Sixteenth Day of February, 1999

*Attest:*

*Attesting Officer*

*Acting Commissioner of Patents and Trademarks*